US005187056A

United States Patent [19]

Saito et al.

[11] Patent Number: 5,187,056

[45] Date of Patent: Feb. 16, 1993

[54] SILVER HALIDE COLOR PHOTOGRAPHIC MATERIAL

[75] Inventors: Naoki Saito; Keiji Mihayashi, both of Kanagawa, Japan

[73] Assignee: Fuji Photo Film Co., Ltd., Kanagawa, Japan

[21] Appl. No.: 737,274

[22] Filed: Jul. 29, 1991

[30] Foreign Application Priority Data

Jul. 30, 1990 [JP] Japan ..... 2-201845

[51] Int. Cl.[5] ..... G03C 7/36

[52] U.S. Cl. ..... 430/544; 430/557; 430/558; 430/957

[58] Field of Search ..... 430/556, 557, 544, 957, 430/558

[56] References Cited

U.S. PATENT DOCUMENTS 5,066,576 11/1991 Ichijima et al. ..... 430/557

FOREIGN PATENT DOCUMENTS 51-104825 9/1976 Japan .
52-82423 7/1977 Japan .
1-233452 9/1989 Japan .
2-28645 1/1990 Japan .

*Primary Examiner*—Lee C. Wright
*Attorney, Agent, or Firm*—Birch, Stewart, Kolasch & Birch

[57] ABSTRACT

The present invention relates to a silver halide color photographic material, which contains a novel yellow coupler of formula (I) in at least one hydrophilic colloid layer which is provided on a support, (I)

where $R^1$ represents a non-metallic atomic group necessary for forming a 5-membered unsaturated hetero ring together with a residue of in the formula; $R^2$ represents a hydrogen atom, an aliphatic group, an aromatic group, or a heterocyclic group; $R^3$ represents an organic residue; X represents a group capable of splitting off from the formula when the compound has reacted with the oxidation product of an aromatic primary amine developing agent; A represents an acidic dissociating group which may be at any substitutable position in the formula; and n represents an integer of 1 or more; provided that when A is a substituent in X, the X as split off from the formula when the compound has reacted with the oxidation product of a developing agent does not further react with the oxidation product of the developing agent. The coupler has an high dye-forming speed to form a dye with a high color density and a high color fastness, and the photographic material containing the coupler is processed to form a color image with an improved sharpness, an elevated sensitivity and an elevated color fastness.

14 Claims, No Drawings

SILVER HALIDE COLOR PHOTOGRAPHIC MATERIAL

FIELD OF THE INVENTION

The present invention relates to a silver halide color photographic material containing a novel yellow dye-forming coupler (hereinafter referred to as a "yellow coupler") and, more precisely, to a silver halide color photographic material containing a novel yellow coupler having a high dye-forming speed for forming a dye having a high color density and a high color fastness. The photographic material of the invention containing such a novel yellow coupler may be processed to form a color image with an improved sharpness, an elevated sensitivity and an elevated color fastness.

BACKGROUND OF THE INVENTION

A color photographic material is exposed and then color-developed, whereupon the oxidized aromatic primary amine developing agent in the color developer reacts with couplers in the material to give a color image. In the present system for forming color images, color reproduction by a subtractive color process is employed, where yellow, magenta and cyan color images are formed for the reproduction of blue, green and red, the former being complementary to the latter, respectively.

The indispensable features of couplers are that they not only are capable of forming dyes but the dyes to be formed have an excellent spectral absorption characteristic, the dyes have a high color density, the couplers have a high dye-forming speed, and the dyes to be formed from the couplers have high fastness to light, heat and moisture.

As yellow couplers capable of forming yellow dyes, compounds having an active methylene group are generally used; and acylacetanilide couplers and malondianilide couplers are widely known. The former are widely used as the most popular yellow couplers. They may form dyes having excellent color hue and color fastness, but they have drawbacks that the color density of the dyes to be formed is low and the color-forming speed is low. In particular, when the couplers are to be used as DIR couplers (which may release a development inhibitor when reacted with the oxidation product of an aromatic primary amine developing agent and which are used for the purpose of improving the sharpness and color-reproducibility of the images to be formed), the drawbacks are fatal.

Examples of improved yellow couplers which are free from the above mentioned drawbacks include azolyl acetate couplers described in JP-A-51-104825 (the term "JP-A" as used herein means an "unexamined published Japanese patent application") and azolylacetanilide couplers described in JP-A-52-82423, 1-233452 and 2-28645. However, it is desired to further improve the couplers with respect to the fastness of the dyes to be formed as well as to the dye-forming speed.

SUMMARY OF THE INVENTION

One object of the present invention is to provide a novel yellow coupler having a high dye-forming speed and which is able to form a dye with high color density and high color fastness.

Another object of the present invention is to provide a silver halide color photographic material containing such a novel yellow coupler, which may produce a color image having an elevated sharpness, an elevated color reproducibility, an elevated sensitivity and an elevated color image fastness.

The objects have been attained by a silver halide color photographic material which contains a compound of the following general formula (I) in at least one hydrophilic colloid layer as provided on a support:

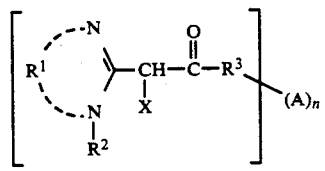

(I)

wherein $R^1$ represents a non-metallic atomic group necessary for forming a 5-membered unsaturated hetero ring together with a residue of

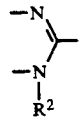

in the formula; $R^2$ represents a hydrogen atom, an aliphatic group, an aromatic group, or a heterocyclic group; $R^3$ represents an organic residue; X represents a group capable of splitting off from the formula when the compound has reacted with the oxidation product of an aromatic primary amine developing agent; A represents an acidic dissociating group which may be at any substitutable position in the formula; and n represents an integer of 1 or more; provided that when A is a substituent in X, the X as split off from the formula when the compound has reacted with the oxidation product of a developing agent does not further react with the oxidation product of the developing agent.

DETAILED DESCRIPTION OF THE INVENTION

Couplers of formula (I) which are used in the present invention will be explained in detail hereunder.

In formula (I), $R^1$ represents a non-metallic atomic group necessary for forming a heterocyclic unsaturated 5-membered ring together with a residue of

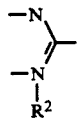

in the formula. In the 5-membered unsaturated hetero ring to be represented by:

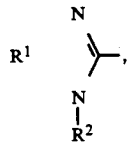

the other two ring-forming atoms than the two nitrogen atoms and the one carbon atom therein may be independently a carbon atom, a nitrogen atom, a sulfur atom, a selenium atom or a tellurium. Of these atoms, preferred are a carbon atom and a nitrogen atom. The hetero ring may optionally be substituted or may be in the form of a condensed ring. The condensed ring may further be substituted. As examples of substituents which may be in the hetero ring and condensed ring, there are mentioned an aliphatic group (for example, methyl, ethyl, n-propyl, 2-ethylhexyl), an aromatic group (for example, phenyl, naphthyl), a heterocyclic group (for example, 2-pyridyl, N-morpholyl, N-succinimido), a halogen atom (for example, fluorine, chlorine, bromine), a nitro group, a cyano group, an acyl group (for example, acetyl, benzoyl), an acyloxy group (for example, acetoxy, benzoyloxy), a hydroxyl group, an alkoxy group (for example, methoxy, ethoxy, 2-ethylhexyloxy), an aryloxy group (for example, phenoxy, naphthoxy), an alkoxycarbonyl group (for example, methoxycarbonyl, ethoxycarbonyl), an aryloxycarbonyl group (for example, phenoxycarbonyl, naphthoxycarbonyl), a carbamoyl group (for example, N,N-dimethylcarbamoyl, N-phenylcarbamoyl), an amino group, an acylamino group (for example, acetylamino, benzoylamino, furoylamino), an alkoxycarbonylamino group (for example, ethoxycarbonylamino, n-butoxycarbonylamino), an aryloxycarbonylamino group (for example, phenoxycarbonylamino, naphthoxycarbonylamino), a carbamoylamino group (for example, (N,N-diethylcarbamoyl)amino, (N-phenylcarbamoyl)amino), a sulfonyl group (for example, methanesulfonyl, benzenesulfonyl, tosyl), a sulfonylamino group (for example, methanesulfonylamino, benzenesulfonylamino), a sulfamoyl group (for example, N,N-diethylsulfamoyl, N-phenylsulfamoyl), and a sulfamoylamino group (for example, (N,N-diethylsulfamoyl)amino, (N-phenylsulfamoyl)amino). These substituents may further be substituted by other various substituents.

In formula (I), the 5-membered unsaturated heterocyclic group to be represented by:

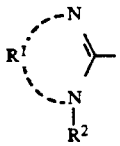

is especially preferably a group of the following general formulas (A) or (B):

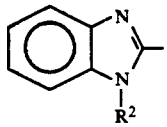

(A)

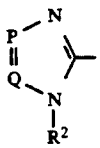

(B)

In formulae (A) and (B), $R^2$ has the same meaning as $R^2$ in formula (I). In formula (B), P and Q independently represent a carbon atom or a nitrogen atom.

The heterocyclic group to be represented by formula (A) or (B) may have one or more substituents. As examples of substituents which may be in the group of formula (A) or (B), those mentioned for the heterocyclic group of:

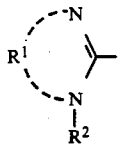

are referred to.

In formula (I), the aliphatic group of $R^2$ includes, a straight chain or branched, linear or cyclic, and saturated or unsaturated aliphatic group having preferably from 1 to 30 and more preferably from 1 to 22 carbon atoms, for example, a methyl group, an ethyl group, a vinyl group, an allyl group, a 2-ethylhexyl group, a cyclohexyl group and a 2-(n-hexyl)-n-decyl group. Additional examples of suitable aliphatic groups include those mentioned for group $R^3$ discussed hereinbelow.

In formula (I), the aromatic group of $R^2$ includes the group having preferably from 6 to 20 and more preferably from 6 to 10 carbon atoms, for example, a phenyl group, a 2-naphthyl group, and a 2-anthracenyl group. Further examples of representative aromatic groups include those discussed below for group $R^3$.

In formula (I), the heterocyclic group of $R^2$ includes preferably a 5-membered to 7-membered one having preferably from 6 to 10 carbon atoms and nitrogen, oxygen and/or sulfur atom(s) as hetero atom(s), for example, a 2-morpholyl group, a 4-pyridyl group, and a 2-furanyl group. Additional examples of typical heterocyclic groups include those discussed hereinbelow for group $R^3$. The aliphatic group, the aromatic group and the heterocyclic group represented by $R^2$ may be further substituted by any other various substituents. As examples of substituents of these groups, those mentioned for the group $R^1$ are referred to.

In formula (I), $R^3$ represents an organic residue. The organic residue of $R^3$ includes, for example, a straight chain or branched, linear or cyclic, saturated or unsaturated, and substituted or unsubstituted aliphatic group (preferably having from 1 to 30 carbon atoms, such as methyl, propyl, t-butyl, trifluoromethyl, tridecyl, 3-(2,4-di-t-amylphenoxy)propyl, 2-dodecyloxyethyl, 3-phenoxypropyl, 2-hexylsulfonylethyl, cyclopentyl, benzyl), an aromatic group (preferably having from 6 to 30 carbon atoms, for example, phenyl, 4-t-butylphenyl, 4-tetradecanamidophenyl), a heterocyclic group (preferably a 5-membered to 7 -membered one, such as 2-furyl, 2-thienyl, 2-pyrimidyl, 2-benzothiazolyl), an alkoxy group (preferably having from 1 to 30 carbon atoms, such as methoxy, ethoxy, 2-methoxyethoxy, 2-dodecyloxyethoxy, 2-methanesulfonylethoxy), an aryloxy group (preferably having from 6 to 30 carbon atoms, such as phenoxy, 2-methylphenoxy, 4-t-butylphenoxy), a heterocyclic-oxy group (preferably a 5-membered to 7-membered one, such as 2-benzimidazolyloxy), and a group of $-N(R^4)(R^5)$. $R^4$ and $R^5$ each represent an aliphatic group, an aromatic group, a hydrogen atom, or a heterocyclic group. The aliphatic group of $R^4$ or $R^5$ preferably has from 1 to 30 carbon atoms and it may be a straight chain or branched, linear or cyclic, saturated or unsaturated, and unsubstituted or substituted one. It includes, for example, methyl, propyl, isoamyl, trifluoromethyl, 3-(2,4-di-t-amylphenoxy)propyl, 2-dodecyloxyethyl, 3-phenoxypropyl and benzyl groups. The aromatic group of $R^4$ or $R^5$ includes, for example, a substituted phenyl group and an unsubstituted phenyl group. As examples of substituents of the substituted phenyl group, there are mentioned a halogen atom (for example, fluorine, chlorine, bromine), a straight chain or branched, linear or cyclic, saturated or unsaturated, and substituted or unsubstituted aliphatic group (for example, methyl, propyl, t-butyl, trifluoromethyl, tridecyl, 3-(2,4-di-t-amylphenoxy)propyl, 2-dodecyloxyethyl, 3-(phenoxypropyl, 2-hexylsulfonylethyl, cyclopentyl, benzyl), an aryl group (for example, phenyl, 4-t-butylphenyl, 4-tetradecanamidophenyl), a heterocyclic group (for example, 2-furyl, 2-thienyl, 2-pyrimidyl, 2-benzothiazolyl), a cyano group, an alkoxy group (for example, methoxy, ethoxy, 2-methoxyethoxy, 2-docecyloxyethoxy, 2-methanesulfonylethoxy), an aryloxy group (for example, phenoxy, 2-methylphenoxy, 4-t-butylphenoxy), a heterocyclic-oxy group (for example, 2-benzimidazolyloxy), an acyloxy group (for example, acetoxy, hexadecanoyloxy), a carbamoyloxy group (for example, N-ethylcarbamoyloxy), a silyloxy group (for example, trimethylsilyloxy), a sulfonyloxy group (for example, dodecylsulfonyloxy), an acylamino group (for example, acetamido, benzamido, tetradecanamido, α-(2,4-di-t-amylphenoxy)butylamido, 2,4-di-t-amylphenoxyacetamido, α-[4-(4-hydroxyphenylsulfonyl)-phenoxy)]decanamido, isopentadecanamido), an anilino group (for example, phenylamino, 2-chloroanilino, 2-chloro-5-tetradecanamidoanilino, 2-chloro-5-dodecyloxycarbonylanilino, N-acetylanilino, 2-chloro-5-{α-(2-t-butyl-4-hydroxyphenoxy)-dodecanamido}anilino), a ureido group (for example, phenylureido, methylureido, N,N-dibutylureido), an imido group (for example, N-succinimido, 3-benzylhydantoinyl, 4-(2-ethylhexanoylamino)phthalimido), a sulfamoylamino group (for example, N,N-dipropylsulfamoylamino, N-methyl-N-decylsulfamoylamino), an alkylthio group (for example, methylthio, octylthio, tetradecylthio, 2-phenoxyethylthio, 3-phenoxypropylthio, 3-(4-t-butylphenoxy)propylthio), an arylthio group (for example, phenylthio, 2-butoxy-5-t-octylphenylthio, 3-pentadecylphenylthio, 2-carboxyphenylthio, 4-tetradecanamidophenylthio), a heterocyclic-thio group (for example, 2-benzothiazolylthio), an alkoxycarbonylamino group (for example, methoxycarbonylamino, tetradecyloxycarbonylamino), an aryloxycarbonylamino group (for example, phenoxycarbonylamino, 2,4-di-tert-butylphenoxycarbonylamino), a sulfonamido group (for example, methanesulfonamido, hexadecanesulfonamido, benzenesulfonamido, p-toluenesulfonamido, octadecanesulfonamido, 2-methyloxy-5-t-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-{3-(2,4-di-t-tert amylphenoxy)propyl}carbamoyl), an acyl group (for example, acetyl, (2,4-di-tert-amylphenoxy)acetyl, benzoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl), a sulfinyl group (for example, octanesulfinyl, dodecylsulfinyl, phenylsulfinyl), an alkoxycarbonyl group (for example, methoxycarbonyl, butoxycarbonyl, dodecylcarbonyl, octadecylcarbonyl), and an aryloxycarbonyl group (for example, phenyloxycarbonyl, 3-pentadecyloxycarbonyl).

The heterocyclic group of $R^4$ or $R^5$ is preferably a 5-membered or 6-membered one having, as hetero atom(s), nitrogen, oxygen and/or sulfur atom(s). The heterocyclic group of $R^4$ or $R^5$ has preferably from 1 to 25 carbon atoms and may optionally have substituent(s) (for example, selected from an alkyl group such as methyl, isopropyl or octyl group, an alkoxy group such as methoxy, isopropoxy or octoxy group, and an alkoxycarbonyl group such as methoxycarbonyl, ethoxycarbonyl or octoxycarbonyl group).

In formula (I), $R^3$ is preferably $—N(R^4)(R^5)$, more preferably $—NH—R^4$, where $R^4$ and $R^5$ have the same meanings as those mentioned above.

In formula (I), X is a group capable of splitting off from the formula when the compound has reacted with the oxidation product of an aromatic primary amine developing agent. When the coupler of formula (I) is used as one which releases a photographically useful group, such as a DIR coupler, X must be a group having a property as a photographically useful group or a precursor thereof.

When the coupler of formula (I) is not used as a photographically useful group-releasing coupler, X is desired to be a group of the following general formula (II) or (III):

(II)

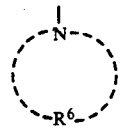

(III)

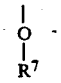

In formula (II), $R^6$ represents a non-metallic atomic group necessary for forming a 5-membered or 6-membered ring together with the nitrogen atom as bonded to the active point in the formula. Specific examples of heterocyclic skeletons of formula (II) are mentioned below.

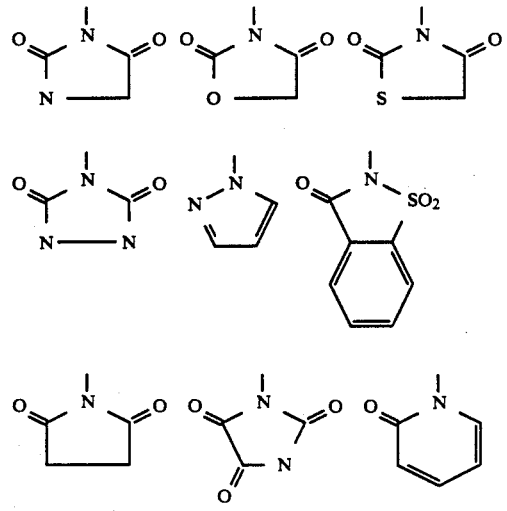

-continued

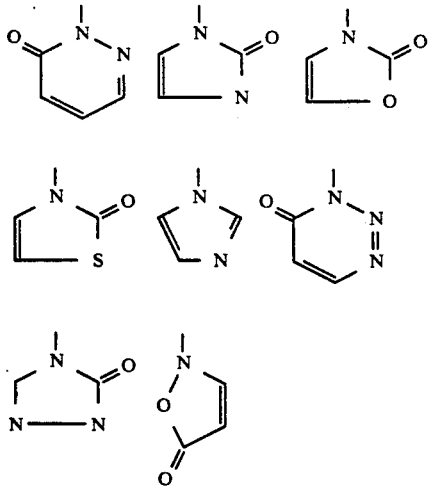

Of the heterocyclic skeletons, especially preferred are those of the following formula (IV), where $R^8$ represents a non-metallic atomic group necessary for forming a 5-membered hetero ring:

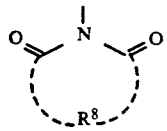

(IV)

In the above-mentioned heterocyclic groups, the ring-constituting nitrogen and carbon atoms may have substituents. As specific examples of such substituents, there are mentioned an alkyl group (for example, methyl, ethyl, ethoxyethyl), an aryl group (for example, phenyl, 4-chlorophenyl), an aralkyl group (for example, benzyl), an alkoxy group (for example, methoxy, ethoxy), a halogen atom (for example, chlorine, fluorine), an acylamino group (for example, acetamido), a sulfonamido group (for example, methanesulfonamido), a sulfonyl group, a sulfamoyl group, a carbamoyl group, a carboxyl group, an alkoxycarbonyl group, a hydroxyl group, a nitro group, a cyano group, and an alkenyl group (for example, vinylmethyl).

In formula (III), $R^7$ represents an aliphatic group (for example, methyl, ethyl, allyl), an aromatic group (for example, phenyl, naphthyl), or a heterocyclic group (for example, 2-pyridyl, 2-pyrrole). In addition, $R^7$ may represent an aliphatic group, an aromatic group or a heterocyclic group set forth for group $R^3$. $R^7$ is preferably an aromatic group. The group of $R^7$ may have substituent(s), and specific examples of such substituents include a halogen atom (for example, chlorine), an alkyl group (for example, methyl), an alkoxy group (for example, methoxy), an acylamido group (for example, acetamido), a sulfonamido group (for example, methanesulfonamido), a sulfonyl group (for example, methylsulfonyl, 4-hydroxyphenylsulfonyl), a sulfamoyl group, a carbamoyl group, a carboxyl group, an alkoxycarbonyl group, a hydroxyl group, a cyano group, and a nitro group.

Of the groups of formula (III), especially preferred are those of the following general formula (V):

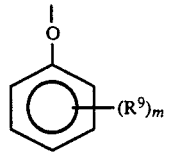

(V)

where $R^9$ represents a hydrogen atom, an aliphatic group, an aromatic group, a heterocyclic group, a cyano group, a nitro group, an acyl group, a carbamoyl group, an alkoxycarbonyl group, an aryloxycarbonyl group, an alkylsulfonyl group, an arylsulfonyl group, an acylamino group, a sulfamoyl group, a sulfonylamino group, a carboxyl group, an alkoxy group, an aryloxy group, or a halogen atom, and the number of carbon atoms constituting the group of $R^9$ is preferably within the range of from 1 to 16, more preferably from 1 to 10; m represents an integer of from 0 to 5, and when m is 2 or more, plural $(R^9)$'s may be same as or different from one another.

When the coupler of formula (I) is used as a photographically useful group-releasing coupler, for example, as a DIR coupler, X in formula (I) preferably forms a structure shown in the following formula (VI) that is bonded to the coupler residue B:

$$B-(L^1)_a-Z-(L^2-Y)_b \qquad (VI)$$

In formula (VI), B represents a residue of a coupler component of formula (I) except X; and Z represents a main part of a compound having a development inhibiting activity, and it is bonded to the coupling position of the coupler directly (when a=0) or via a linking group $L^2$. (when a=1).

Y represents a substituent capable of expressing the development inhibiting activity of Z and is bonded to Z via a linking group $L^2$. The linking group $L^2$ contains a chemical bond which is cleaved in a developer.

a represents 0 or 1; and b represents an integer of from 0 to 2 and is preferably 1 or 2. When b is 2, two $(-L^2-Y)$'s may be same as or different from each other.

A compound of formula (IV) releases $\theta Z-(L^2-Y)_b$ or $\theta L^1-Z\ (L^2-Y)_b$, after it has coupled with the oxidation product of a color developing agent. In the latter, $L^1$ is immediately cleaved from the formula to give $\theta Z\ (L^2-Y)_b$. The moiety $\theta Z-(L^2-Y)_b$ diffuses through light-sensitive layers while displaying the development inhibiting activity, and a part of this flows out into a color developer. The moiety $\theta Z-(L^2-Y)_b$ which flows into a color developer is rapidly decomposed at the position of the cleavable chemical bond in the moiety, or that is, the bond between Z and Y is cleaved to give a compound composed of Z having a small development inhibiting activity and a water-soluble group. Finally, the compound composed of Z and a water-soluble group is to remain in the developer so that the development inhibiting activity of the compound of formula (IV) is substantially lost.

A compound having a development inhibiting activity is not accumulated in the processing solution, so that not only the processing solution can be used repeatedly but also a sufficient amount of a DIR coupler may be incorporated into a photographic material.

As the main part of the development inhibitor of Z, typical is a divalent nitrogen-containing heterocyclic group or nitrogen-containing heterocyclic-thio group.

The latter nitrogen-containing heterocyclic-thio group includes, for example, a tetrazolylthio group, a benzothiazolylthio group, a benzimidazolylthio group, a thiadiazolylthio group, an oxadiazolylthio group, a triazolylthio group, and a imidazolylthio group. Specific examples of the group are mentioned below, along with the adjacent groups $B—(L^1)_a—$ and $—(L^2—Y)_b$.

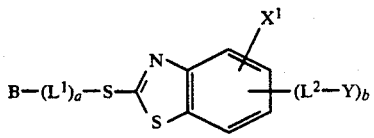

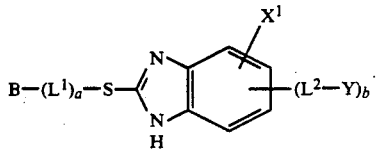

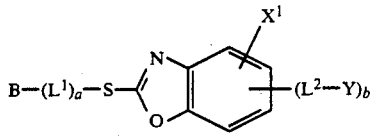

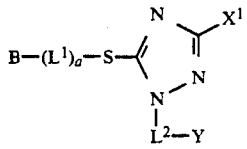

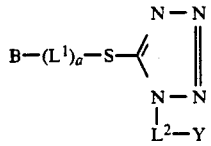

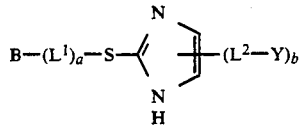

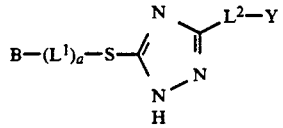

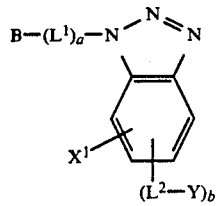

-continued

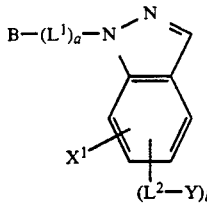

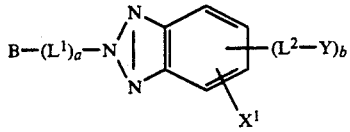

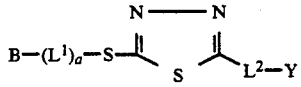

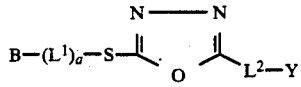

In the above-mentioned formulae, the substituent of $X^1$ is contained in the moiety of Z in formula (VI), and it is preferably a hydrogen atom, a halogen atom, an alkyl group, an alkenyl group, an alkanamido group, an alkenamido group, an alkoxy group, a sulfonamido group, or an aryl group.

As examples of the substituent Y in formula (VI), there are mentioned an alkyl group, a cycloalkyl group, an alkenyl group, a cycloalkenyl group, an aryl group, an aralkyl group, or a heterocyclic group.

Examples of the linking group $L^1$ in formula (VI) are mentioned below, along with the adjacent groups B and $Z—(L^2—Y)_b$.

$B—OCH_2—Z—(L^2—Y)_b$ (linking group as described in U.S. Pat. No. 4,146,396)

$B—SCH_2—Z—(L^2—Y)_b$ $B—OCO—Z—(L^2—Y)_b$ (linking group as described in German Patent OLS No. 2,626,315)

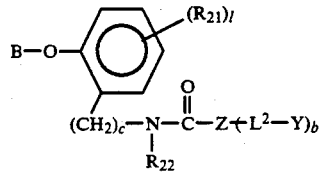

(linking groups as described in German Patent OLS No. 2,855,697; c is an integer of from 0 to 2)

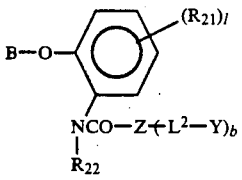

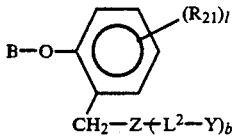

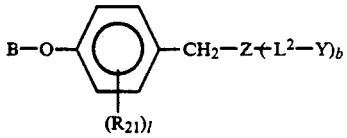

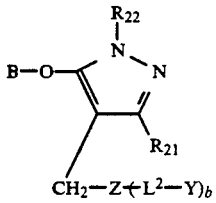

In these formulae, $R_{21}$ represents a hydrogen atom, a halogen atom, an alkyl group, an alkenyl group, an aralkyl group, an alkoxy group, an alkoxycarbonyl group, an anilino group, an acylamino group, an ureido group, a cyano group, a nitro group, a sulfonamido group, a sulfamoyl group, a carbamoyl group, an aryl group, a carboxyl group, a sulfo group, a cycloalkyl group, an alkanesulfonyl group, an arylsulfonyl group, or an acyl group;

$R_{22}$ represents a hydrogen atom, an alkyl group, an alkenyl group, an aralkyl group, a cycloalkyl group, or an aryl group; and l represents 1 or 2, and when l is 2, two $(R_{21})$'s may form a condensed ring.

In these DIR couplers (when a=1 in formula (VI)), the split-off group to be released after reaction with the oxidation product of a developing agent is immediately decomposed to release a development inhibitor (H—Z—$(L^2—Y)_b$). Accordingly, such DIR couplers (a=1) have the same effect as the other DIR couplers (of formula (VI) where a=0) not having the group $L^1$.

In formula (VI), the linking group $L^2$ contains a chemical bond to be cleaved in a developer. Examples of such a cleavable chemical bond are mentioned in the following table. The illustrated groups are cleaved by the action of a nucleophilic reagent which is a component of constituting a color developer, such as a hydroxy ion or a hydroxylamine, to display the effect of the present invention.

| Chemical Bond in $L_2$ | Reaction of Cleaving the bond (reaction with $^{\ominus}OH$) |
|---|---|
| —COO— | —COOH + HO— |
| H<br>—NCOO— | —$NH_2$ + HO— |
| —$SO_2O$— | —$SO_2H$ + HO— |

-continued

| Chemical Bond in $L_2$ | Reaction of Cleaving the bond (reaction with $^{\ominus}OH$) |
|---|---|
| —$OCH_2CH_2SO_2$— | —OH + $CH_2$=$CHSO_2$— |
| —OC(=O)— | —OH + HO— |
| —NHC(=O)C(=O)— | —$NH_2$ + HO— |

The divalent linking group as illustrated in the above table is linked to Z directly or via an alkylene group and/or a phenylene group, on one hand; while it is linked to Y directly on the other hand. When it is linked to Z via an alkylene group and/or a phenylene group, the interrupting divalent group moiety between the linking group and Z may contain, for example, an ether bond, an amido bond, a carbonyl bond, a thioether bond, a sulfone group, a sulfonamido bond and/or an urea bond.

As the linking group of $L^2$, for example, those mentioned below along with the adjacent groups Z and Y are preferred.

—Z—$(CH_2)_d$COO—Y

—Z—$(CH_2)_d$OC(=O)—Y

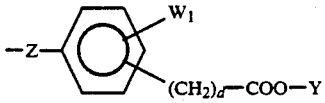

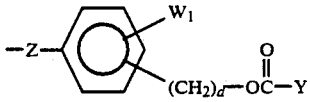

—Z—$(CH_2)_d$—NHCOO—Y

—Z—$(CH_2)_d$—OC(=O)NH—Y

—Z—NHC(=O)—$(CH_2)_d$C(=O)O—Y

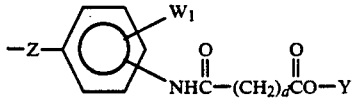

—Z—$(CH_2)_p$COO$CH_2CH_2SO_2$—Y

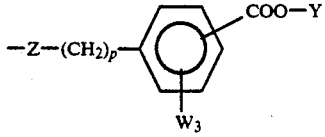

—Z—NCOO—Y
|
$W_2$

-continued $$-Z-\underset{\underset{W_2}{|}}{N}-COCO-Y$$

In these formulae, d represents an integer of from 0 to 10, preferably from 0 to 5; $W_1$ represents a hydrogen atom, a halogen atom, an alkyl group having from 1 to 10 carbon atoms, preferably from 1 to 5 carbon atoms, an alkanamido group having from 1 to 5 carbon atoms, preferably from 1 to 5 carbon atoms, an alkoxy group having from 1 to 10 carbon atoms, preferably from 1 to 5 carbon atoms, an alkoxycarbonyl group having from 1 to 10 carbon atoms, preferably from 1 to 5 carbon atoms, an aryloxycarbonyl group, an alkanesulfonamido group having from 1 to 10 carbon atoms, preferably from 1 to 5 carbon atoms, an aryl group, a carbamoyl group, an N-alkylcarbamoyl group having from 1 to 10 carbon atoms, preferably from 1 to 5 carbon atoms, a nitro group, a cyano group, an arylsulfonamido group, a sulfamoyl group, or an imido group; $W_2$ represents a hydrogen atom, an alkyl group having from 1 to 6 carbon atoms, an aryl group, or an alkenyl group; $W_3$ represents a hydrogen atom, a halogen atom, a nitro group, or an alkoxy or alkyl group having from 1 to 6 carbon atoms; and p represents an integer of from 0 to 6.

The alkyl or alkenyl group to be represented by $X^1$ and Y is a straight chain, branched or cyclic alkyl or alkenyl group having from 1 to 10 carbon atoms, preferably from 1 to 5 carbon atoms. Preferably, these group have substituent(s). As examples of such substituents, there are mentioned a halogen atom, a nitro group, an alkoxy group having from 1 to 4 carbon atoms, an aryloxy group having from 6 to 10 carbon atoms, an alkanesulfonyl group having from 1 to 4 carbon atoms, an arylsulfonyl group having from 6 to 10 carbon atoms, an alkanamido group having from 1 to 5 carbon atoms, an anilino group, a benzamido group, an alkyl-substituted carbamoyl group having from 1 to 6 carbon atoms, a carbamoyl group, an aryl-substituted carbamoyl group having from 6 to 10 carbon atoms, an alkylsulfonamido group having from 1 to 4 carbon atoms, an arylsulfonamido group having from 6 to 10 carbon atoms, an alkylthio group having from 1 to 4 carbon atoms, an arylthio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having from 1 to 4 carbon atoms, an alkanoyl group having from 1 to 4 carbon atoms, a benzoyl group, an alkanoyloxy group having from 1 to 4 carbon atoms, a benzoyloxy group, a perfluoroalkyl group having from 1 to 4 carbon atoms, a cyano group, a tetrazolyl group, a hydroxyl group, a carboxyl group, a mercapto group, a sulfo group, an amino group, an alkylsulfamoyl group having from 1 to 4 carbon atoms, an arylsulfamoyl group having from 6 to 10 carbon atoms, a morpholino group, an aryl group having from 6 to 10 carbon atoms, a pyrrolidinyl group, an ureido group, an urethane group, an alkoxy-substituted carbonyl group having from 1 to 6 carbon atoms, an aryloxy-substituted carbonyl group having from 6 to 10 carbon atoms, an imidazolidinyl group, and an alkylidenamino group having from 1 to 6 carbon atoms.

The alkanamido group or alkenamido group to be represented by $X^1$ may be a straight chain, branched or cyclic alkanamido or alkenamido group having from 1 to 10 carbon atoms, preferably from 1 to 5 carbon atoms. The group may optionally have substituent(s). As examples of such substituents, those mentioned above for the alkyl and alkenyl groups are referred to.

The alkoxy group to be represented by $X^1$ is a straight chain, branched or cyclic alkoxy group having from 1 to 10 carbon atoms, preferably from 1 to 5 carbon atoms. The group may optionally have substituent(s). As examples of such substituents, those mentioned above for the alkyl and alkenyl groups are referred to.

The aryl group to be represented by Y is preferably a phenyl group or a naphthyl group, which may optionally be substituted. As examples of substituents on the group, an alkyl group having from 1 to 4 carbon atoms as well as those mentioned above for the alkyl and alkenyl groups are referred to.

The heterocyclic group to be represented by Y is preferably a 5-membered to 7-membered one, which includes, for example, a diazolyl group (such as 2-imidazolyl, 4-pyrazolyl), a triazolyl group (such as 1,2,4-triazol-3-yl), a thiazolyl group (such as 2-benzothiazolyl), an oxazolyl group (such as 1,3-oxazol- 2-yl), a pyrrolyl group, a pyridyl group, a diazinyl group (such as 1,4-diazin-2-yl), a triazinyl group (such as 1,2,4-triazin-5-yl), a furyl group, a diazolinyl group (such as imidazolin-2-yl), a pyrrolinyl group, and a thienyl group.

Of the couplers of formula (VI), especially useful are those of the following general formulae (VII), (VIII), (IX), (X), (XI), (XII) and (XIII). These couplers illustrated below are preferred as being able to release a development inhibitor having a strong development inhibiting activity.

In formulae (VII) to (XIII), B, $L^2$ and Y have the same meanings as those mentioned above.

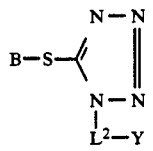

(VII)

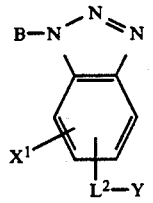

(VIII)

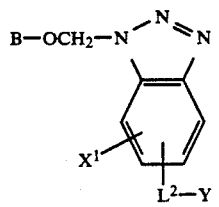

(IX)

-continued (X)

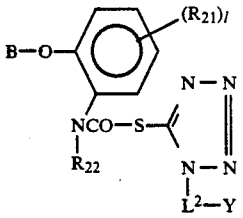

(XI)

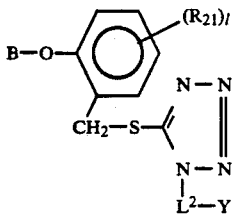

(XII)

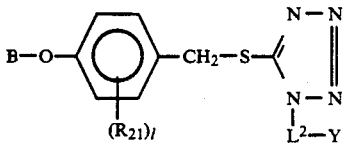

(XIII)

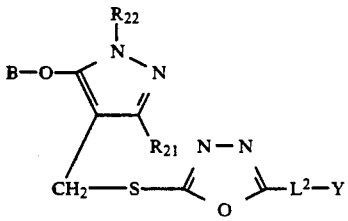

In formula (I), A represents an acidic dissociating group. The acidic dissociating group indicates a substituent capable of releasing a hydrogen ion ($H^{\ominus}$) in an alkaline solution or in the presence of a base (for example, ammonia, amines, anilines, pyridine). As specific examples of such an acidic dissociating group, there are mentioned —COOH, a phenolic —OH, $-S(O)_nH$ (n=0 to 3), $-SO_2NH_2$, $-SO_2NH-R^{31}$, $-SO_2NHCOR^{31}$, $--SO_2NHCO_2R^{31}$, $-CONHCOR^{31}$, $-CONHCO_2R^{31}$, $-CONHSO_2R^{31}$, and $-CONHSO_2NR^{31}R^{32}$. In these groups, $R^{31}$ represents an aliphatic group, an aromatic group or a heterocyclic group; and $R^{32}$ represents a hydrogen atom, an aliphatic group, an aromatic group or a heterocyclic group.

The aliphatic group to be represented by $R^{31}$ and $R^{32}$ is a saturated or unsaturated, straight chain or branched, linear or cyclic, and substituted or unsubstituted aliphatic hydrocarbon residue having from 1 to 40 carbon atoms, preferably from 1 to 22, carbon atoms. As specific examples of these groups, there are mentioned a methyl group, an ethyl group, a propyl group, an isopropyl group, a butyl group, a (t)-butyl group, an (i)-butyl group, a (t)-amyl group, a hexyl group, a cyclohexyl group, a 2-ethylhexyl group, an octyl group, a 1,1,3,3-tetramethylbutyl group, a decyl group, a dodecyl group, a hexadecyl group, and an octadecyl group.

The aromatic group to be represented by $R^{31}$ and $R^{32}$ has from 6 to 20 carbon atoms and is preferably a substituted or unsubstituted phenyl group or a substituted or unsubstituted naphthyl group.

The heterocyclic group to be represented by $R^{31}$ and $R^{32}$ has from 1 to 20 carbon atoms, preferably from 1 to 7 carbon atoms and has nitrogen, oxygen and/or sulfur atom(s) as hetero atom(s). It is preferably a 3-membered to 8-membered substituted or unsubstituted heterocyclic group. As specific examples of such heterocyclic groups for $R^{31}$ and $R^{32}$, there are mentioned a 2-pyridyl group, a 4-pyridyl group, a 2-thienyl group, a 2-furyl group, a 2-imidazolyl group, a pyradinyl group, a 2-pyrimidinyl group, a 1 imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-3-yl group, a succinimido group, a phthalimido group, a 1,2,4-triazol-2-yl group, and a 1-pyrazolyl group.

The above-mentioned aromatic group, heterocyclic group and aliphatic group may optionally be substituted. As examples of substituents acceptable on the group, monovalent organic groups are referred to, which include, for example, a halogen atom (for example, chlorine, fluorine, bromine), an alkyl group (for example, methyl, ethyl, t-octyl, t-amyl, n-nonyl, methoxymethyl), an alkoxy group (for example, methoxy, n-octyloxy, n-decyloxy, n-pentadecyloxy), an aryloxy group (for example, phenoxy, t-octylphenoxy), an alkoxycarbonyl group (for example, methoxycarbonyl, n-dodecyloxycarbonyl, n-hexadecyloxycarbonyl), an aryloxycarbonyl group (for example, phenoxycarbonyl, 2,4-di-t-amylphenoxycarbonyl), a sulfonamido group (for example, methanesulfonamido, n-butanesulfonamido, n-hexadecanesulfonamido, benzenesulfonamido), a sulfamoyl group (for example, N,N-di-n-octylsulfamoyl, N-n-hexadecylsulfamoyl), an amino group (for example, ethylamino, di-n-octylamino), a carbamoyl group (for example, di-n-octylcarbamoyl, diethylcarbamoyl), an acylamino group (for example, 2,4-di-t-amylphenoxyacetamido, n-pentadecylphenoxyacetamido), a sulfonyl group (for example, methylsulfonyl, n-dodecylsulfonyl), a cyano group, an aryl group (for example, phenyl), an aralkyl group (for example, benzyl), a nitro group, a hydroxyl group, a carboxyl group, an acyl group (for example, acetyl), and a heterocyclic group (for example, n-octadecylsuccinimido).

In formula (I), the acidic dissociating group A may be positioned at any desired position. When A is a substituent as bonded to X, the group X as released from the formula by reaction of the compound of the formula with the oxidation product of a developing agent does not further react with the oxidation product of the developing agent.

In formula (I), n represents an integer of 1 or more. When n is an integer of 2 or more, plural A's may be same as or different from one another and they may be positioned either at the same position or at different positions.

Specific examples of couplers of formula (I) for use in the present invention are mentioned below, which, however, are not limitative of the invention.

(1)
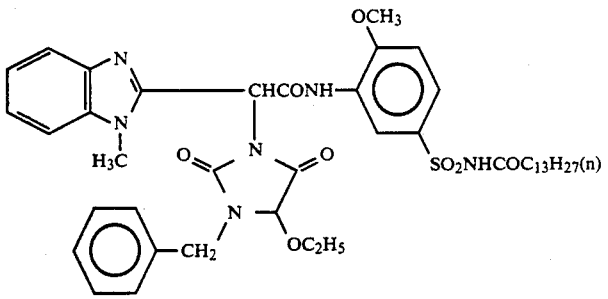
(2)
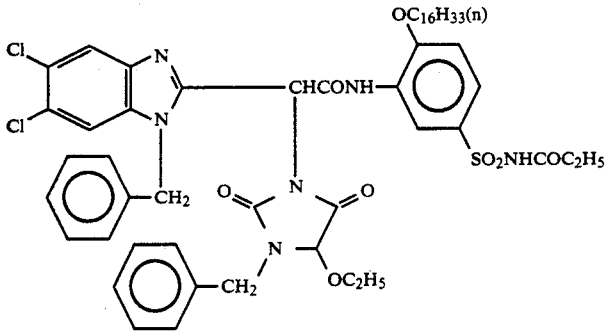
(3)
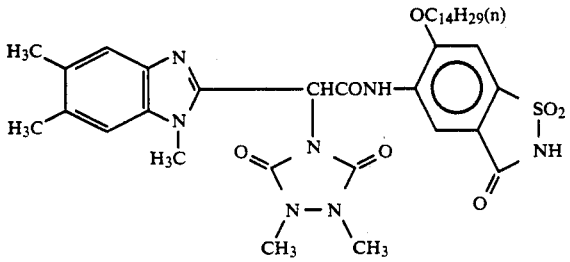
(4)
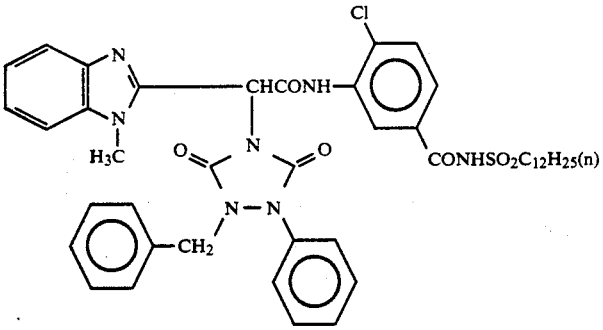
(5)
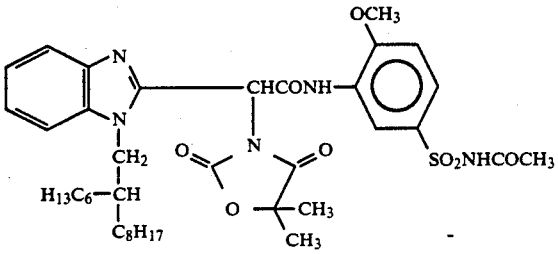

-continued
(6)
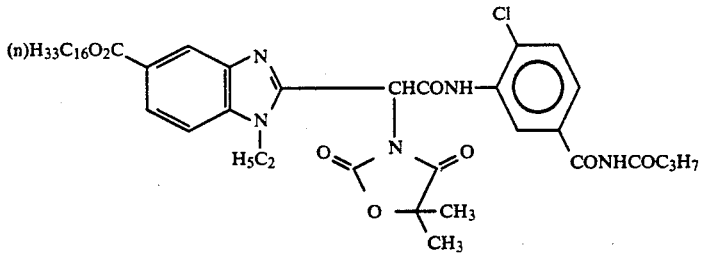
(7)
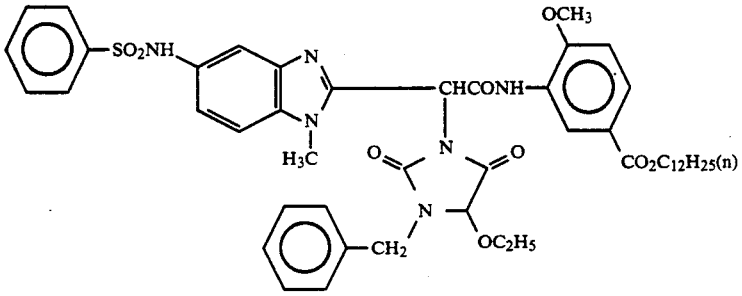
(8)
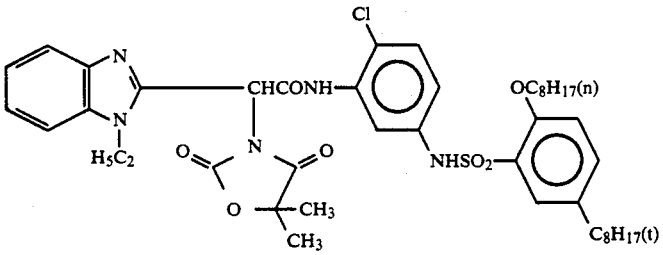
(9)
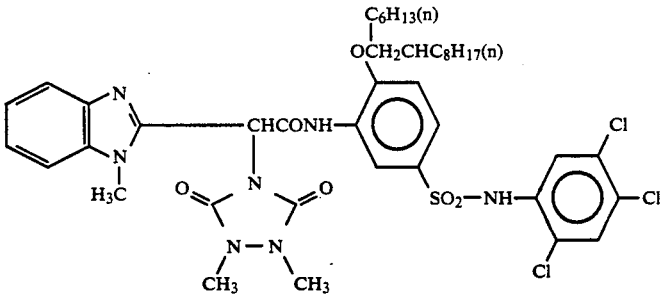
(10)
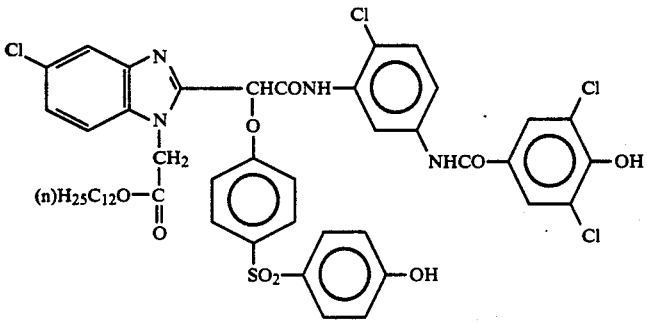

-continued
(11)
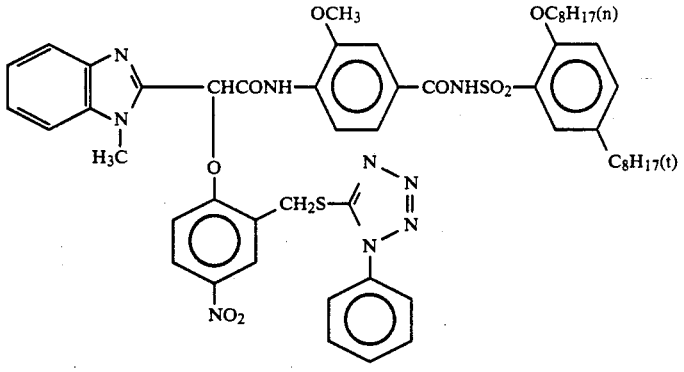
(12)
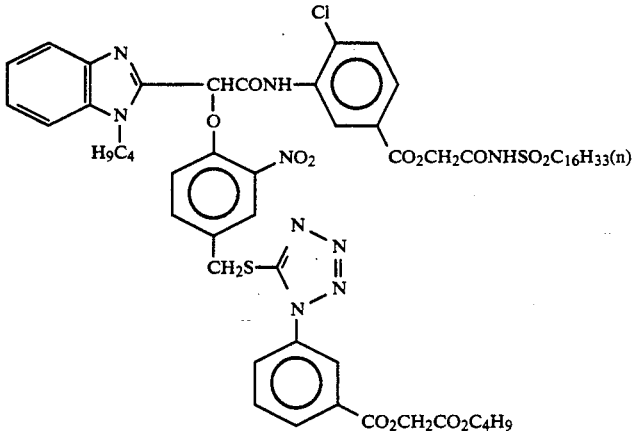
(13)
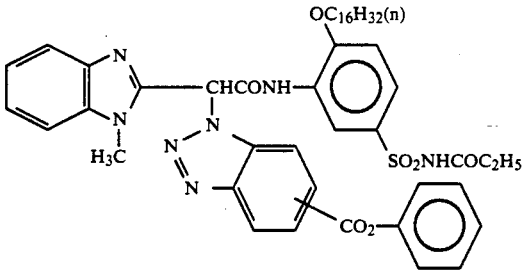
(14)
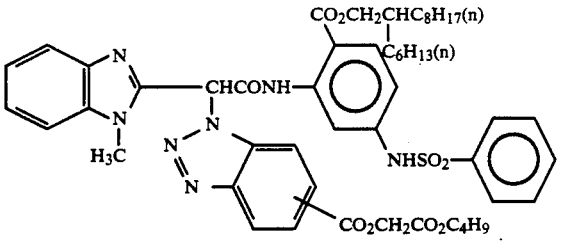
(15)
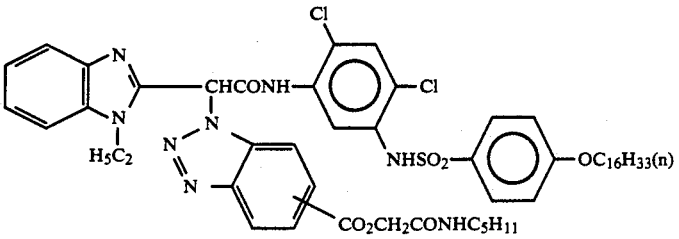

-continued
(16)
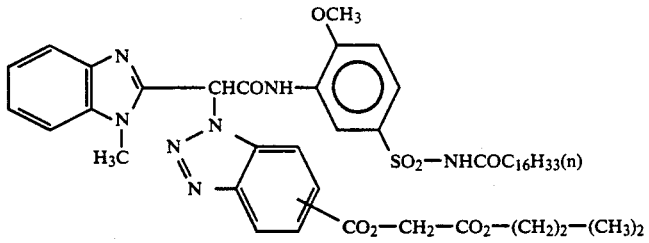
(17)
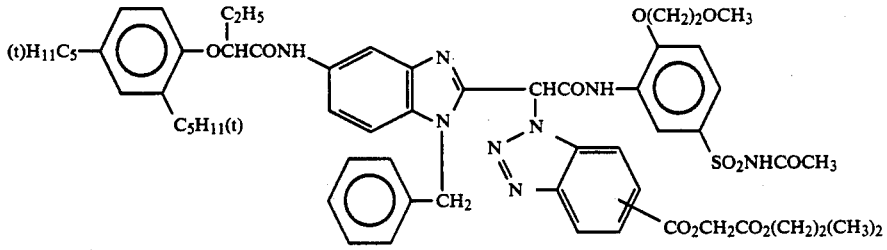
(18)
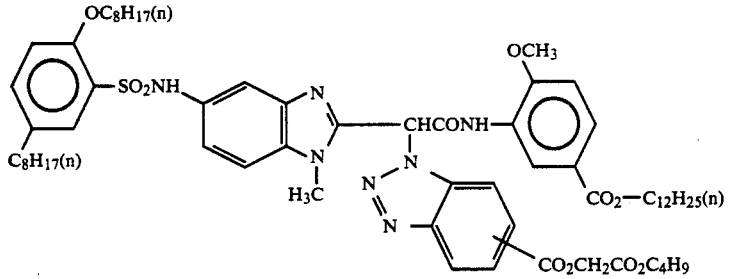
(19)
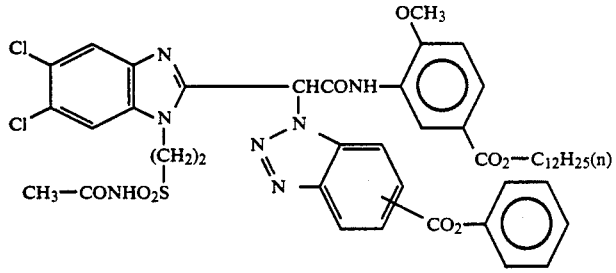
(20)
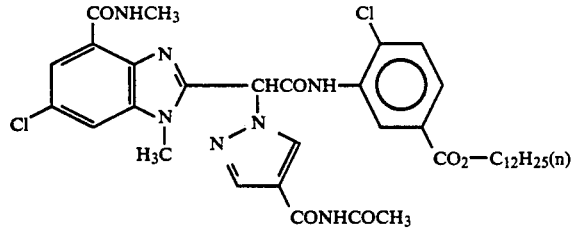
(21)
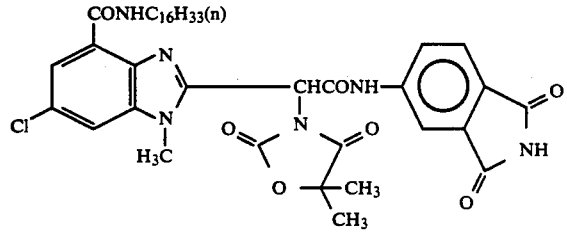

-continued
(22)
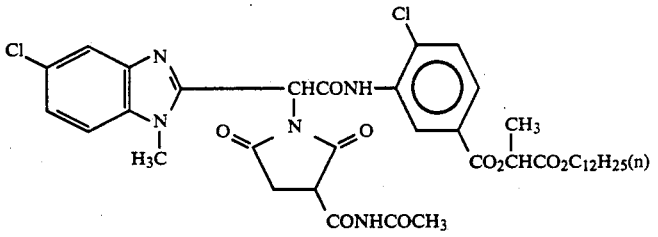
(23)
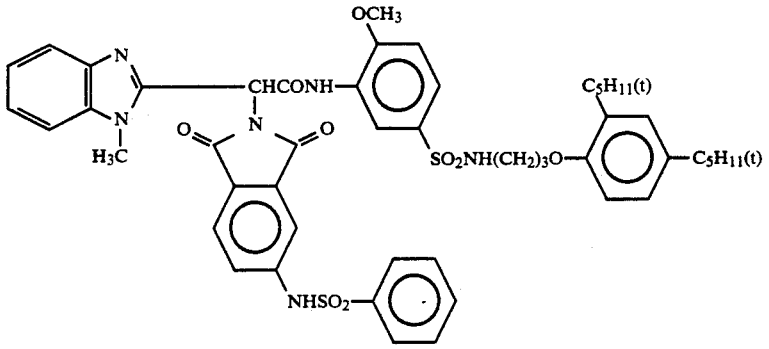
(24)
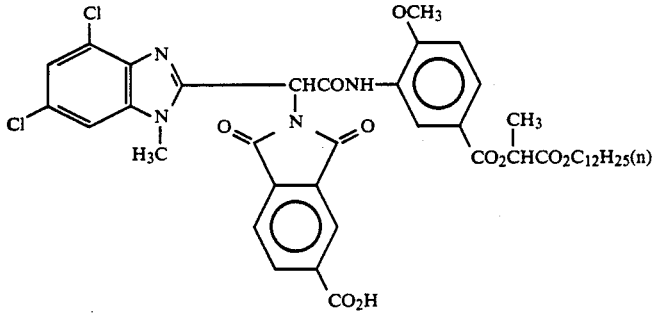
(25)
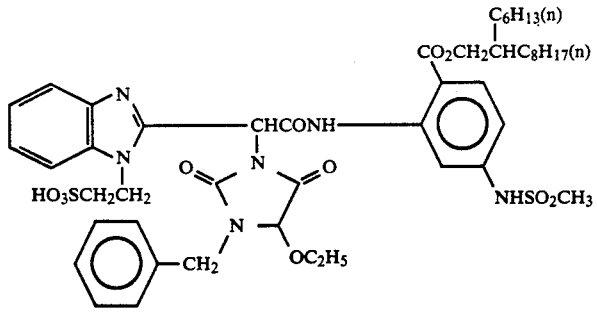
(26)
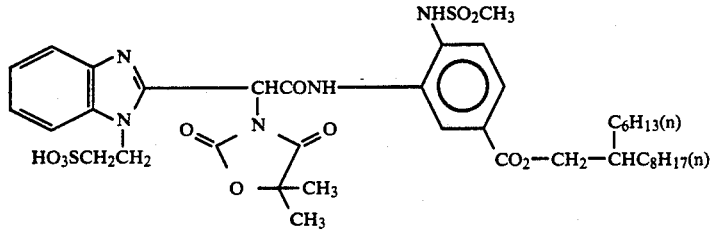

-continued
(27)
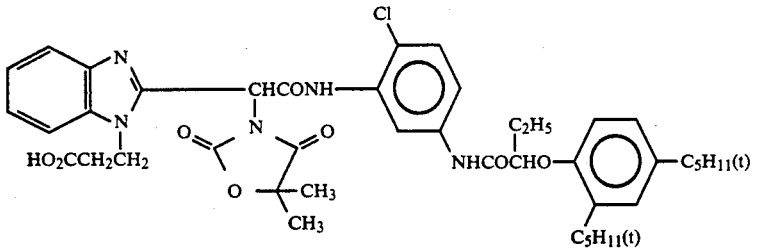
(28)
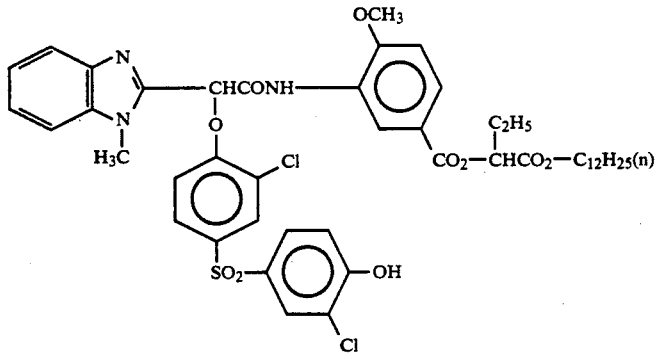
(29)
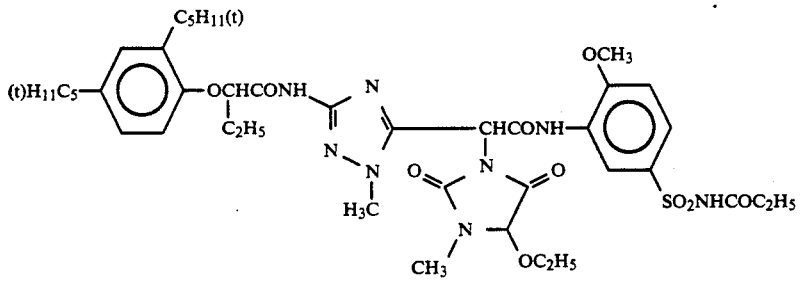
(30)
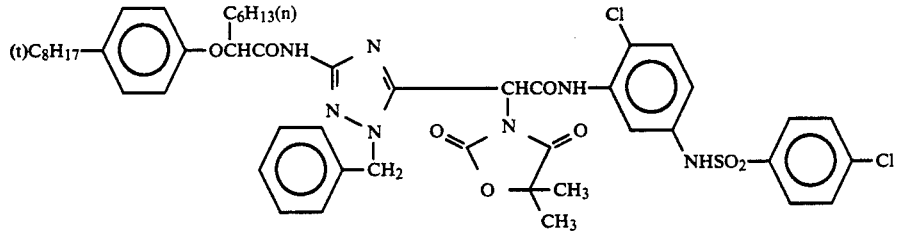
(31)
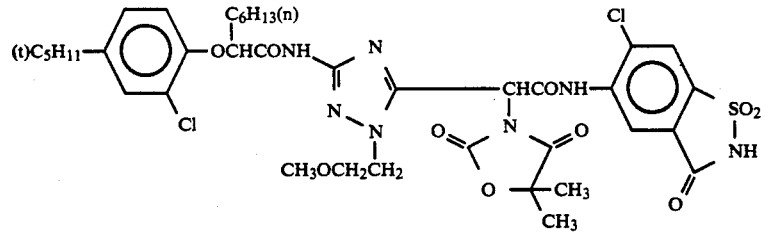
(32)
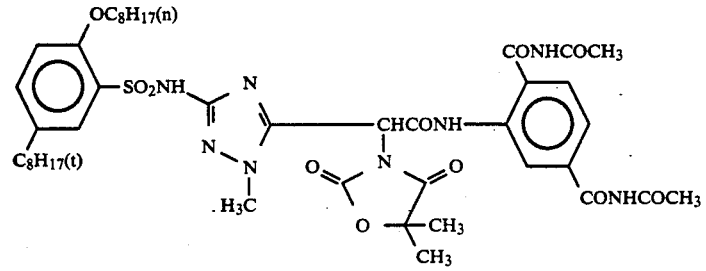

-continued
(33)
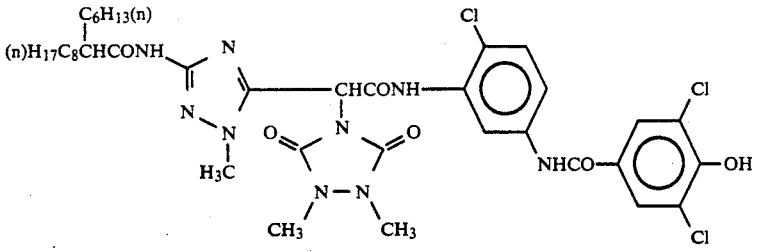
(34)
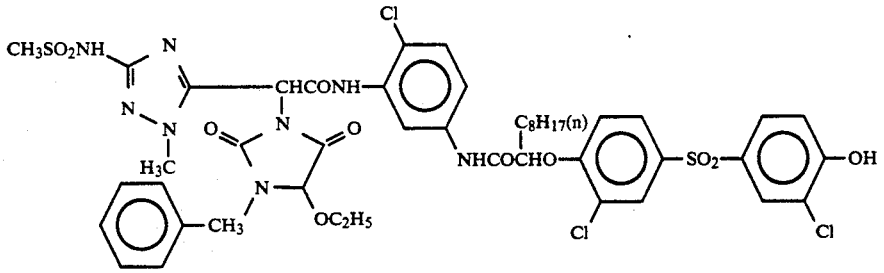
(35)
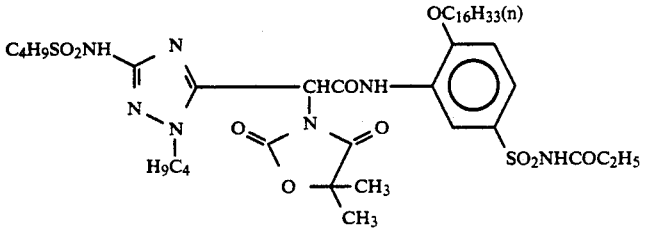
(36)
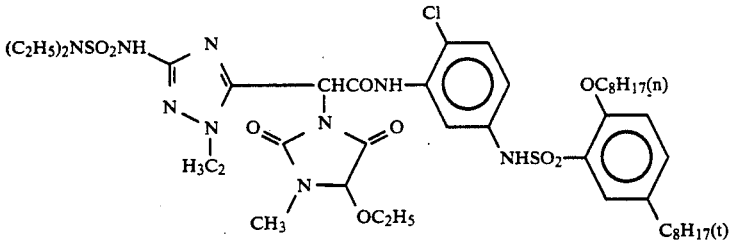
(37)
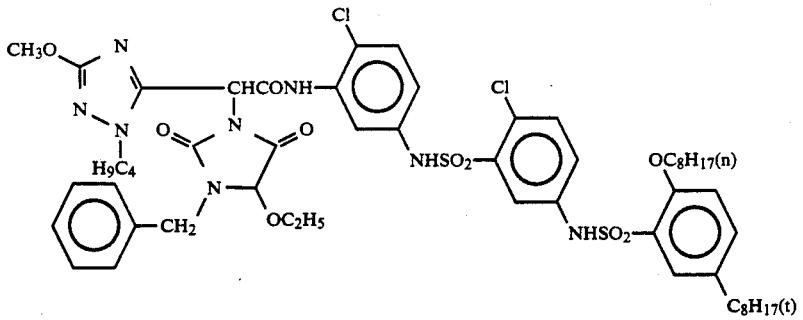
(38)
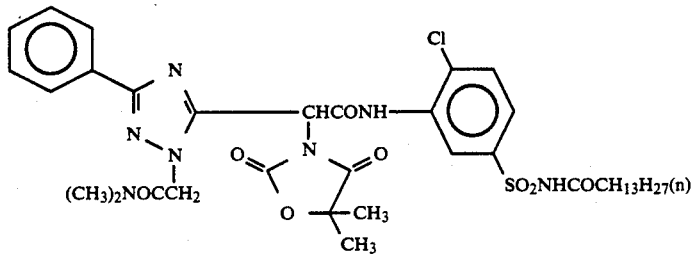

-continued
(39)
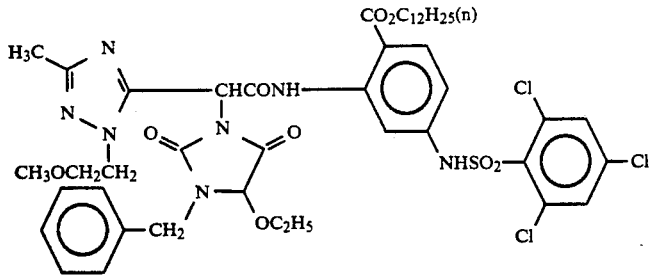
(40)
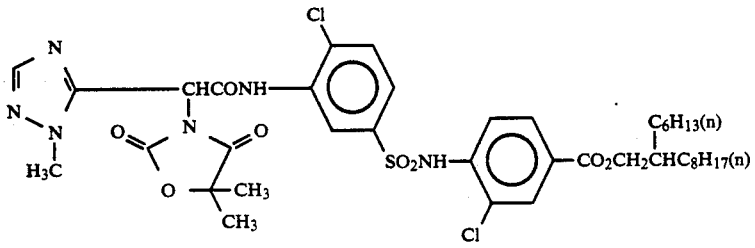
(41)
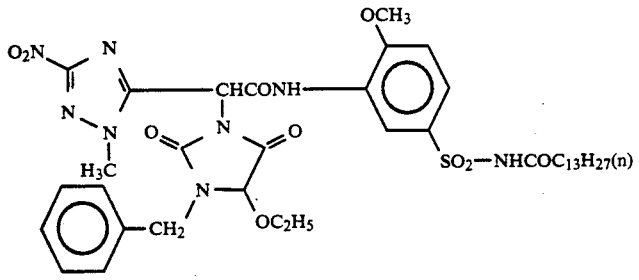
(42)
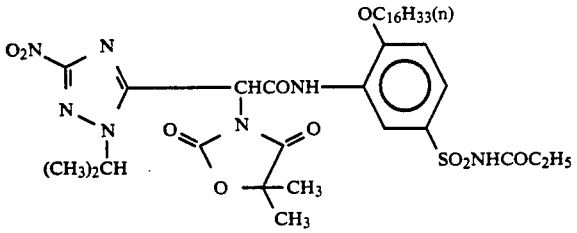
(43)
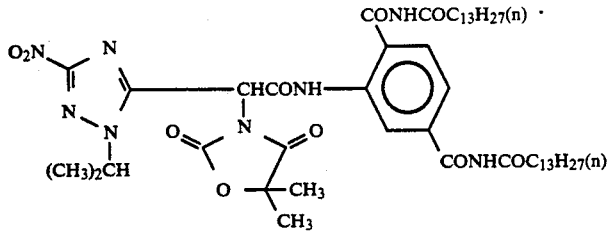
(44)
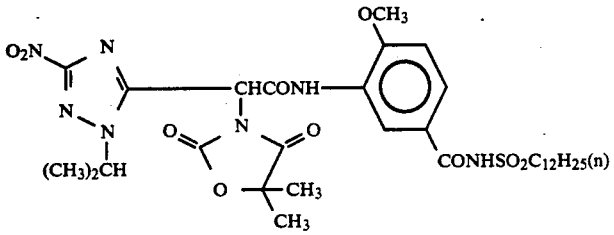

-continued
(45)
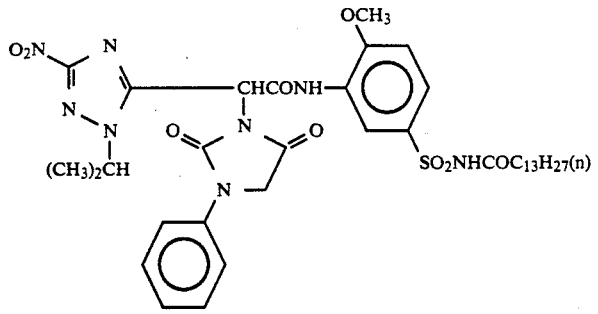
(46)
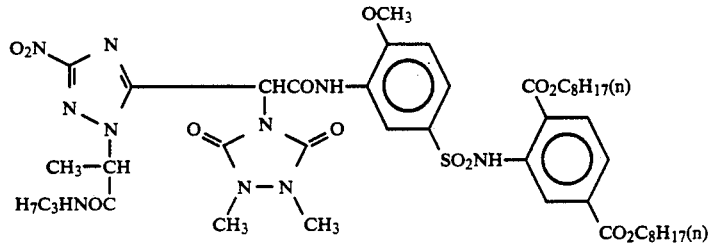
(47)
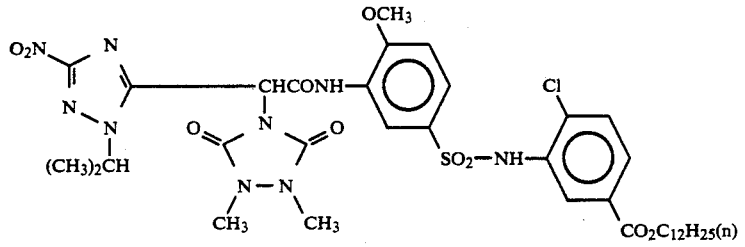
(48)
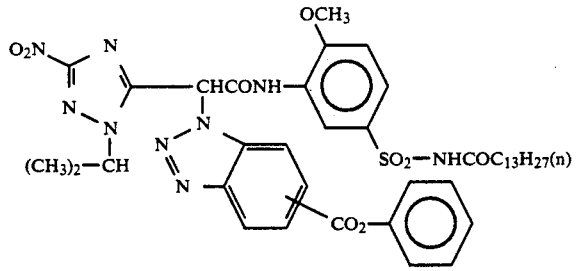
(49)
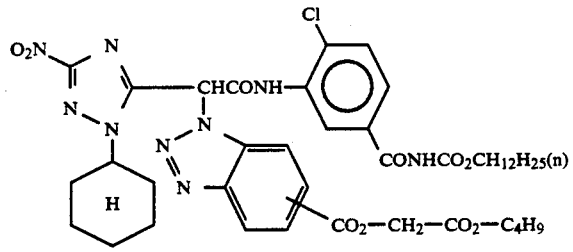
(50)
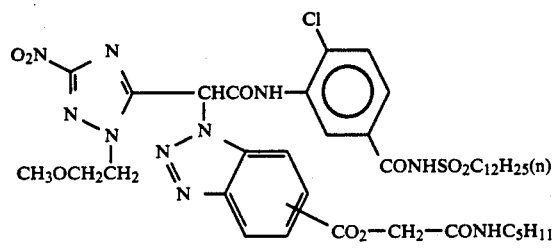

-continued
(51)
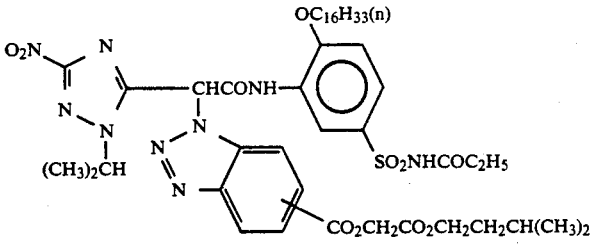
(52)
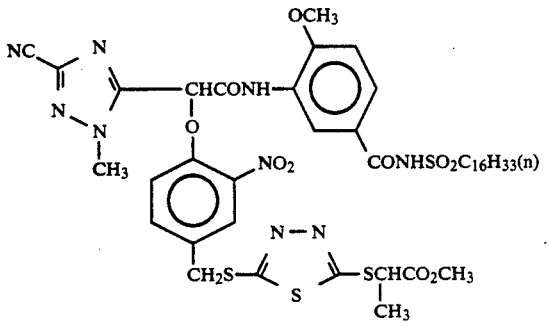
(53)
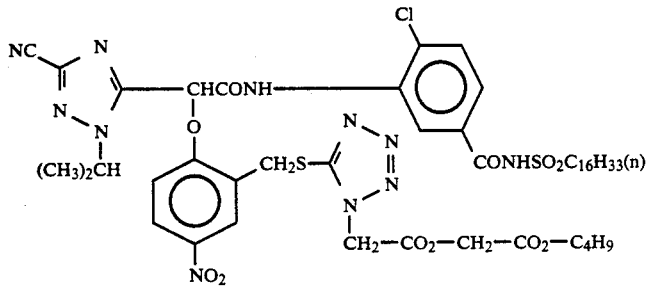
(54)
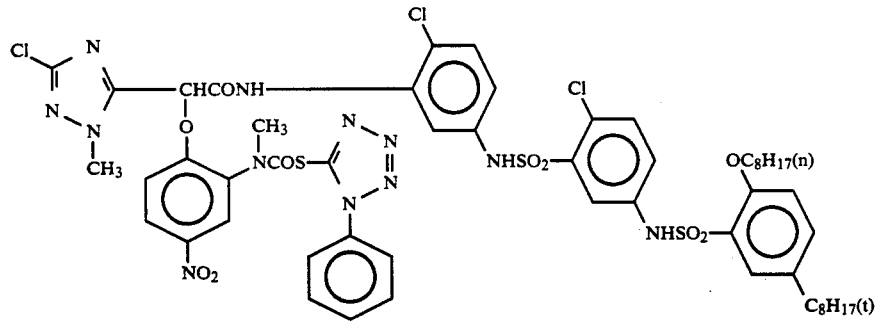
(55)
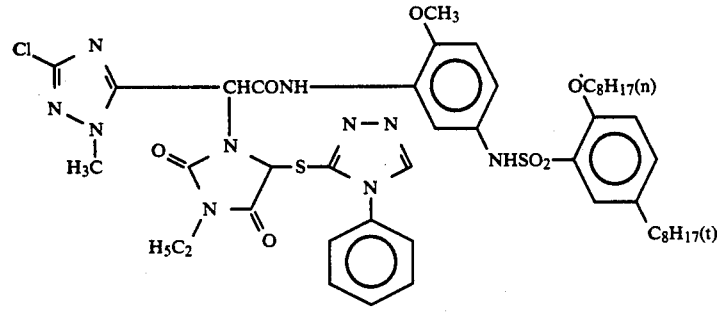

-continued
(56)
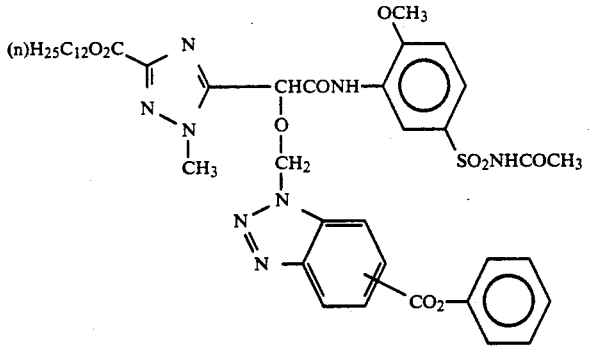
(57)
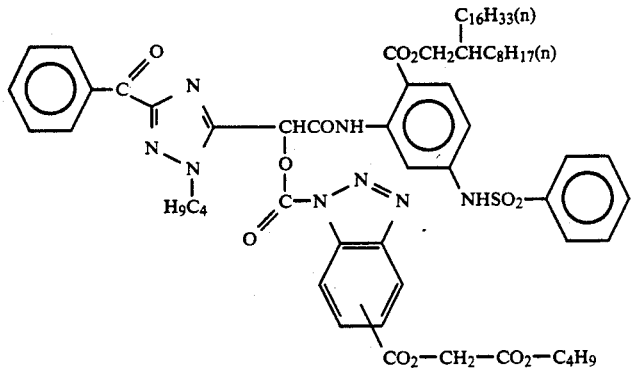
(58)
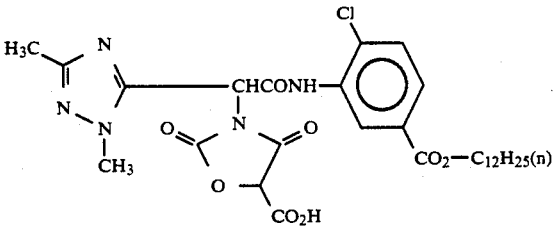
(59)
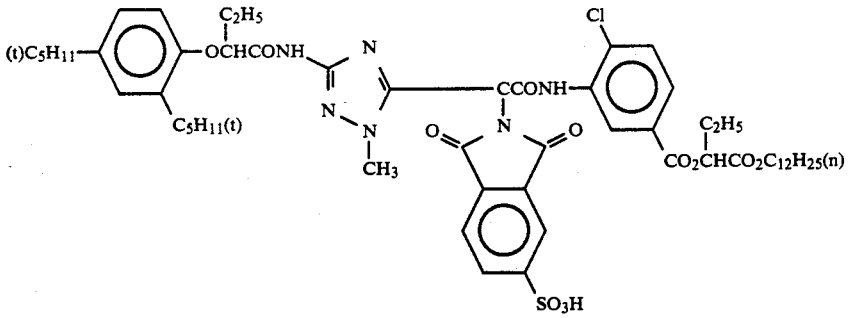
(60)
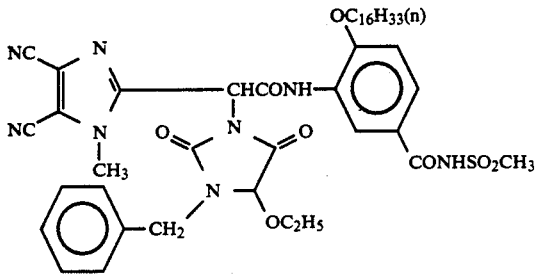

-continued
(61)
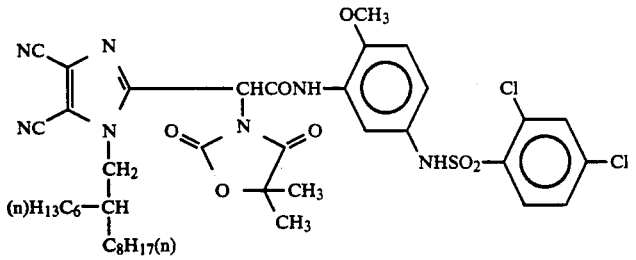
(62)
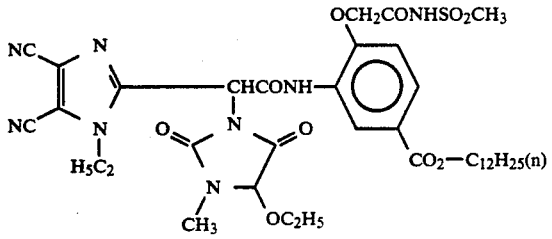
(63)
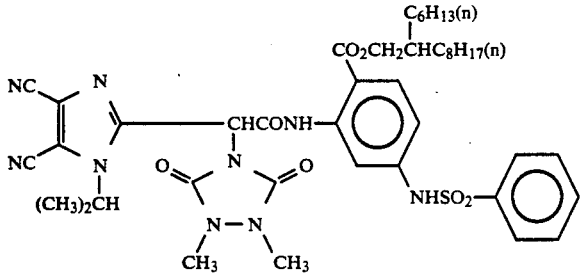
(64)
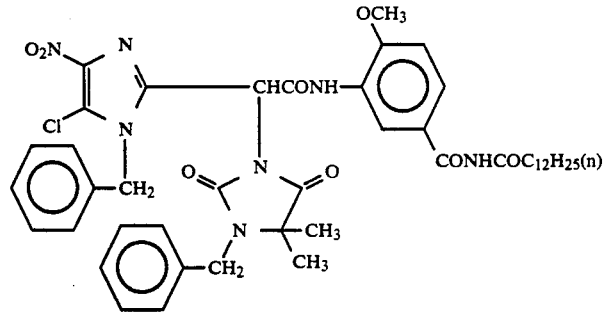
(65)
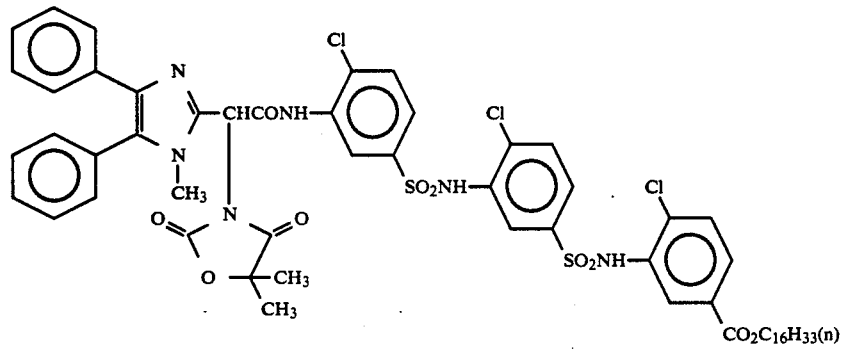

-continued
(66)
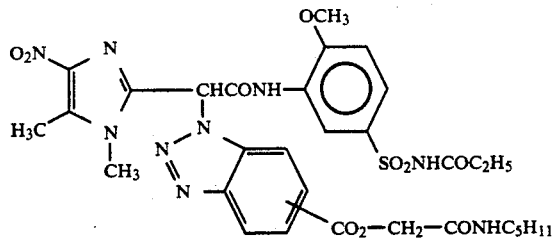
(67)
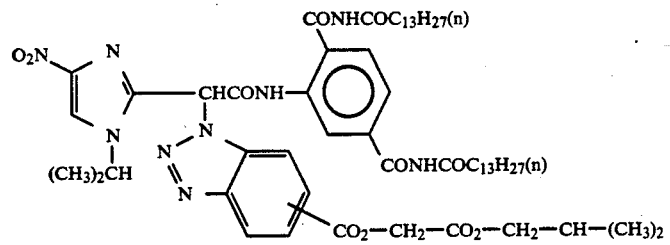
(68)
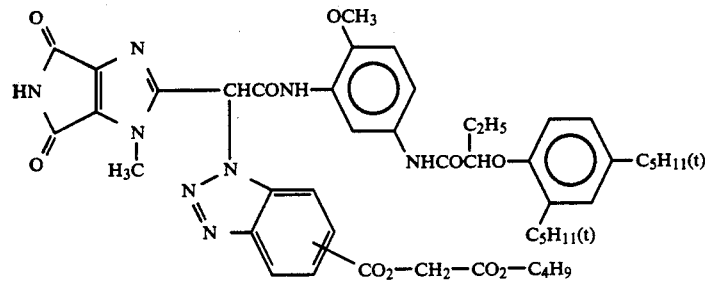
(69)
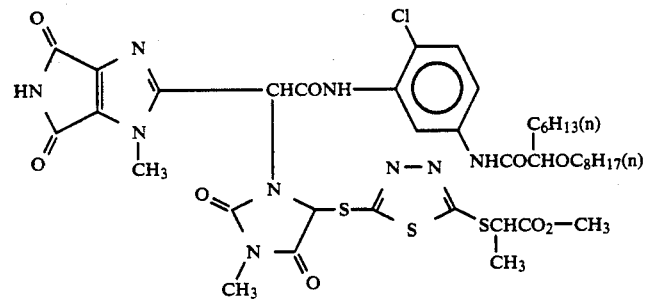
(70)
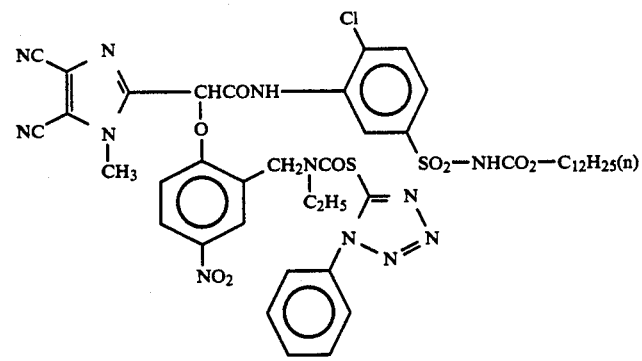
(71)
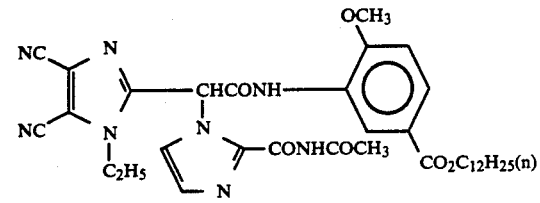

-continued
(72)
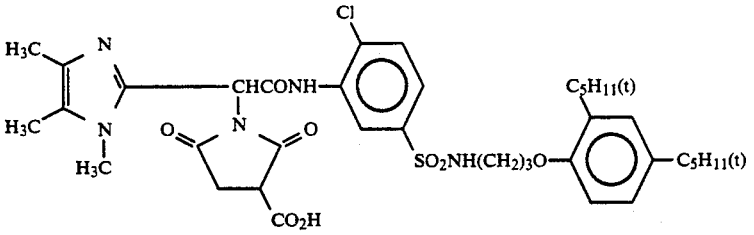
(73)
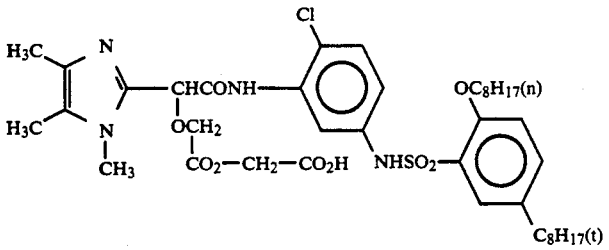
(74)
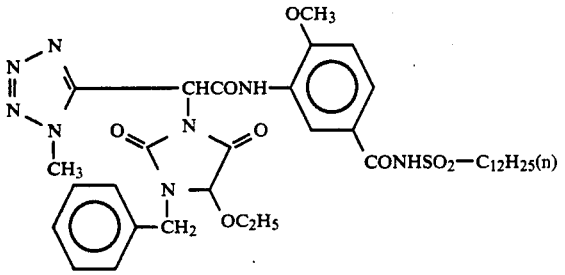
(75)
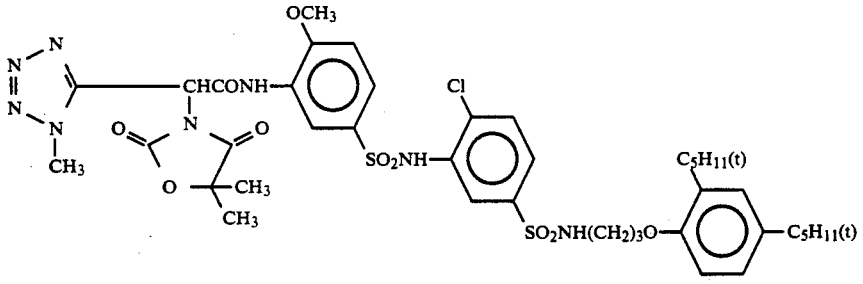
(76)
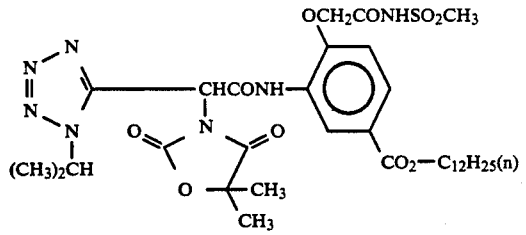
(77)
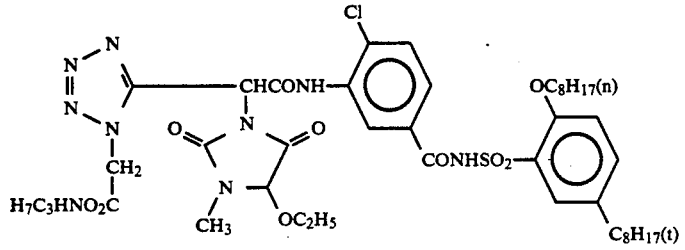

-continued
(78)
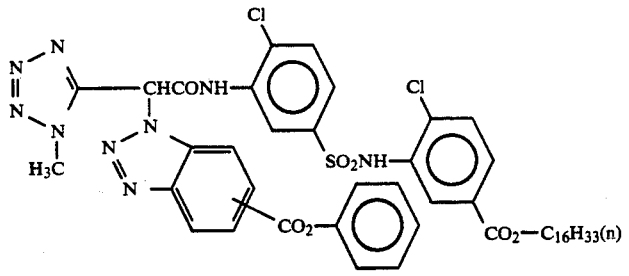
(79)
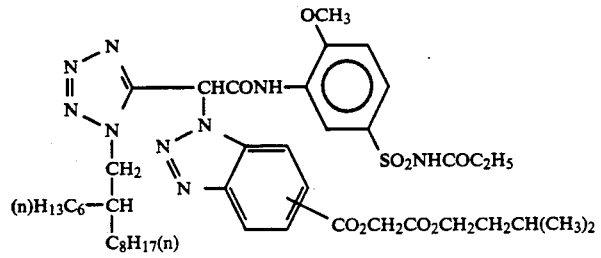
(80)
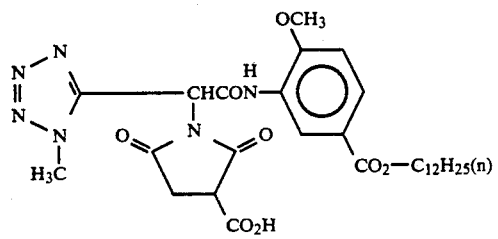
(81)
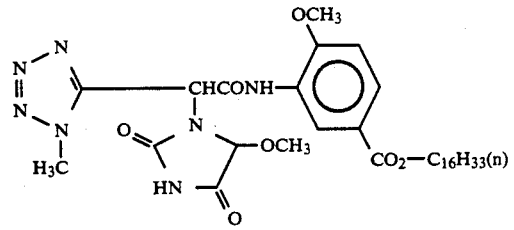
(82)
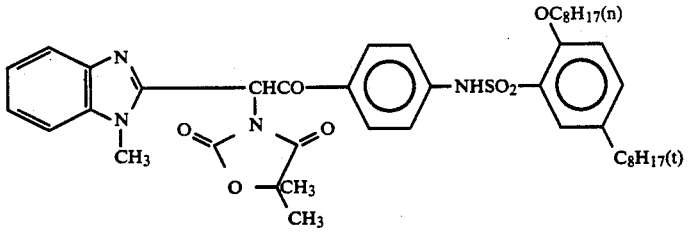
(83)
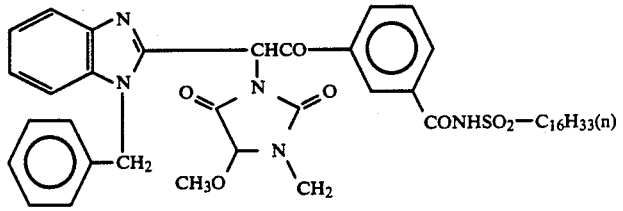

-continued
(84)
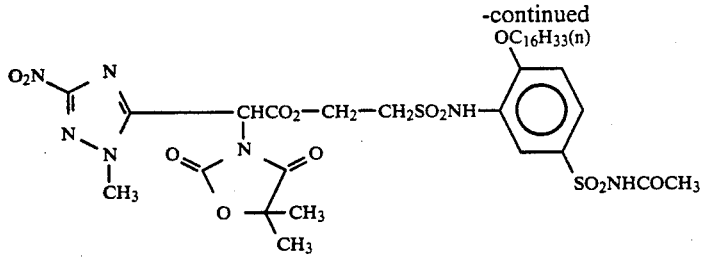
(85)
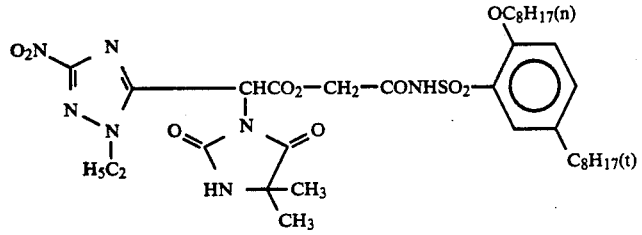
(86)
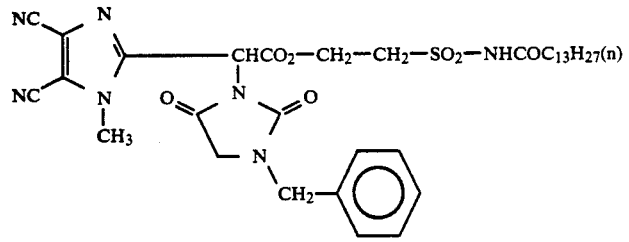
(87)
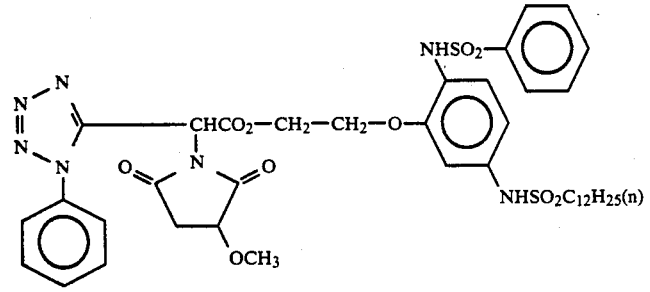
(88)
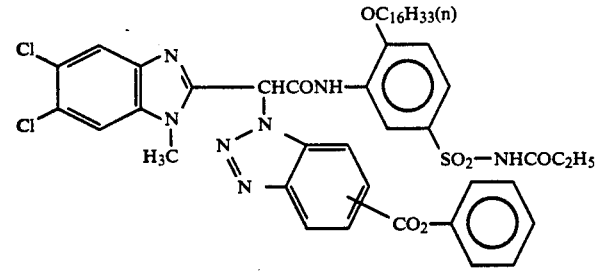
(89)
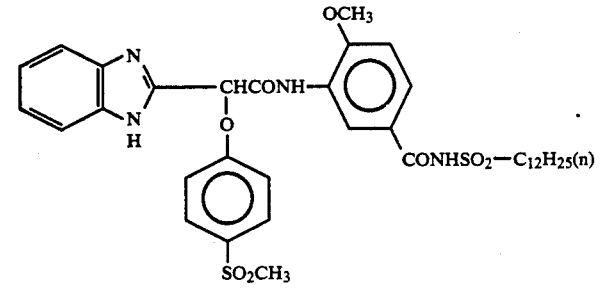
These compounds may easily be prepared by a process disclosed, for example, in Organic Syntheses Collective Volume I, page 245. For example, these compounds may be prepared by a process of halogenating a compound of a general formula (XIV):

(XIV)

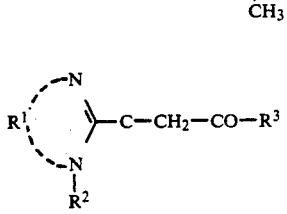

where $R^1$, $R^2$ and $R^3$ have the same meanings as those in formula (I), at the active methylene part thereof, by an ordinary method, followed by reacting the halogenated intermediate and a compound XH (where X has the same meaning as that in formula (I)) in the presence of a base. Alternatively, compounds of formula (I) where X is bonded to the formula via a sulfur atom may also be prepared by reacting a compound of formula (XIV) and a sulfenyl chloride XCl which is obtained by reacting a compound XH and a chlorine gas or sulfuryl chloride.

Some production examples for illustrating the production of typical compounds of formula (I) to be used in the present invention are mentioned below.

Other compounds of formula (I), not illustrated in the following production examples, may also be prepared in the same manner as the illustrated examples.

PRODUCTION EXAMPLE 1

Production of Compound (1):

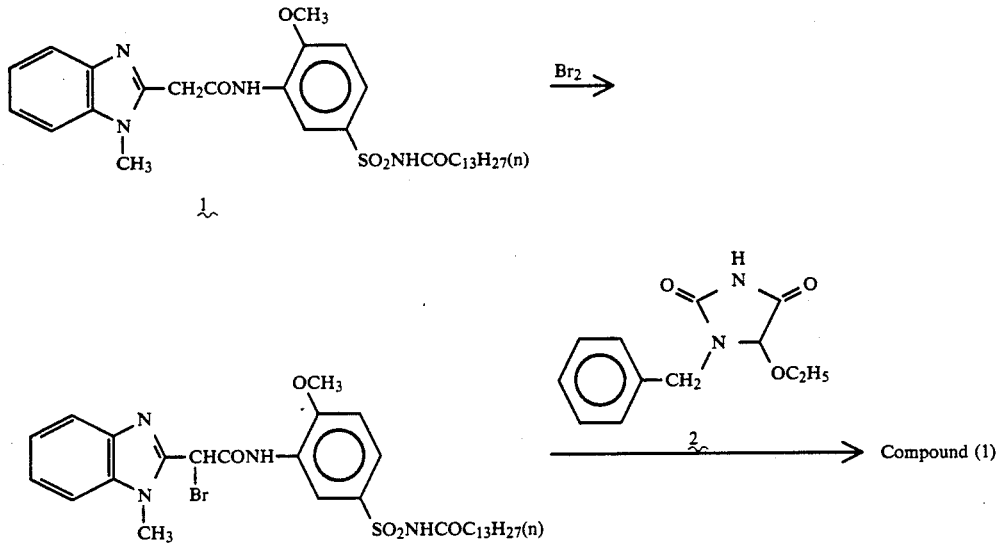

5.0 g of compound 1 was dissolved in 50 ml of methylene chloride, and 1.5 g of bromine was dropwise added thereto over a period of 10 minutes at room temperature. After reacting for 30 minutes at room temperature, the reaction mixture was washed with water and dried with magnesium sulfate. The desiccant magnesium sulfate was removed by filtration, and the resulting filtrate was dropwise added to a solution of 4.0 g of compound 2 and 1.7 g of triethylamine as dissolved in 50 ml of dimethylformamide. After reacting for one hour at 40° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 4.5 g of the intended coupler (1) as a white glassy solid.

PRODUCTION EXAMPLE 2

Production of Compound (3):

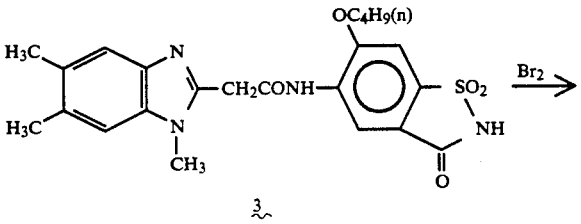

-continued

PRODUCTION EXAMPLE 2

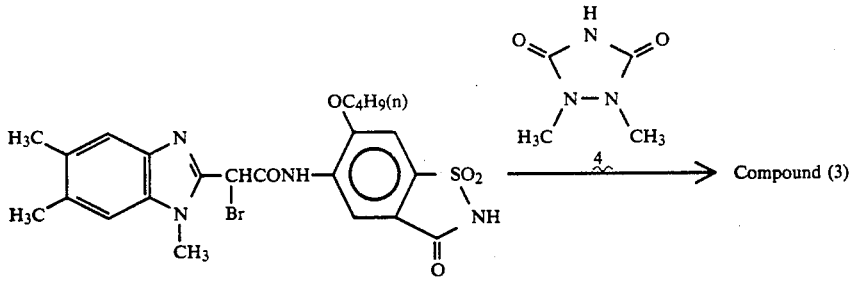

5.0 g of compound 3 was dissolved in 50 ml of methylene chloride, and 1.4 g of bromine was dropwise added thereto over a period of 15 minutes at room temperature. After reacting for 45 minutes at room temperature, the reaction mixture was washed with water and dried with magnesium sulfate. The desiccant magnesium sulfate was removed by filtration, and the resulting filtrate was dropwise added to a solution of 2.0 g of compound 4 and 1.6 g of triethylamine as dissolved in 50 ml of dimethylformamide. After reacting for one hour at 45° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 4.9 g of the intended coupler (3) as a white glassy solid.

6.0 g of compound 5 was dissolved in 60 ml of methylene chloride, and 1.4 g of bromine was dropwise added thereto over a period of 20 minutes at room temperature. After reacting for 40 minutes at room temperature, the reaction mixture was washed with water and dried with magnesium sulfate. The desiccant magnesium sulfate was removed by filtration, and the resulting filtrate was dropwise added to a solution of 2.3 g of compound 6 and 1.8 g of triethylamine as dissolved in 50 ml of dimethylformamide. After reacting for two hours at 45° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 6.1 g of the intended coupler (6) as a glassy solid.

PRODUCTION EXAMPLE 3

Production of Compound (6):

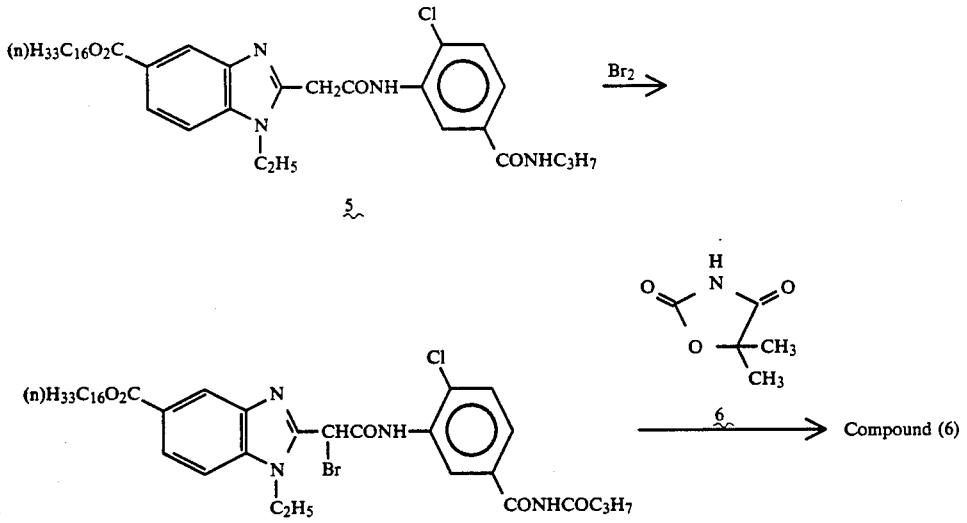

PRODUCTION EXAMPLE 4

Production of Compound (7):

-continued

PRODUCTION EXAMPLE 4

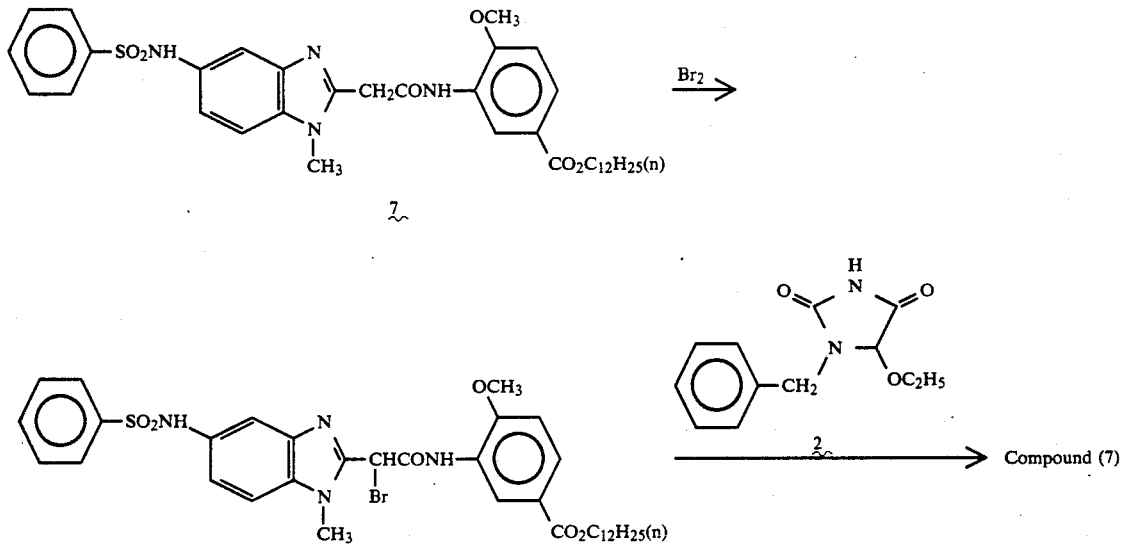

5.0 g of compound 7 was dissolved in 50 ml of methylene chloride, and 1.3 g of bromine was dropwise added thereto over a period of 10 minutes at room temperature. After reacting for 30 minutes at room temperature, the reaction mixture was washed with water and dried with magnesium sulfate. The desiccant magnesium sulfate was removed by filtration, and the resulting filtrate was dropwise added to a solution of 3.5 g of compound 2 and 1.5 g of triethylamine as dissolved in 50 ml of dimethylformamide. After reacting for two hours at 40° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 4.3 g of the intended coupler (7) as a white glassy solid.

PRODUCTION EXAMPLE 5

Production of Compound (13):

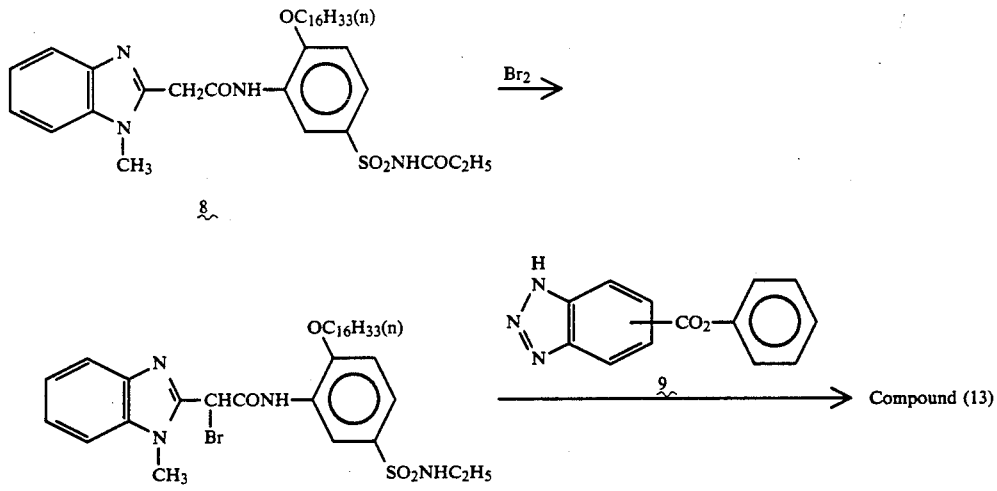

PRODUCTION EXAMPLE 6

Production of Compound (16):

-continued

PRODUCTION EXAMPLE 6

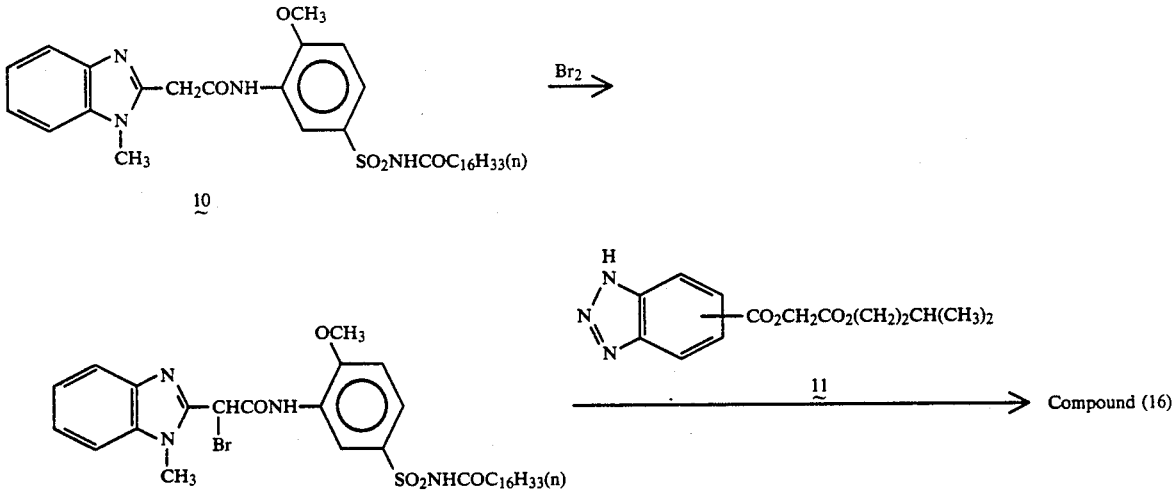

15.0 g of compound 8 was dissolved in 150 ml of methylene chloride, and 4.1 g of bromine was dropwise added thereto over a period of 20 minutes at room temperature. After reacting for 50 minutes at room temperature, the reaction mixture was washed with water and dried with magnesium sulfate. The desiccant magnesium sulfate was removed by filtration, and the resulting filtrate was dropwise added to a solution of 11.2 g of compound 9 and 4.7 g of triethylamine as dissolved in 150 ml of dimethylformamide. After reacting for three hours at room temperature, the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was crystallized from a mixed solvent of isopropyl alcohol and ethyl acetate to obtain 12.2 g of the intended coupler (13) as a pale yellow crystal having a melting point of 155° to 159° C.

6.4 g of compound 10 was dissolved in 60 ml of methylene chloride, and 1.8 g of bromine was dropwise added thereto over a period of 15 minutes at room temperature. After reacting for 40 minutes at room temperature, the reaction mixture was washed with water and dried with magnesium sulfate. The desiccant magnesium sulfate was removed by filtration, and the resulting filtrate was dropwise added to a solution of 6.0 g of compound 11 and 2.1 g of triethylamine as dissolved in 60 ml of dimethylformamide. After reacting for four hours at room temperature, the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 5.5 g of the intended coupler (16) as a pale yellow glassy solid.

PRODUCTION EXAMPLE 6

Production of Compound (16):

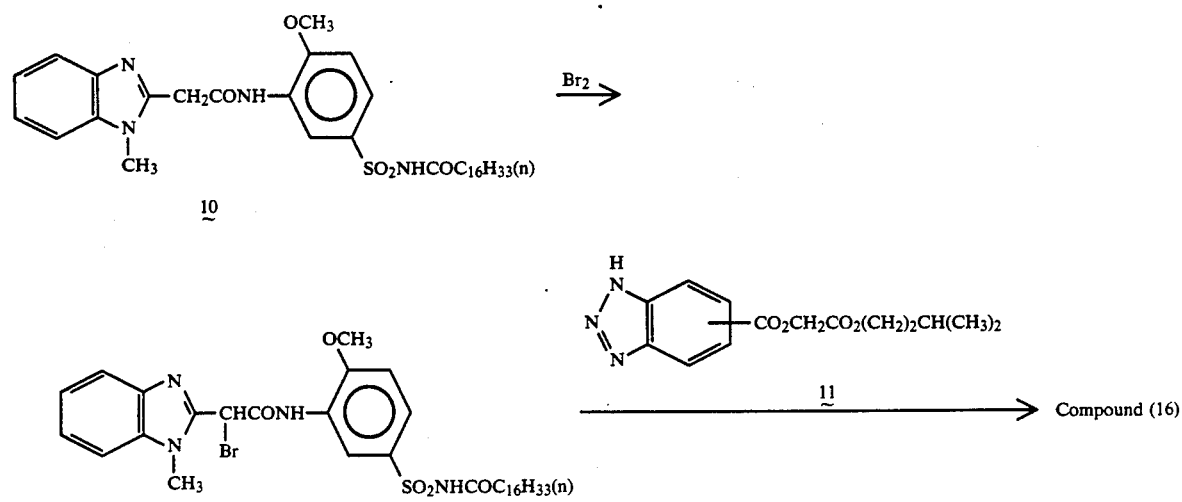

PRODUCTION EXAMPLE 7

Production of Compound (19):

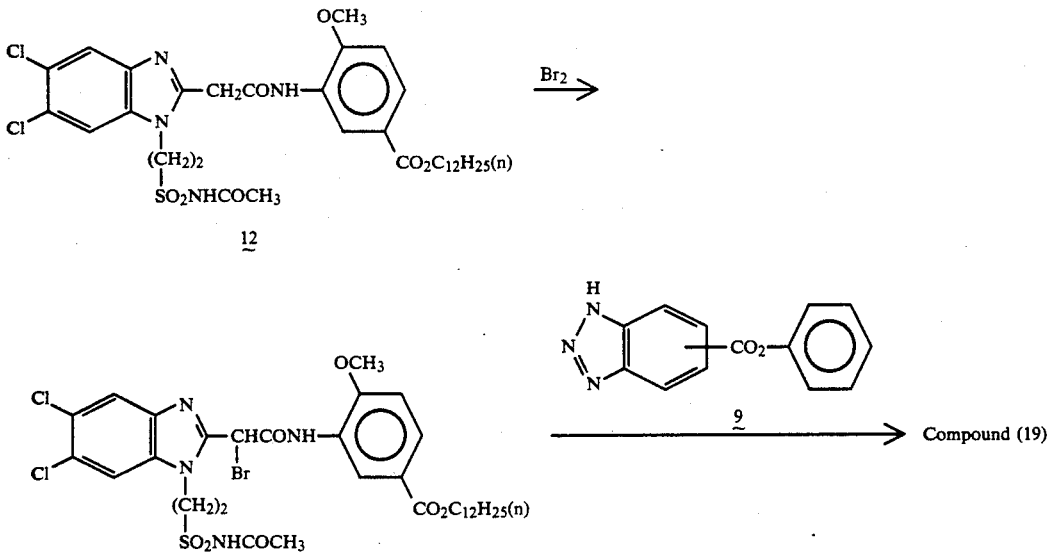

5.0 g of compound 12 was dissolved in 50 ml of methylene chloride, and 1.3 g of bromine was dropwise added thereto over a period of 15 minutes at room temperature. After reacting for 30 minutes at room temperature, the reaction mixture was washed with water and dried with magnesium sulfate. The desiccant magnesium sulfate was removed by filtration, and the resulting filtrate was dropwise added to a solution of 3.4 g of compound 9 and 1.5 g of triethylamine as dissolved in 50 ml of dimethylformamide. After reacting for two hours at 35° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 4.3 g of the intended coupler (19) as a white glassy solid.

PRODUCTION EXAMPLE 8

Production of Compound (29):

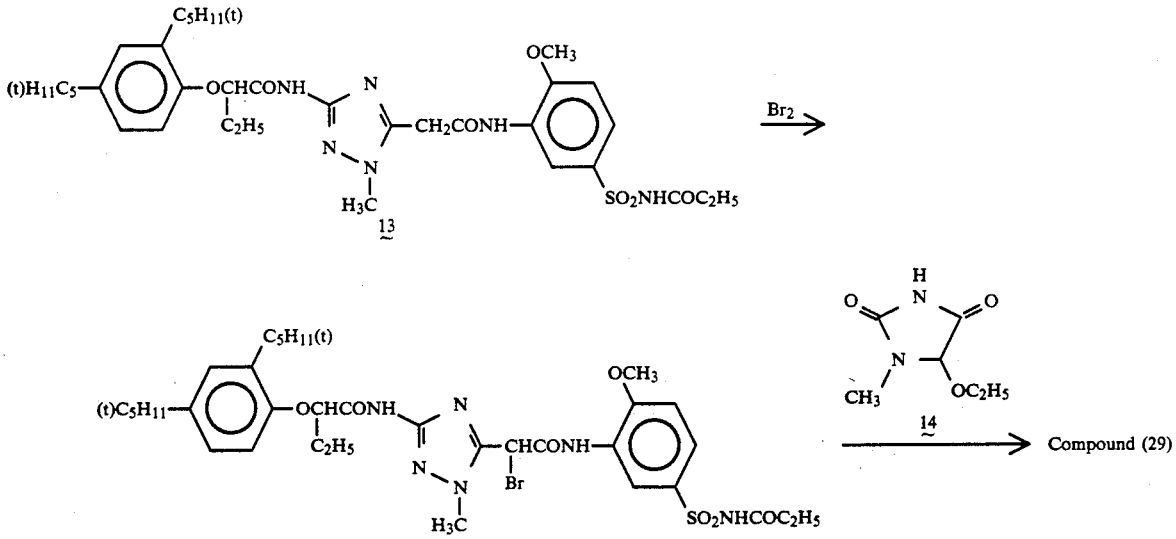

8.5 g of compound 13 was dissolved in 85 ml of methylene chloride, and 2.2 g of bromine was dropwise added thereto over a period of 10 minutes at room temperature. After reacting for 40 minutes at room temperature, the reaction mixture was washed with water and dried with magnesium sulfate. The desiccant magnesium sulfate was removed by filtration, and the resulting filtrate was dropwise added to a solution of 3.8 g of compound 14 and 2.5 g of triethylamine as dissolved in 85 ml of dimethylformamide. After reacting for two hours at 40° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 5.2 g of the intended coupler (29) as a pale yellow glassy solid.

dried with magnesium sulfate. The desiccant magnesium sulfate was removed by filtration, and the resulting filtrate was dropwise added to a solution of 9.3 g of compound 2 and 4.0 g of triethylamine as dissolved in 50 ml of dimethylformamide. After reacting for four hours at 40° C., the reaction mixture was poured into water and extracted with ethyl acetate. The organic layer was washed with water and dried with magnesium sulfate. The desiccant magnesium sulfate was re-

PRODUCTION EXAMPLE 8

Production of Compound (34):

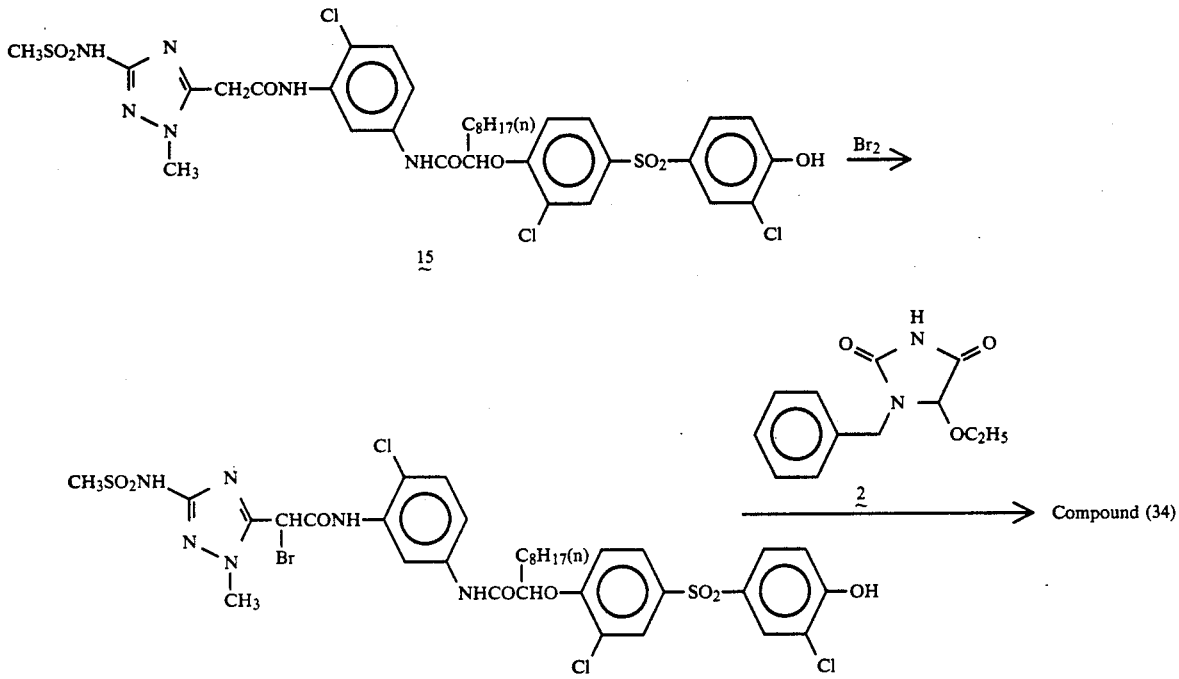

15.0 g of compound 15 was dissolved in 150 ml of methylene chloride, and 3.5 g of bromine was dropwise added thereto over a period of 40 minutes at room temperature. After reacting for 50 minutes at room temperature, the reaction mixture was washed with water and moved by filtration, and the solvent was removed by distillation under reduced pressure to obtain a yellow oil. This was purified by silicagel column chromatography to obtain 14.2 g of the intended coupler (34) as a pale yellow oil.

PRODUCTION EXAMPLE 10

Production of Compound (36):

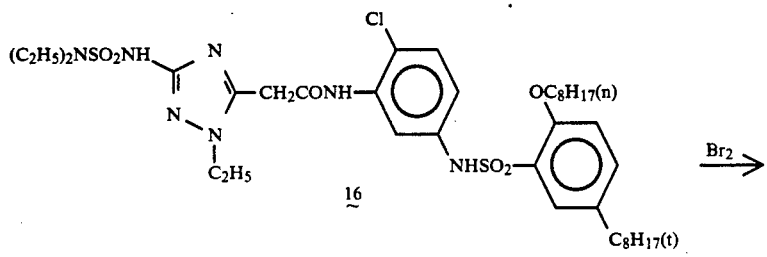

-continued

PRODUCTION EXAMPLE 10

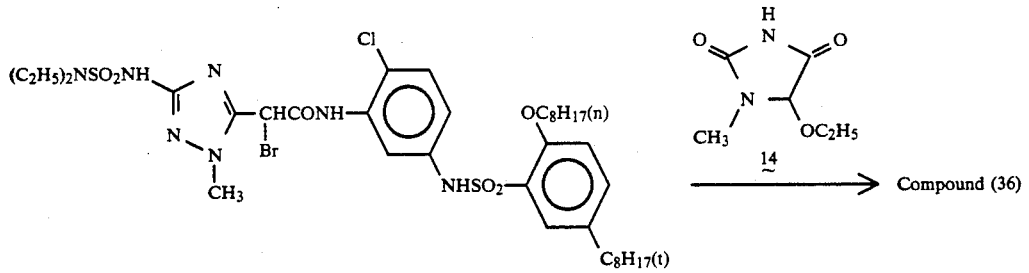

5.0 g of compound 16 was dissolved in 50 ml of methylene chloride, and 1.1 g of bromine was dropwise added thereto over a period of 15 minutes at room temperature. After reacting for 30 minutes at room temperature, the reaction mixture was washed with water and dried with magnesium sulfate. The desiccant magnesium sulfate was removed by filtration, and the resulting filtrate was dropwise added to a solution of 2.0 g of compound 14 and 1.3 g of triethylamine as dissolved in 50 ml of dimethylformamide. After reacting for two hours at 45° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 4.8 g of the intended coupler (36) as a white glassy solid.

25.0 g of compound 17 was dissolved in 250 ml of methylene chloride, and 7.6 g of bromine was dropwise added thereto over a period of 35 minutes at room temperature. After reacting for 60 minutes at room temperature, the reaction mixture was washed with water and dried with magnesium sulfate. The desiccant magnesium sulfate was removed by filtration, and the resulting filtrate was dropwise added to a solution of 20.2 g of compound 2 and 8.7 g of triethylamine as dissolved in 50 ml of dimethylformamide. After reacting for five hours at 40° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 24.4 g of the intended coupler (41) as a white glassy solid.

PRODUCTION EXAMPLE 11

Production of Compound (41):

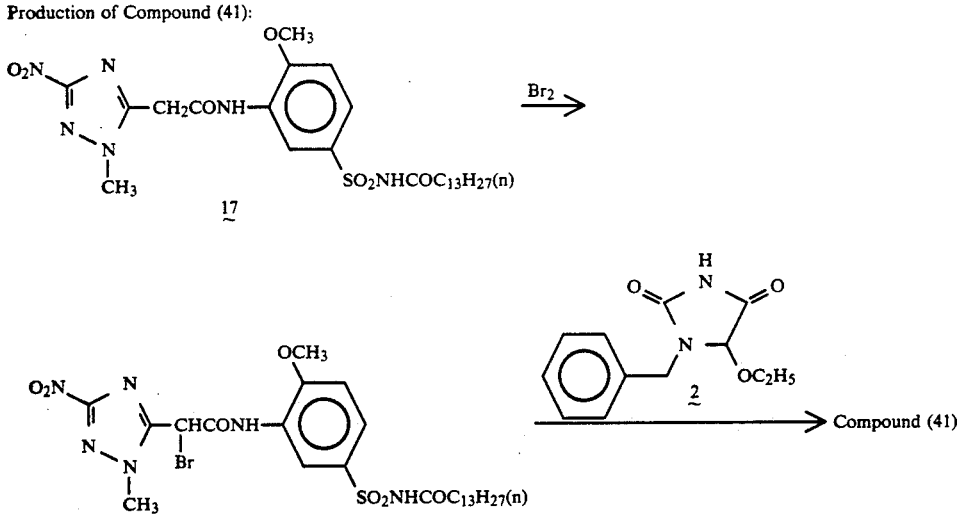

PRODUCTION EXAMPLE 12

Production of Compound (50):

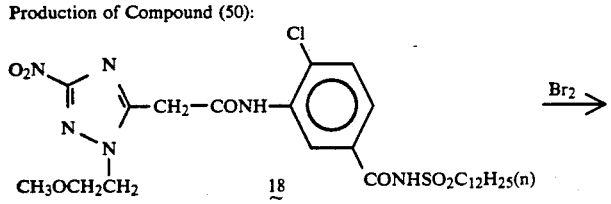

-continued

PRODUCTION EXAMPLE 12

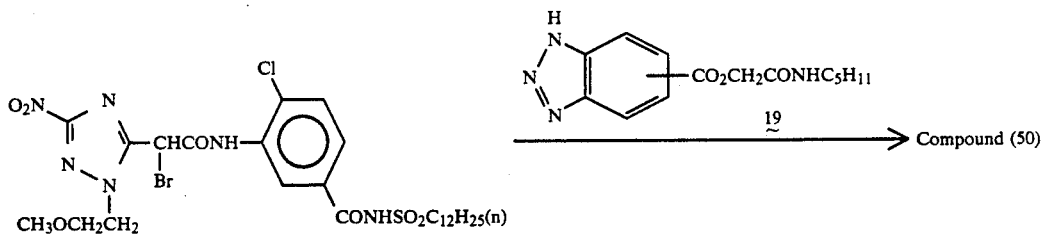

7.8 g of compound 18 was dissolved in 80 ml of methylene chloride, and 2.2 g of bromine was dropwise added thereto over a period of 10 minutes at room temperature. After reacting for 50 minutes at room temperature, the reaction mixture was washed with water and dried with magnesium sulfate. The desiccant magnesium sulfate was removed by filtration, and the resulting filtrate was dropwise added to a solution of 7.4 g of compound 19 and 2.6 g of triethylamine as dissolved in 80 ml of dimethylformamide. After reacting for 1 hour at room temperature, the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 4.8 g of the intended coupler (50) as a pale yellow glassy solid.

15.0 g of compound 20 was dissolved in 150 ml of methylene chloride, and 4.0 g of bromine was dropwise added thereto over a period of 25 minutes at room temperature. After reacting for 40 minutes at room temperature, the reaction mixture was washed with water and dried with magnesium sulfate. The desiccant magnesium sulfate was removed by filtration, and the resulting filtrate was dropwise added to a solution of 13.1 g of compound 11 and 4.6 g of triethylamine as dissolved in 50 ml of dimethylformamide. After reacting for one hour at 40° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 13.0 g of the intended coupler (51) as a pale yellow oil.

PRODUCTION EXAMPLE 13

Production of Compound (51):

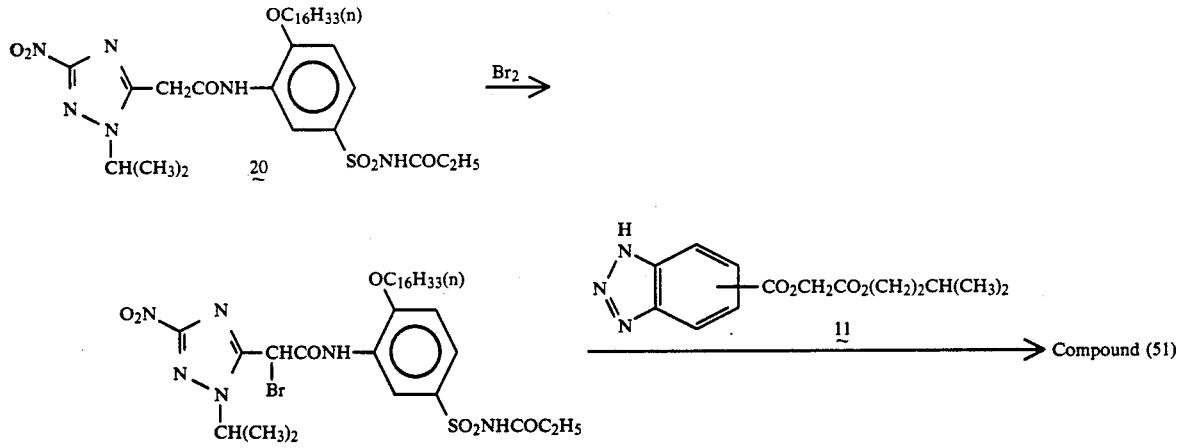

PRODUCTION EXAMPLE 14

Production of Compound (82):

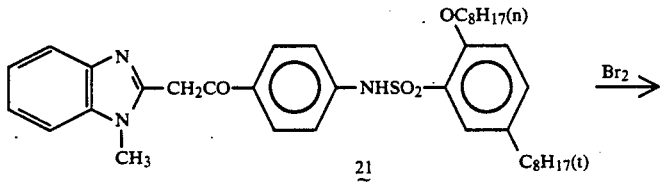

-continued

PRODUCTION EXAMPLE 14

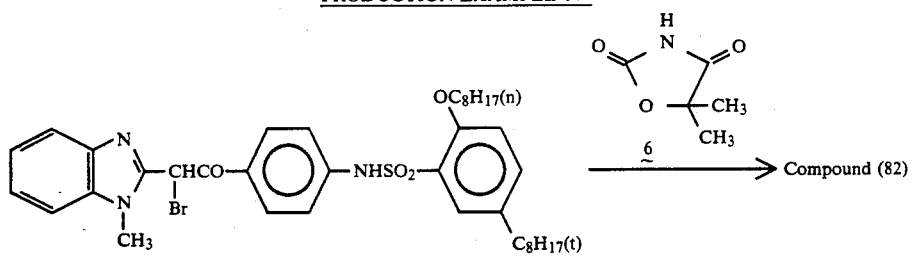

10.0 g of compound 21 was dissolved in 100 ml of methylene chloride, and 2.7 g of bromine was dropwise added thereto over a period of 25 minutes at room temperature. After reacting for 50 minutes at room temperature, the reaction mixture was washed with water and dried with magnesium sulfate. The desiccant magnesium sulfate was removed by filtration, and the resulting filtrate was dropwise added to a solution of 2.0 g of compound 6 and 3.1 g of triethylamine as dissolved in 100 ml of dimethylformamide. After reacting for three hours at 40° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow oil. This was purified by silicagel column chromatography to obtain 9.5 g of the intended coupler (82) as a pale yellow oil.

PRODUCTION EXAMPLE 15

Production of Compound (88):

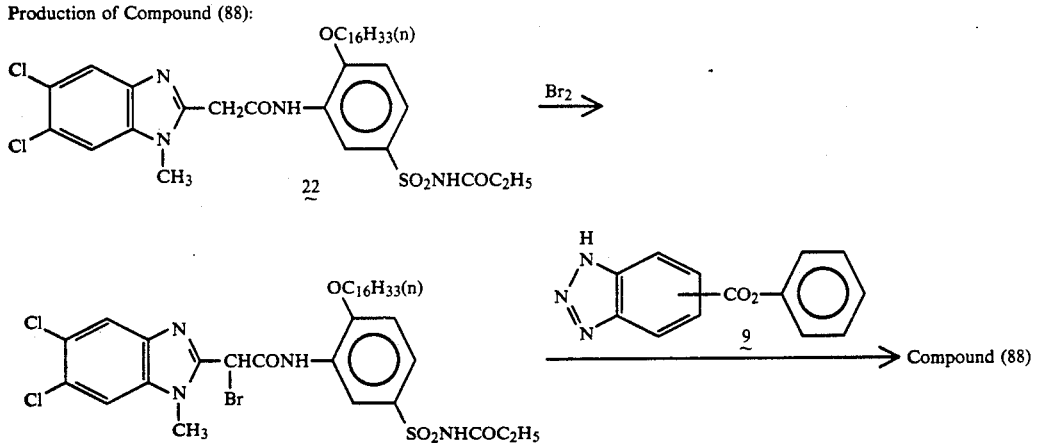

8.3 g of compound 22 was dissolved in 100 ml of methylene chloride, and 1.9 g of bromine was dropwise added thereto over a period of 10 minutes at room temperature. After reacting for 80 minutes at room temperature, the reaction mixture was washed with water and dried with magnesium sulfate. The desiccant magnesium sulfate was removed by filtration, and the resulting filtrate was dropwise added to a solution of 5.8 g of compound 9 and 2.46 g of triethylamine as dissolved in 100 ml of dimethylformamide. After reacting for one hour at 40° C., the reaction mixture was poured into water and extracted with ethyl acetate. The organic layer was washed with water and dried with magnesium sulfate. The desiccant magnesium sulfate was removed by filtration, and the solvent was removed by distillation under reduced pressure to obtain a yellow crystal. This was recrystallized from methanol to obtain 7.6 g of the intended coupler (88) as a pale yellow crystal having a melting point of 202° to 203° C..

Compounds of formula (I) of the present invention can be used in a multi-layer multi-color photographic material having at least three light-sensitive layers each having a different color sensitivity on a support. A multi-layer natural color photographic material, to which compounds of formula (I) of the present invention can be applied, generally has at least one red-sensitive emulsion layer, at least one green-sensitive emulsion layer and at least one blue-sensitive emulsion layer.

In such a natural color photographic material, the order of the layers to be provided on the support may freely be selected in accordance with the use and object of the material. Compounds of formula (I) of the present invention may be incorporated in any of such layers in the material, and they are generally incorporated into the blue-sensitive emulsion layer or into the adjacent layer (interlayer, etc.). They may be incorporated into any of the high-sensitivity layer, middle-sensitivity layer and low-sensitivity layer constituting the blue-sensitive layer.

The amount of the compound of formula (I) of the invention to be added varies, in accordance with the structure of the compound itself, and is generally from $1\times10^{-7}$ to 1.0 mol, especially preferably from $1\times10^{-6}$ to 0.5 mol, per mol of silver in the layer to which the compound is added or in the adjacent layer.

The layer containing the yellow coupler of the present invention may contain a high boiling point organic solvent, and the amount of the solvent to be added to the layer is preferably 2 or less, especially preferably 0.7 or less, as a weight ratio to the amount of the total yellow coupler(s) in the layer.

The yellow coupler of the present invention may be incorporated into the layer as instructed above either singly or in combination with any other conventional coupler(s).

The photographic material of the present invention is not specifically defined, provided that it has at least one blue-sensitive silver halide emulsion layer, at least one green-sensitive silver halide emulsion layer and at least one red-sensitive silver halide emulsion layer on a support. In the photographic material, the number of the silver halide emulsion layers and non light-sensitive layers as well as the order of the layers on the support is not specifically defined. As one typical example, there is mentioned a silver halide color photographic material having plural light-sensitive layer units each composed of plural silver halide emulsion layers each having a substantially the same color-sensitivity but having a different degree of sensitivity. The respective light-sensitive layers are unit light-sensitive layers each having a color-sensitivity to anyone of blue light, green light and red light. In such a multi-layer silver halide color photographic material, in general, the order of the light-sensitive layer units to be on the support comprises a red-sensitive layer unit, a green-sensitive layer unit and a blue-sensitive layer unit as formed on the support in this order. As the case may be, however, the order may be opposite to the above-mentioned one, in accordance with the object of the photographic material. As still another embodiment, a different color-sensitive layer may be sandwiched between the other two and the same color-sensitive layers.

Various non-light-sensitive layers such as an interlayer may be provided between the above-mentioned silver halide light sensitive layers, or on or below the uppermost layer or lowermost layers.

Such an interlayer may contain various couplers and the DIR compounds described in JP-A-61-43748, 59-113438, 59-113440, 61-20037 and 61-20038, and it may also contain conventional color mixing preventing agents.

As the constitution of the plural silver halide emulsions constituting the respective light-sensitive layer units, preferred is a two-layered constitution composed of a high-sensitivity emulsion layer and a low-sensitivity emulsion layer as described in West German Patent 1,121,470 and British Patent 923,045. In general, it is preferred that the plural light-sensitive layers are arranged on the support in such a way that the degree of sensitivity of the layer is to gradually decrease in the direction to the support. In one embodiment, a non-light-sensitive layer may be provided between the plural silver halide emulsion layers. In another embodiment, a low-sensitivity emulsion layer is formed remote from the support and a high-sensitivity emulsion layer is formed near to the support, as described in JP-A-57-112751, 62-200350, 62-206541, and 62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/BL/GH/RH/RL; and an order of BH/BL/GH/GL/RL/RH.

As other examples, there are mentioned an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and 62-63936.

As a further example, there is mentioned a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of this type, the degree of sensitivity of each emulsion layer is gradually lowered in the direction of the support. Even in the three-layer constitution of this type, each of the same color-sensitivity layers may be composed of three layers of middle-sensitivity emulsion layer/high-sensitivity emulsion layer/low-sensitivity emulsion layer as formed in this order from the remotest side from the support, as described in JP-A 59-202464.

As still other examples of the layer constitution of the photographic material of the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer.

Where the photographic material of the invention has four or more layers, the layer constitution thereof may be varied in accordance with the manner mentioned above.

As mentioned above, various layer constitutions and arrangements may be selected in accordance with the object of the photographic material of the invention.

The silver halide to be preferably used in the photographic emulsion layer constituting the photographic material of the present invention is silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 10 mol %.

The silver halide grains to be used in the photographic emulsions constituting the photographic material of the present invention may be regular crystalline ones such as cubic, octahedral or tetradecahedral grains, or irregular crystalline ones such as spherical or tabular grains, or irregular crystalline ones having a crystal defect such as a twin plane, or composite crystalline ones composed of the above-mentioned regular and irregular crystalline forms.

Regarding the grain size of the silver halide grains, the grains may be fine grains having a small grain size of about 0.2 microns or less or may be large ones having a large grain size of up to about 10 microns as the diameter of the projected area. The emulsion of the grains may be either a polydispersed emulsion or a monodispersed emulsion.

The silver halide photographic emulsions to be used in the present invention may be prepared by various methods, for example, those described in *Research Disclosure* (RD) No. 17643 (December, 1978), pages 22 to 23 (I. Emulsion Preparation and Types); RD No. 18716 (November, 1979), pages 648; RD No. 307105 (November, 1989); P. Glafkides, *Chimie et Physique Photographique* (published by Paul Montel, 1967); G. F. Duffin,

*Photographic Emulsion Chemistry* (published by Focal Press, 1966); and V. L. Zelikman et al., *Making and Coating Photographic Emulsion* (published by Focal Press, 1964).

Monodispersed emulsions as described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with the various methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112,157.

Regarding the crystal structure of the silver halide grains constituting the emulsions of the invention, the grains may have the same halogen composition throughout the whole grain, or they may have different halogen compositions between the inside part and the outside part of one grain, or they may have a layered structure. Further, the grains may have different halogen compositions as conjugated by an epitaxial bond, or they may have other components than silver halides, such as silver rhodanide or lead oxide, as conjugated with the silver halide matrix. Additionally, a mixture of various grains of different crystalline forms may be employed in the present invention.

The above-mentioned emulsions may be either surface latent image type emulsions for forming latent images essentially on the surfaces of the grains or internal latent image type emulsions for forming latent images essentially in the insides of the grains, or they may also be composite emulsions for forming latent images both on the surfaces of the grains and in the insides thereof. However, the emulsions must be negative ones. Of the latter internal latent image type emulsions, core/shell type internal latent image type emulsions described in JP-A-63-264740 are referred to. Preparation of such core/shell type internal latent image type emulsions is disclosed in JP-A-59-133542. The preferred thickness of the shell of the grains in the emulsion is, though varying in accordance with the way of development of the material, approximately from 3 to 40 nm, especially preferably from 5 to 20 nm.

The emulsions for use in the invention are generally physically ripened, chemically ripened and/or color-sensitized. Additives to be used in such a ripening or sensitizing step are described in *Research Disclosure* Nos. 17643, 18716 and 307105, and the related descriptions in these references are shown in Table mentioned below.

In preparing the photographic material of the present invention, two or more light-sensitive silver halide emulsions which are different from one another with respect to at least one characteristic of the grain size, grain size distribution, halogen composition, shape of grains and sensitivity may be blended and incorporated into one layer.

Surface-fogged silver halide grains as described in U.S. Pat. No. 4,082,553, inside-fogged silver halide grains as described in U.S. Pat. No. 4,626,498 and JP-A-59-214852 and colloidal silver are preferably incorporated into the light-sensitive silver halide emulsion layers and/or substantially non-light-sensitive hydrophilic colloid layers constituting the photographic material of the present invention. Inside-fogged or surface fogged silver halide grains are meant to be silver halide grains capable of being uniformly (or non-imagewise) developed irrespective of the non-exposed part or exposed part of the photographic material containing them. Preparation of such inside-fogged or surface-fogged silver halide grains is described in U.S. Pat. No. 4,626,498 and JP-A-59-214852.

The silver halide forming the inside core of an inside-fogged core/shell type silver halide grain may have the same halogen composition as that of the shell thereof or may have a different halogen from that of the latter. Such an inside-fogged or surface-fogged silver halide grain may be any of silver chloride, silver chlorobromide, silver iodobromide and silver chloroiodobromide grain. The grain size of the fogged silver halide grains is not specifically defined, but the grains are desired to have a mean grain size of from 0.01 to 0.75 μm, especially preferably from 0.05 to 0.6 μm. The grains are also not specifically defined with respect to the shape thereof. They may be regular grains or they may be in the form of a polydispersed emulsion. However, they are preferably in the form of a monodispersed emulsion (where at least 95% by number or by weight of all the silver halide grains therein have a grain size falling within the range of the mean grain size plus/minus 40%).

The photographic material of the present invention preferably contains non-light-sensitive fine silver halide grains. Non-light-sensitive fine silver halide grains are meant to be fine silver halide grains which are not sensitive to the light as imparted to the photographic material for imagewise exposure thereof and are substantially not developed in the step of development of the exposed material. These fine grains are desired not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains are desired to have a mean grain size (as a mean value of the circle-corresponding diameter of the projected area) of from 0.01 to 0.5 μm, more preferably from 0.02 to 0.2 μm.

The fine silver halide grains may be prepared by the same method as that of preparing ordinary light-sensitive silver halide grains. The surfaces of the fine silver halide grains to be prepared do not need to be optically sensitized and color sensitization of the grains is unnecessary. However, prior to addition of the fine grains to the coating composition, it is desired to previously add a known stabilizer, such as triazole compounds, azaindene compounds, benzothiazolium compounds or, mercapto compounds or zinc compounds, to the coating composition. Incorporation of a colloidal silver into the fine silver halide grains-containing layer is also preferred.

In preparing the photographic material of the present invention, the amount of the silver to be used therein is preferably 6.0 g/m$^2$ or less, most preferably 4.5 g/m$^2$ or less.

Various known photographic additives which may be used in preparing the photographic materials of the present invention are mentioned in the above-mentioned three Research Disclosures, and the related descriptions therein are shown in the following table.

| Kind of Additives | RD 17643 (Dec. 1978) | RD 18716 (Nov. 1979) | RD 307105 (Nov. 1989) |
|---|---|---|---|
| 1. Chemical Sensitizer | p. 23 | p. 648, right column | p. 866 |
| 2. Sensitivity Enhancer | | p. 648, right column | |
| 3. Spectral Sensitizer Super-Sensitizer | pp. 23 to 24 | p. 648, right column to p. 649, right column | pp. 866 to 868 |
| 4. Whitening Agent | p. 24 | p. 647, right column | p. 868 |
| 5. Anti-foggant Stabilizer | pp. 24 to 25 | p. 649, right column | pp. 868 to 870 |
| 6. Light-Absorbent Filter Dye Ultraviolet Absorbent | pp. 25 to 26 | p. 649, right column to p. 650, left column | p. 873 |
| 7. Stain Inhibitor | p. 25, right column | p. 650, left to right column | p. 872 |
| 8. Color Image Stabilizer | p. 25 | p. 650, left column | p. 872 |
| 9. Hardening Agent | p. 26 | p. 651, left column | pp. 874 to 875 |
| 10. Binder | p. 26 | p. 651, left column | pp. 873 to 874 |
| 11. Plasticizer Lubricant | p. 27 | p. 650, right column | p. 876 |
| 12. Coating Aid Surfactant | pp. 26 to 27 | p. 650, right column | pp. 875 to 876 |
| 13. Antistatic Agent | p. 27 | p. 650, right column | pp. 876 to 877 |
| 14. Mat Agent | | | pp. 878 to 879 |

In order to prevent deterioration of the photographic property of the photographic material of the invention by formaldehyde gas as imparted thereto, compounds capable of reacting with formaldehyde so as to solidify it, for example, those described in U.S. Pat. Nos. 4,411,987 and 4,435,503, are preferably incorporated into the material.

The photographic material of the present invention is desired to contain a mercapto compound as described in U.S. Pat. Nos. 4,740,454 and 4,788,132 and JP-A-62-18539 and 1-283551.

The material is also desired to contain a compound capable of releasing a foggant, a development accelerator, a silver halide solvent or a precursor thereof irrespective of the amount of the developed silver as formed by development, as described in JP-A-1-106052.

The material is also desired to contain a dye dispersion as dispersed by the method described in International Patent Laid-Open Application No. WO88/04794 and Japanese Patent Kohyo Koho Hei-1-502912 or a dye described in European Patent 317,308A, U.S. Pat. No. 4,420,555 and JP-A-1-259358.

Various color couplers can be incorporated into the photographic material of the present invention, and examples of usable color couplers are described in patent publications as referred to in the above-mentioned RD No. 17643, VII-C to G and RD No. 307105, VII-C to G.

As yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred, in addition to the yellow couplers of formula (I) of the present invention.

As magenta couplers, 5-pyrazolone compounds and pyrazoloazole compounds are preferred. For instance, those described in U.S. Pat. Nos. 4,310,619, 4,351,897, European Patent 73,636, U.S.Pat. Nos. 3,061,432, 3,725,045, RD No. 24220 (June, 1984), JP-A-60-33552, RD No. 24230 (June, 1984), JP-A-60-43659, 61-72238, 60-35730, 55-118034, 60-185951, U.S. Pat. Nos. 4,500,630, 4,540,654, 4,556,630, and WO(PCT)88/04795 are preferred.

As cyan couplers, phenol couplers and naphthol couplers are preferred. For instance, those described in U.S. Pat. Nos. 4,052,212, 4,146,396, 4,228,122, 4,296,200, 2,369,929, 2,801,171, 2,771,162, 2,895,816, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199, and JP-A-61-42658 are preferred. In addition, pyrazoloazole couplers described in JP-A-64-553, 64-554, 64-555 and 64-556, as well as imidazole couplers as described in U.S. Pat. No. 4,818,672 may also be used.

Polymerized dye-forming couplers may also be used, and typical examples of such couplers are described in U.S. Pat. Nos. 3,451,820, 4,080,211,. 4,367,282, 4,409,320, 4,576,910, British Patent 2,102,137, and European Patent 341,184A.

Couplers capable of forming colored dyes having a pertinent diffusibility may also be used, and those described in U.S. Pat. No. 4,366,237, British Patent 2,125,570, European Patent 96,570, and West German Patent OLS No. 3,234,533 are preferred.

As colored couplers for correcting the unnecessary absorption of colored dyes, those described in RD No. 17643, VII-G, RD No. 307105, VII-D, U.S. Pat. No. 4,163,670, JP-B-57-39413, U.S. Pat. Nos. 4,004,929, 4,138,258, and British Patent 1,146,368 are preferred. Additionally, couplers for correcting the unnecessary absorption of the colored dyed by the phosphor dye to be released during coupling, as described in U.S. Pat. No. 4,774,181, as well as couplers having a dye precursor group capable of reacting with a developing agent to form a dyes, as split-off groups, as described in U.S. Pat. No. 4,777,120 are also preferably used.

Couplers capable of releasing a photographically useful residue along with coupling may also be used in the present invention. For instance, as DIR couplers capable of releasing a development inhibitor, those described in the patent publications as referred to in the above-mentioned RD No. 17643, Item VII-F and RD No. 307105, VII-F, as well as those described in JP-A-57-151944, 57-154234, 60-184248, 63-37346 and 63-37350 and U.S. Pat. Nos. 4,248,962 and 4,782,012 are preferred.

As couplers capable of imagewise releasing a nucleating agent or development accelerator during development, those described in British Patents 2,097,140 and 2,131,188, and JP-A-59-157638 and 59-170840 are preferred. In addition, compounds capable of releasing a foggant, a development accelerator or a silver halide solvent by redox reaction of the material with the oxidation product of a developing agent, as described in JP-A-60-107029, 60-252340 and 1-44940, are also preferably used.

Additionally, as examples of compounds which may be incorporated into the photographic materials of the present invention, there are further mentioned competing couplers described in U.S. Pat. No. 4,130,427; polyvalent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and 62-24252; couplers capable of releasing a dye which recolors after being released from the coupler, as described in European Patents 173,302A and 313,308A; bleaching accelerator-releasing couplers as described in RD Nos. 11449 and 24241, and JP-A-61-201247; ligand-releasing couplers described in U.S. Pat. No. 4,553,477; leuco dye-releasing couplers described in JP-A-63-75747; and couplers capable of releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027.

As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy 5-tert octylaniline), hydrocarbons (e.g., paraffin, dodecylbenzene, diisopropylnaphthalene). As an auxiliary solvent, organic solvents having a boiling point of approximately from 30° to 160° C., preferably from 50° to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, West German Patent (OLS) Nos. 2,541,174 and 2,541,130.

The color photographic materials of the present invention preferably contain phenethyl alcohol as well as other various antiseptics or fungicides, for example, those described in JP-A-63-257747, 62-272248 and 1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 879.

It is desired that the total film thickness of all the hydrophilic colloid layers as provided on the surface of the support having emulsion layers is 28 microns or less, preferably 23 microns or less, more preferably 18 microns or less, especially preferably 16 microns or less, in the photographic material of the present invention. It is also desired that the photographic material of the invention has a film swelling rate (T ½) of 30 seconds or less, preferably 20 seconds or less. The film thickness as referred to herein is one as measured under controlled conditions at a temperature of 25° C. and a relative humidity of 55% (for 2 days); and the film swelling rate as referred to herein may be measured by any means known in this technical field. For instance, it may be measured by the use of a swellometer of the model as described in A. Green et al., Photographic Science Engineering, Vol. 19, No. 2, pages 124 to 129. The film swelling rate (T ½) is defined as follows: 90% of the maximum swollen thickness of the photographic material as processed in a color developer under the conditions of 30° C. and 3 minutes and 15 seconds is called a saturated swollen thickness. The time necessary for attaining a half (½) of the saturated swollen thickness is defined to be a film swelling rate (T ½).

The film swelling rate (T ½) can be adjusted by adding a hardening agent to the gelatin of a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness − original film thickness)/(original film thickness).

It is desired that the photographic material of the present invention has a hydrophilic colloid layer (backing layer) having a total dry thickness of from 2 microns to 20 microns, on the surface opposite to the surface as coated with emulsion layers. The backing layer is desired to contain the above-mentioned light-absorbent, filter dye, ultraviolet absorbent, antistatic agent, hardening agent, binder, plasticizer, lubricant, coating aid, surfactant, etc. The backing layer is desired to have a swelling degree of from 150 to 500%.

The color photographic material of the present invention can be developed by any ordinary method, for example, in accordance with the process described in the above-mentioned RD No. 17643, pages 28 and 29, RD No. 8716, page 615, from left column to right column, and RD No. 307105, pages 880 and 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfoneamidoethylaniline, 3-methyl-4-amino-N-ethyl-N-β-methoxyethylaniline, as well as sulfates, hydrochlorides and p-toluenesulfonates of the compounds. Above all, 3-methyl-4-amino-N-ethyl-N-β-hydroxyethylaniline sulfate is especially preferred. These compounds can be used in combination of two or more of them, in accordance with the desired object.

The color developer generally contains a pH buffer such as alkali metal carbonates, borates or phosphates, and a development inhibitor or anti-foggant such as bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediamine-tetraacetic acid, nitrilo-triacetic acid, diethylenetriamine-pentaacetic acid, cyclohexanediamine-tetraacetic acid, hydroxylethylimino-diacetic acid, 1-hydroxyethylidene- 1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and their salts.

Where the photographic material is processed for reversal development in general, it is first subjected to black-and-white development and then subjected to color development. For the first black-and-white development is used a black-and-white developer, which contains a conventional black-and-white developing agent, for example, dihydroxybenzenes such as hydroquinone, 3-pyraozlidones such as 1-phenyl-3-pyraozlidone, or aminophenols such as N-methyl-p-aminophenol, singly or in combination.

The color developer and the black-and-white developer generally has a pH value of from 9 to 12. The amount of the replenisher to the developer is, though depending upon the color photographic material to be processed, generally 3 liters or less per $m^2$ of the material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

Opening Ratio = (Contact Surface Area ($cm^2$) of Processing Solution with Air)/(Volume ($cm^3$) of Processing Tank)

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing method described in JP-A-63-216050. Reduction of the opening ratio is preferably applied not only to both steps of color development and black-and-white development but also to all of the subsequent steps such as bleaching, bleach-fixation, fixation, rinsing and stabilization steps. In addition, the amount of the replenisher to be added may also be reduced by means of suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the processing solution.

After color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of continuous two tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with amino-polycarboxylic acids such as ethylenediaminetetraacetic acid, diethylenetriaminepentaacetic acid, cyclohexanediamine-tetraacetic acid, methyliminodiacetic acid, 1,3-diaminopropanetetraacetic acid or glycol ether-diamine-tetraacetic acid or with organic acids such as citric acid, tartaric acid or malic acid. Among them, aminopolycarboxylato/iron(III) complexes such as ethylenediaminetetraacetato/iron(III) complex and 1,3-diaminopropanetetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8.0, but the solution may have a lower pH value for rapid processing.

The bleaching solution, the bleach-fixing solution and the previous bath may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, German Patents 1,290,812 and 2,059,988, JP-A-53-32736, 53-57831, 53-37418, 53-72623, 53-95630, 53-95631, 53 -104232, 53-124424, 53-141623 and 53-28426, RD No. 17129 (July, 1978); thiazolidine derivatives as described in JP-A-50-140129; thiourea derivatives as described in JP-B-45-8506, JP-A-52-20832 and 53-32735 and U.S. Pat. No. 3,706,561; iodide salts as described in German Patent 1,127,715 and JP-A-58-16235; polyoxyethylene compounds as described in German Patents 966,410 and 2,748,430; polyamine compounds as described in JP-B-45-8836; other compounds as described in JP-A-49-40943, 49-59644, 53-94927, 54-35727, 55-26506 and 58-163940; and bromide ions. Above all, mercapto group- or disulfide group-containing compounds, in particular, those as described in U.S. Pat. No. 3,893,858, German Patent 1,290,812 and JP-A-53-95630 are preferred, as having a large accelerating effect. In addition, compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material of the invention, usable are thiosulfates, thiocyanates, thioether compounds, thioureas, and a large amount of iodide salts. Use of thiosulfates is general for the purpose. Above all, ammonium thiosulfate is most widely used. Additionally, a combination of thiosulfates and thiocyanates, thioether compounds or thioureas is also preferred. As the preservative to be used in the fixing solution or bleach-fixing solution, preferred are sulfites, bisulfites and carbonyl bisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

In the present invention, the fixing solution or bleach-fixing solution preferably contains compounds having a pKa value of from 6.0 to 9.0, preferably imidazoles such as unsubstituted imidazole, 1-methylimidazole, 1-ethylimidazole or 2-methylimidazole, in an amount of from 0.1 to 10 mol/liter, for the purpose of adjusting the pH value of the solution.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and the generation of stains in the processed material may effectively be prevented.

In the desilvering process, it is desired that stirring of the processing solution during the process is promoted as much as possible. As examples of reinforced stirring means for forcedly stirring the photographic material during the desilvering step, there are mentioned a method of running a jet stream of the processing solution to the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective for any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the material would be elevated. The above-mentioned reinforced stirring means is more effective, when a bleaching accelerator is incorporated into the processing solution. Because of the means, therefore, the bleaching accelerating effect could be remarkably augmented, and the fixation preventing effect by the bleaching accelerator could be evaded.

The photographic material of the present invention can be processed with an automatic developing machine. It is desired that the automatic developing machine to be used for processing the material of the present invention is equipped with a photographic material-conveying means as described in JP-A-60-191257, 60-191258 and 60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of these reasons, the conveying means is especially effective for shortening the processing time in each processing step and for reducing the amount of the replenisher to each processing bath.

The silver halide color photographic material of the present invention is generally rinsed in water and/or stabilized, after being desilvered. The amount of the water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), the replenishment system of normal current or countercurrent and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. In the practice of processing the photographic material of the present invention, the method of reducing calcium and magnesium ions, which is described in JP-A-62-288838, can be extremely effectively used for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms,* edited by Association of Sanitary Technique, Japan (1982, by Kogyo Gijutsukai, Japan), and *Encyclopeadia of Bactericidal and Fungicidal Agents,* edited by Nippon Bactericide and Fungicide Association, Japan (1986), can also be used.

The pH value of the rinsing water to be used for processing the photographic material of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A-57-8543, 58-14834 and 60-220345, can be employed.

In addition, the material can also be stabilized, following the rinsing step. As one example of this case, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylenetetramine and aldehyde-sulfite adducts.

The stabilizing bath may also contain various chelating agents and fungicides.

The overflow from the rinsing and/or stabilizing solutions because of addition of replenishers thereto may be re-used in the other steps such as the previous desilvering step.

Where the photographic material of the present invention is processed with an automatic developing machine system and the processing solutions as being used in the step are evaporated and thickened, it is desired to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A-53-135628, as the precursors.

The silver halide color photographic material of the present invention can contain various kinds of 1-phenyl-3-pyrazolidones, if desired, for the purpose of accelerating the color developability thereof. Specific examples of these compounds are described in JP-A-56-4339, 57-144547 and 58-115438.

The processing solutions for the photographic material of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solution used.

The present invention is also applicable to heat-developing photographic materials as described in U.S. Pat. No. 4,500,626, JP-A-60-133449, 59-218443 and 61-238056 and European Patent 210,660A2.

Since the silver halide color photographic material of the present invention contains a novel yellow coupler which has a high dye-forming speed and which may give a dye having a high color density and a high color fastness, it has a high sensitivity a high color reproducibility and may form a color image having a high sharpness and a high color fastness.

Next, the present invention will be explained in more detail by way of the following examples, which, however, are not intended to restrict the scope of the present invention.

EXAMPLE 1

Preparation of Sample No. 101

Two layers each having the composition mentioned below were formed on a triacetyl cellulose film support previously having a subbing layer thereon, to prepare a photographic material sample (Sample No. 101).

| | |
|---|---|
| (1) Emulsion Layer: | |
| Emulsion of tabular grains (silver iodide content 8 mol %; mean aspect ratio 7.5; mean grain size 0.85 μm) | 0.84 g/m$^2$ as Ag |
| Coupler (1) of the invention | 0.95 g/m$^2$ |
| Tricresyl Phosphate | 1.00 g/m$^2$ |
| Gelatin | 3.50 g/m$^2$ |
| (2) Protective Layer: | |
| Sodium 2,4-Dichloro-6-hydroxy-s-triazine | 0.15 g/m$^2$ |
| Gelatin | 2.0 g/m$^2$ |

Preparation of Samples Nos. 102 to 112

Other Samples Nos. 102 to 112 were prepared in the same manner as in preparation of Sample No. 101 above, except that Coupler (1) was replaced by the same molar amount of the coupler as indicated in Table 1 below. The thus prepared samples were imagewise exposed with a white light and then processed by color development of the procedure mentioned below. The density of each of the thus processed samples was measured, and values of gamma, relative sensitivity and maximum color density were obtained therefrom. Next, the processed samples were stored at a temperature of 60° C. and a relative humidity of 70% for 3 days, and the density of each of the thus stored (aged}samples was measured, whereupon the decrease of the density at the part having an initial yellow density of 1.0 was obtained.

| Color Development Process | | |
|---|---|---|
| Steps | Time | Temperature |
| Color Development | 3 min 15 sec | 38° C. |
| Bleaching | 1 min 00 sec | 38° C. |
| Bleach-fixation | 3 min 15 sec | 38° C. |
| Rinsing (1) | 40 sec | 35° C. |
| Rinsing (2) | 1 min 00 sec | 35° C. |
| Stabilization | 40 sec | 38° C. |
| Drying | 1 min 15 sec | 55° C. |

Next, compositions of the processing solutions as used in the above-mentioned steps are mentioned below.

| | |
|---|---|
| Color Developer: | |
| Diethylenetriamine-pentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-ethyl-N-β-hydroxyethylamino)-2-methylaniline Sulfate | 4.5 g |
| Water to make | 1.0 liter |
| pH | 10.05 |
| Bleaching Solution: | |
| Ethylenediaminetetraacetic Acid Ferric Ammonium Salt Dihydrate | 120.0 g |
| Disodium Ethylenediaminetetra-acetate | 10.0 g |
| Ammonium Bromide | 100.0 g |
| Ammonium Nitrate | 10.0 g |

-continued

| | |
|---|---|
| Bleaching Accelerator | 0.005 mol |

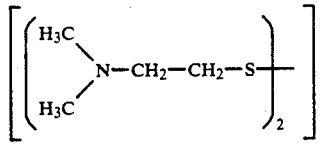

.2HCl

| | |
|---|---|
| Aqueous Ammonia (27 wt %) | 15.0 ml |
| Water to make | 1.0 liter |
| pH | 6.3 |
| Bleach-fixing Solution: | |
| Ethylenediaminetetraacetic Acid Ferric Ammonium Salt Dihydrate | 50.0 g |
| Disodium Ethylenediaminetetra-acetate | 5.0 g |
| Sodium Sulfite | 12.0 g |
| Ammonium Thiosulfate (70 wt/vol. % aqueous solution) | 240.0 ml |
| Aqueous Ammonia (27 wt %) | 6.0 ml |
| Water to make | 1.0 liter |
| pH | 7.2 |

Rinsing Solution

City water was passed through a mixed bed type column as filled with an H-type strong acidic cation-exchange resin (Amberlite IR-120B, produced by Rhom & Haas Co.) and an OH-type strong basic anion-exchange resin (Amberlite IRA-400, produced by Rhom & Haas Co.) so that both the calcium ion concentration and the magnesium ion concentration in the water were reduced to 3 mg/liter, individually. Next, 20 mg/liter of sodium dichloroisocyanurate and 0.15 g/liter of sodium sulfate were added to the resulting water, which had a pH value falling within the range of from 6.5 to 7.5. This was used as the rinsing water.

| Stabilizing Solution: | |
|---|---|
| Formalin (37 wt %) | 2.0 ml |
| Polyoxyethylene-p-monononylphenyl Ether (mean polymerization degree 10) | 0.3 g |
| Disodium Ethylenediaminetetraacetate | 0.05 g |
| Water to make | 1.0 liter |
| pH | 5.0 to 8.0 |

TABLE 1

| Sample | Coupler | Gamma Value (1) | Relative Sensi-tivity (2) | Maximum Color Density | Color Image Fastness |
|---|---|---|---|---|---|
| 101 (sample of the invention) | (1) | 1.35 | 0.00 | 2.22 | 1.00 |
| 102 (sample of the invention) | (6) | 1.33 | −0.01 | 2.17 | 0.99 |
| 103 (sample of the invention) | (7) | 1.32 | −0.02 | 2.15 | 1.00 |
| 104 (sample of the invention) | (29) | 1.32 | −0.01 | 2.16 | 0.99 |
| 105 (sample of the invention) | (34) | 1.33 | 0.00 | 2.19 | 0.99 |
| 106 (sample of the invention) | (36) | 1.30 | −0.02 | 2.14 | 0.98 |
| 107 (sample of the invention) | (41) | 1.34 | 0.00 | 2.12 | 0.98 |
| 108 | (82) | 1.30 | −0.02 | 2.09 | 0.99 |

TABLE 1-continued

| Sample | Coupler | Gamma Value (1) | Relative Sensitivity (2) | Maximum Color Density | Color Image Fastness |
|---|---|---|---|---|---|
| (sample of the invention) | | | | | |
| 109 (comparative sample) | RC-1 | 1.11 | −0.06 | 1.83 | 0.98 |
| 110 (comparative sample) | RC-2 | 1.29 | −0.03 | 2.05 | 0.67 |
| 111 (comparative sample) | RC-3 | 0.87 | −0.12 | 1.72 | 0.94 |
| 112 (comparative sample) | RC-4 | 0.72 | −0.17 | 1.57 | 0.90 |

Notes:
(1) Inclination of a straight line formed by connecting a point giving a yellow density (fog + 0.2) and a point giving a yellow density (fog + 0.7).
(2) (Relative value to the sensitivity of Sample No. 101 of being 0, as a logarithmic number of a reciprocal of an exposure amount giving a yellow density (fog + 0.2).

From the results of Table 1 above, it is noted that the comparative Samples Nos. 109, 111 and 112 had a low gamma value, a low relative sensitivity and a low maximum color density, that the comparative Sample No. had a low color image fastness, and that all the samples of the present invention (Samples Nos. 101 to had a high color forming capacity and gave a color image with a high color fastness.

Comparative couplers used herein are as follows:

RC-1 (Coupler (12) described in JP-A-1-233452)

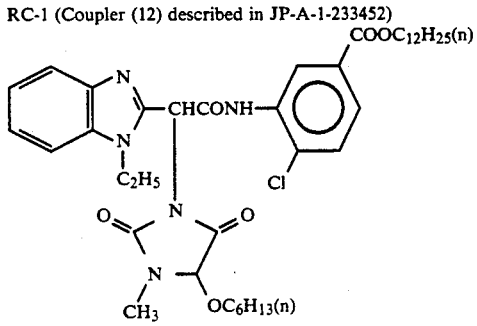

RC-2 (Coupler (9) described in JP-A-1-233452)

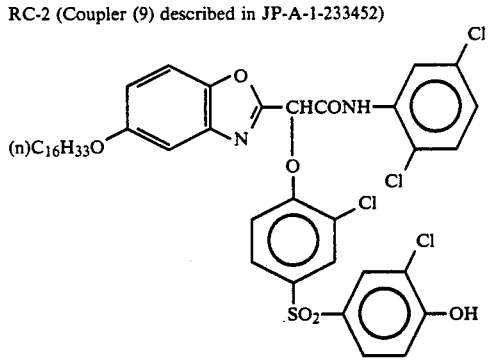

RC-3 (coupler similar to Coupler (3) described in JP-A-52-82423)

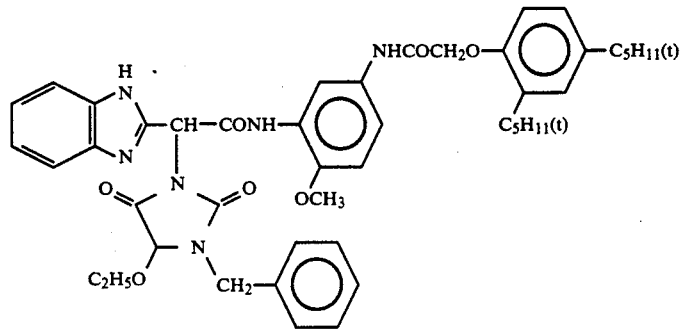

-continued

RC-4 (coupler similar to Coupler (13) described in JP-A-51-104825)

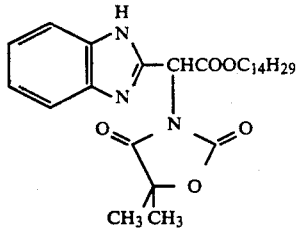

EXAMPLE 2

Preparation of Sample No. 201

Plural layers mentioned below were formed on a cellulose triacetate film support having a subbing layer, to form a multi-layer color photographic material sample (Sample No. 201).

Compositions of Light-Sensitive Layers

The numbers corresponding to the respective components mentioned below indicate the amounts coated, which were represented by the unit of g/m$^2$. For silver halides and colloidal silvers, the number indicates the amount of silver therein. For couplers, additives and gelatin, the number indicates the amount thereof as coated. For sensitizing dyes, the amount coated is represented by the unit of mols per mol of the silver halide in the same layer.

| | |
|---|---|
| **First Layer (Anti-Halation Layer):** | |
| Black Colloidal Silver | 0.15 |
| Gelatin | 1.90 |
| ExM-8 | $2.0 \times 10^{-2}$ |
| **Second Layer (Interlayer):** | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| **Third Layer (Low-Sensitivity Red-Sensitive Emulsion Layer):** | |
| Silver Iodobromide Emulsion (AgI 2 mol %; AgI-rich core-type grains; sphere-corresponding diameter 0.3 μm; fluctuation coefficient of sphere-corresponding diameter 29%; mixture of normal crystal grains and twinned crystal grains having an aspect ratio of diameter/thickness of being 2.5) | 0.50 as Ag |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.22 |
| ExC-4 | $3.0 \times 10^{-2}$ |
| Solv-1 | $7.0 \times 10^{-3}$ |
| **Fourth Layer (Middle-Sensitivity Red-Sensitive Emulsion Layer):** | |
| Silver Iodobromide Emulsion (AgI 4 mol %; AgI-rich core-type grains; sphere-corresponding diameter 0.55 μm; fluctuation coefficient of sphere-corresponding diameter 20%; mixture of normal crystal grains and twinned crystal grains having an aspect ratio of diameter/thickness of being 1.0) | 0.85 as Ag |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |

-continued

| | |
|---|---|
| ExC-2 | $8.0 \times 10^{-2}$ |
| ExC-3 | 0.33 |
| ExY-14 | $1.0 \times 10^{-2}$ |
| Cpd-10 | $1.0 \times 10^{-4}$ |
| Solv-1 | 0.10 |
| **Fifth Layer (High-Sensitivity Red-Sensitive Emulsion Layer):** | |
| Silver Iodobromide Emulsion (AgI 10 mol %; AgI-rich core-type grains; sphere-corresponding diameter 0.7 μm; fluctuation coefficient of sphere-corresponding diameter 30%; mixture of normal crystal grains and twinned crystal grains having an aspect ratio of diameter/thickness of being 2.0) | 0.70 as Ag |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| Solv-1 | 0.15 |
| Solv-2 | $8.0 \times 10^{-2}$ |
| **Sixth Layer (InterLayer):** | |
| Gelatin | 1.10 |
| P-2 | 0.17 |
| Cpd-1 | 0.10 |
| Cpd-4 | 0.17 |
| Solv-1 | $5.0 \times 10^{-2}$ |
| **Seventh Layer (Low-Sensitivity Green-Sensitive Emulsion Layer):** | |
| Silver Iodobromide Emulsion (AgI 2 mol %; AgI-rich core-type grains; sphere-corresponding diameter 0.3 μm; fluctuation coefficient of sphere-corresponding diameter 28%; mixture of normal crystal grains and twinned crystal grains having an aspect ratio of diameter/thickness of being 2.5) | 0.30 as Ag |
| Gelatin | 0.50 |
| ExS-4 | $5.0 \times 10^{-4}$ |
| ExS-5 | $2.0 \times 10^{-5}$ |
| ExS-6 | $0.3 \times 10^{-4}$ |
| ExM-8 | $3.0 \times 10^{-2}$ |
| ExM-9 | 0.20 |
| ExY-13 | $3.0 \times 10^{-2}$ |
| Cpd-11 | $7.0 \times 10^{-3}$ |
| Solv-1 | 0.20 |
| **Eight Layer (Middle-Sensitivity Green-Sensitive Emulsion Layer):** | |
| Silver Iodobromide Emulsion (AgI 4 mol %; AgI-rich core-type grains; sphere-corresponding diameter 0.55 μm; fluctuation coefficient of sphere-corresponding diameter 20%; mixture of normal crystal grains and twinned crystal grains having an aspect ratio of diameter/thickness of being 4.0) | 0.70 as Ag |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-8 | $1.0 \times 10^{-2}$ |
| ExM-9 | 0.25 |
| ExM-10 | $0.5 \times 10^{-2}$ |

-continued

| | |
|---|---|
| ExY-13 | $4.0 \times 10^{-2}$ |
| Cpd-11 | $9.0 \times 10^{-3}$ |
| Solv-1 | 0.20 |
| Ninth Layer (High-Sensitivity Green-Sensitive Emulsion Layer): | |
| Silver Iodobromide Emulsion (AgI 10 mol %; AgI-rich core-type grains; sphere-corresponding diameter 0.7 μm; fluctuation coefficient of sphere-corresponding diameter 30%; mixture of normal crystal grains and twinned crystal grains having an aspect ratio of diameter/thickness of being 2.0) | 0.50 as Ag |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExM-7 | $3.0 \times 10^{-4}$ |
| ExM-8 | $2.0 \times 10^{-2}$ |
| ExM-11 | $6.0 \times 10^{-2}$ |
| ExM-12 | $2.0 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| Tenth Layer (Yellow Filter Layer): | |
| Gelatin | 0.90 |
| Yellow Colloidal Silver | $5.0 \times 10^{-2}$ as Ag |
| Cpd-1 | 0.20 |
| Solv-1 | 0.15 |
| Eleventh Layer (Low-Sensitivity Blue-Sensitive Emulsion Layer): | |
| Silver Iodobromide Emulsion (AgI 4 mol %; AgI-rich core-type grains; sphere-corresponding diameter 0.5 μm; fluctuation coefficient of sphere-corresponding diameter 15%; octahedral grains) | 0.40 as Ag |
| Gelatin | 1.00 |
| ExS-8 | $2.0 \times 10^{-4}$ |
| ExY-13 | $9.0 \times 10^{-2}$ |
| ExY-15 | 0.90 |
| Cpd-2 | $1.0 \times 10^{-2}$ |
| Solv-1 | 0.30 |
| Twelfth Layer (High-Sensitivity Blue-Sensitive Emulsion Layer): | |
| Silver Iodobromide Emulsion (AgI 10 mol %; AgI-rich core-type grains; sphere-corresponding diameter 1.3 μm; fluctuation coefficient of sphere-corresponding diameter 25%; mixture of normal crystal grains and twinned crystal grains having an aspect ratio of diameter/thickness of being 4.5) | 0.50 as Ag |
| Gelatin | 0.60 |
| ExS-8 | $1.0 \times 10^{-4}$ |
| ExY-15 | 0.12 |
| Cpd-2 | $1.0 \times 10^{-3}$ |
| Solv-1 | $4.0 \times 10^{-2}$ |
| Thirteenth Layer (First Protective Layer): | |
| Fine Silver Iodobromide Grain (AgI 1 mol %; mean grain size 0.07 μm) | 0.20 |
| Gelatin | 0.80 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| Fourteenth Layer (Second Protective Layer): | |
| Gelatin | 0.90 |
| B-1 (diameter 1.5 μm) | 0.10 |
| B-2 (diameter 1.5 μm) | 0.10 |
| B-3 | $2.0 \times 10^{-2}$ |
| H-1 | 0.40 |

Further, (Cpd-3), (Cpd-5), (Cpd-6), (Cpd-7), (Cpd-8), (P-1), (W-1), (W-2) and (W-3) mentioned below were added to the layers so as to improve the storage stability, processability, pressure-resistance, anti-fungal property, antibacterial property, antistatic property and coatability.

Additionally, n-butyl p-hydroxybenzoate was added to the layers. Further, the sample contained (B-4), (F 1), (F-4), (F-5), (F-6), (F-7), (F-8), (F-9), (F-10), (F-11), (F-13) and iron salt, lead salt, gold salt, platinum salt, iridium salt and rhodium salt.

Next, chemical names or structural formulae of the compounds used for preparing the same are mentioned below.

UV-1

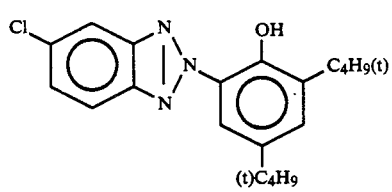

UV-2

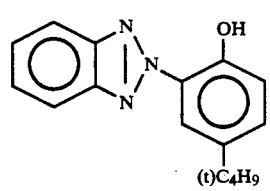

UV-3

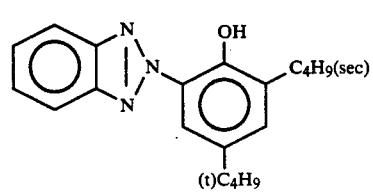

-continued
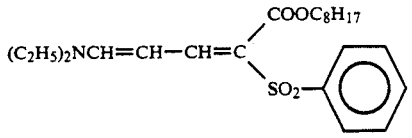
UV-4
Tricresyl Phosphate — Solv-1
Dibutyl Phphthalate — Solv-2
Tri(2-ethylhexyl) Phosphate — Solv-3
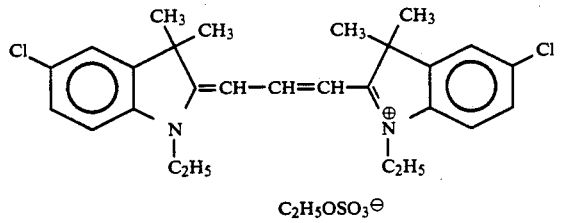
ExF-1
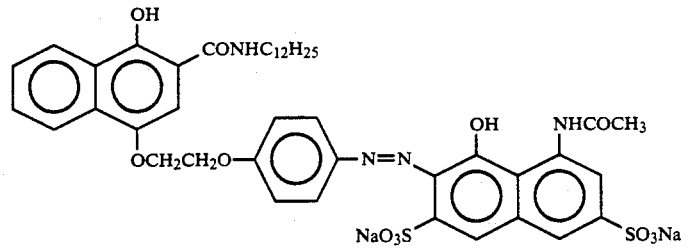
ExC-2
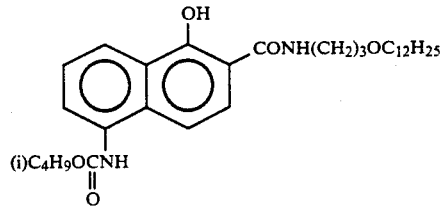
ExC-3
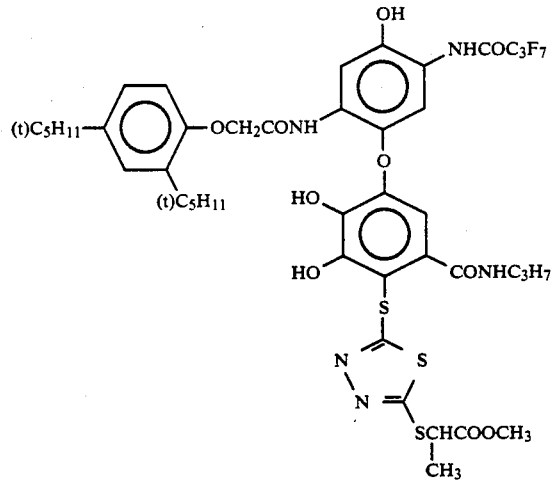
ExC-4
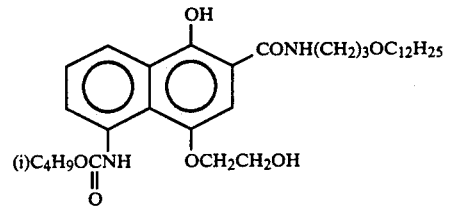
ExC-5

-continued
ExC-6
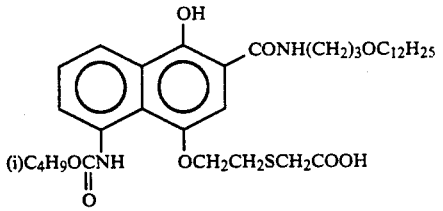
ExM-8
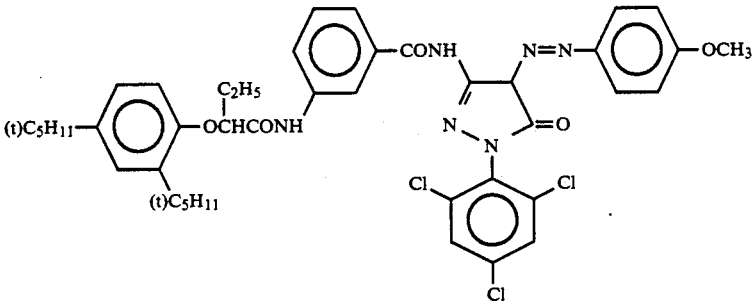
ExM-9
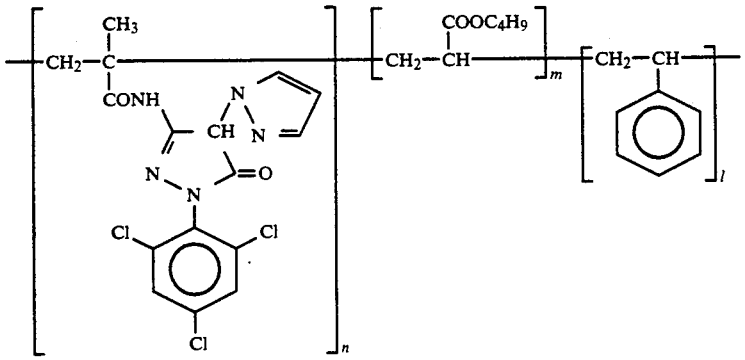
n/m/l = 50/25/25 (by weight) mean molecular weight = 20,000
ExM-10
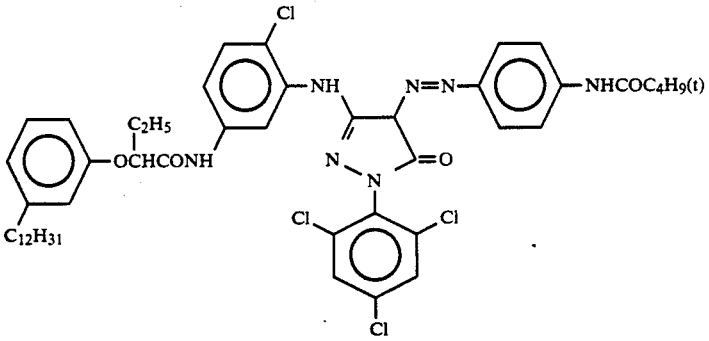
ExM-11
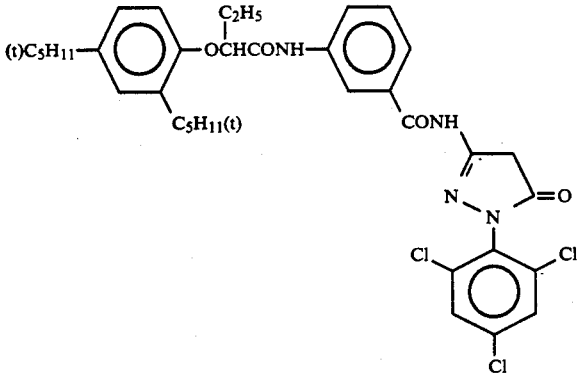

-continued
ExM-12
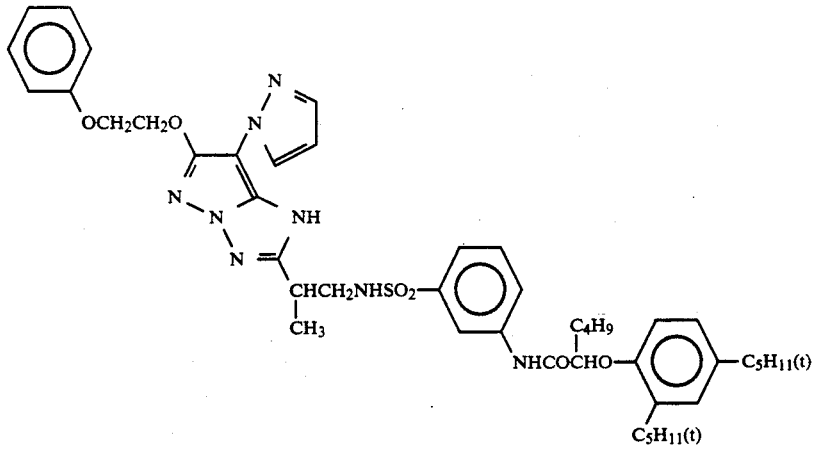
(conventional malonedianilide DIR coupler similar to Coupler (16) described in JP-A-57-151944)
ExY-3
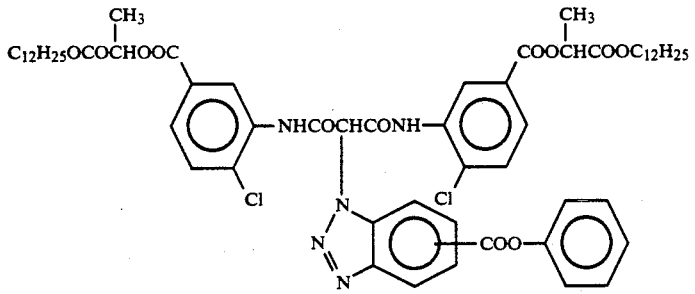
ExY-14
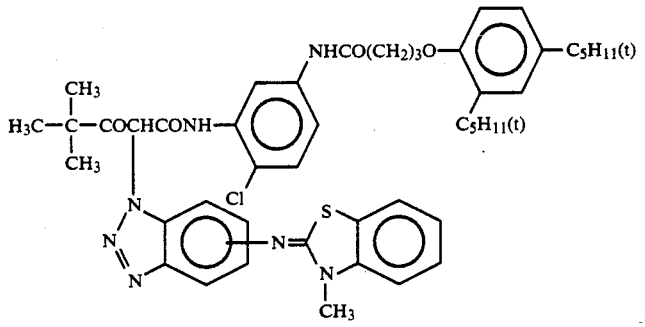
ExY-15
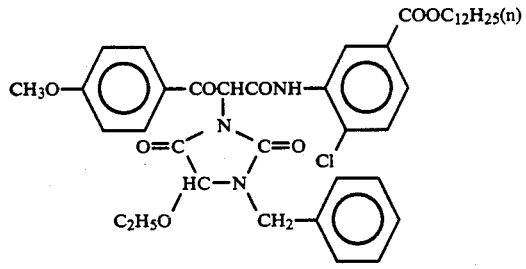
Cpd-1
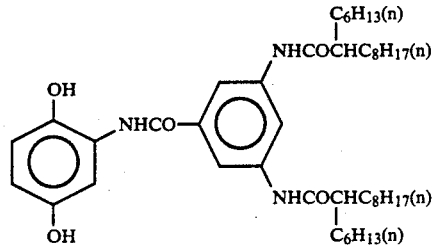

-continued
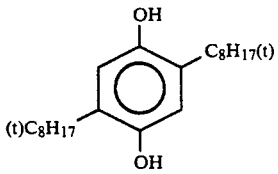
Cpd-2
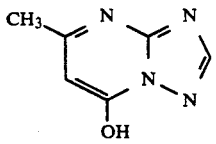
Cpd-3
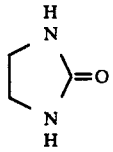
Cpd-4
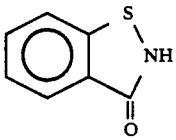
Cpd-5
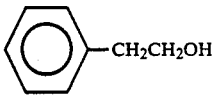
Cpd-6
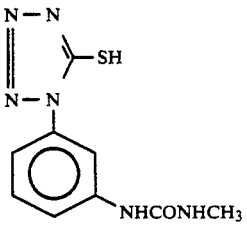
Cpd-7
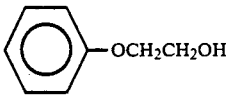
Cpd-8
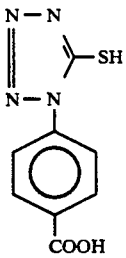
Cpd-9
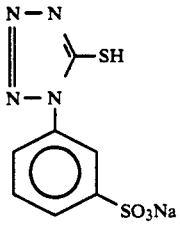
Cpd-10

-continued
Cpd-11
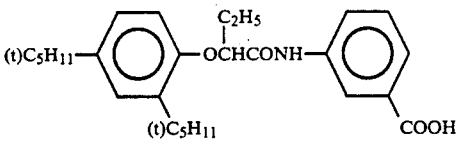
ExS-1
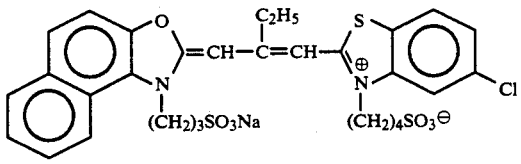
ExS-2
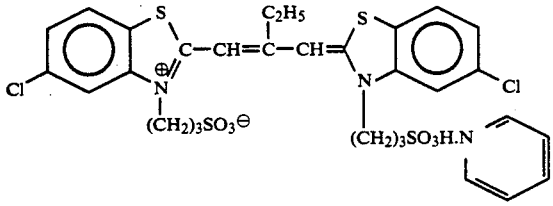
ExS-3
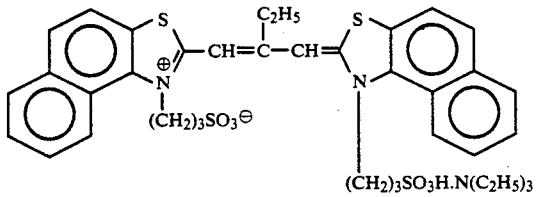
ExS-4
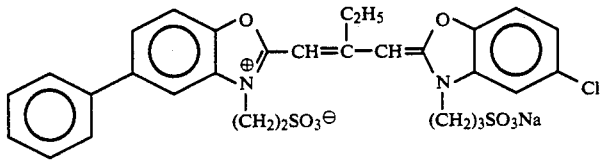
ExS-5
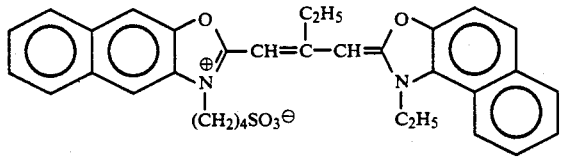
ExS-6
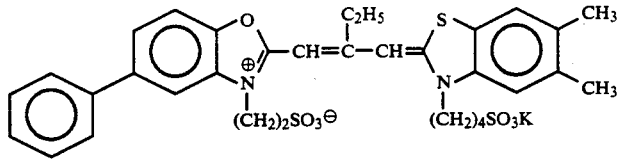
ExS-7
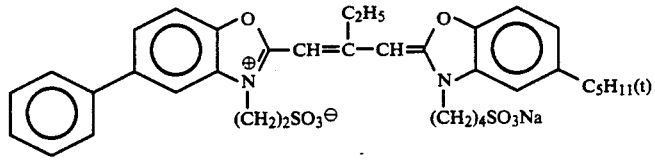
ExS-8
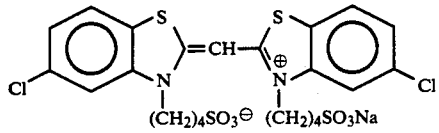

-continued
B-4
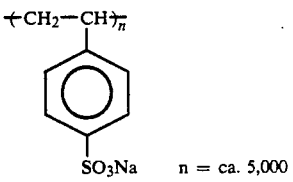
n = ca. 5,000
H-1
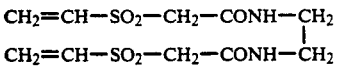
W-1
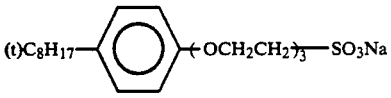
W-2
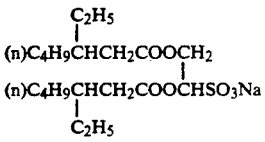
W-3
$C_8F_{17}SO_2N(C_3H_7)CH_2COOK$
P-1
Vinyl Pyrrolidone/Vinyl Alcohol (70/30, by weight) Copolymer
P-2
Polyethyl Acrylate
F-1
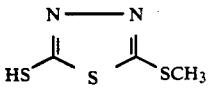
F-4
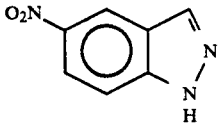
F-5
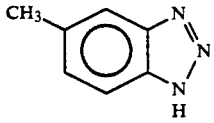
F-6
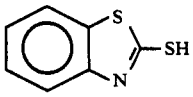
F-7
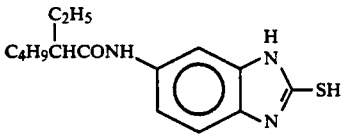
F-8
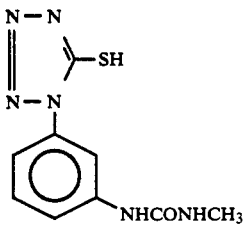
F-9
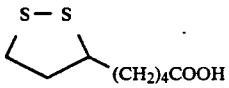

-continued

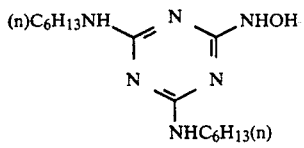

F-10

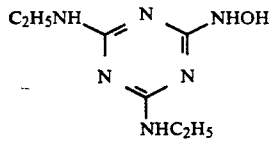

F-11

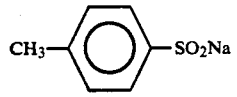

F-13

Preparation of Samples Nos. 202 to 213

Samples Nos. 202 to 213 were prepared in the same manner as in preparation of Sample No. 201, except that ExY-13 in the seventh layer, the eighth layer and the ninth layer was replaced by the coupler as indicated in Table 2 below. The amount of the coupler of the three layers was so adjusted that the imagewise exposed with a white light and then color-developed each sample may have the same sensitivity as the amount of the exposure giving a magenta density of (fog+0.2), and it was represented in Table 2 as a relative molar ratio to the amount of ExY-13 being 1.

These samples were imagewise exposed with a green light and then uniformly exposed with a blue light. The amount of the latter blue-exposure was such that the yellow density of the magenta-fogged region of Sample No. 201 is to be 1.50 by development mentioned below. A value as obtained by subtracting the yellow density in the magenta-fogged density from the yellow density in the magenta density (fog+1.0) is shown in Table 2 as a degree of color turbidity.

Additionally, the samples were imagewise exposed with a white light and then developed by the process mentioned below, and the density of the thus processed samples was measured. The processed samples were then stored under the condition having a temperature of 60° C. and a relative humidity of 70% for 14 days, and the density of the thus stored sample was again measured. The decrease of the density at the point having an initial yellow density of 2.0 is shown in Table 2.

Color Development Process

| Step | Time | Temp. | Amount of Keplen-isher | Tank Capacity |
|---|---|---|---|---|
| Color Development | 3 min 15 sec | 37.8° C. | 25 ml | 10 liters |
| Bleaching | 45 sec | 38.0° C. | 5 ml | 5 liters |
| Fixation (1) | 45 sec | 38.0° C. | — | 5 liters |
| Fixation (2) | 45 sec | 38.0° C. | 30 ml | 5 liters |
| Stabilization (1) | 20 sec | 38.0° C. | — | 5 liters |
| Stabilization (2) | 20 sec | 38° C. | — | 5 liters |
| Stabilization (3) | 20 sec | 38.0° C. | 40 ml | 5 liters |
| Drying | 1 min | 55.0° C. | | |

Amount of replenisher is per $m^2$ of 35 mm-wide sample.

Fixation was effected by countercurrent system from (2) to (1).

Stabilization was effected by countercurrent system from (3) to (1).

The amount of carryover of the developer to the bleaching step and that of carryover of the fixing solution to the stabilizing step were 2.5 ml and 2.0 ml, respectively, per meter of 35 mm-wide sample.

Compositions of the processing solutions used in the above-mentioned steps are mentioned below.

| | Mother Solution (g) | Replenisher (g) |
|---|---|---|
| Color Developer: | | |
| Diethylenetriamine-penta-acetic Acid | 5.0 | 6.0 |
| Sodium Sulfite | 4.0 | 5.0 |
| Potassium Carbonate | 30.0 | 37.0 |
| Potassium Bromide | 1.3 | 0.5 |
| Potassium Iodide | 1.2 mg | — |
| Hydroxylamine Sulfate | 2.0 | 3.6 |
| 4-(N-ethyl-N-β-hydroxyethyl-amino)-2-methylaniline Sulfate | 4.7 | 6.2 |
| Water to make | 1.0 liter | 1.0 liter |
| pH | 10.00 | 10.15 |
| Bleaching Solution: | | |
| 1,3-Diaminopropanetetra-acetic Acid Ferric Ammonium Salt Monohydrate | 144.0 | 206.0 |
| 1,3-Diaminopropanetetra-acetate Acid | 2.8 | 4.0 |
| Ammonium Bromide | 84.0 | 120.0 |

-continued

| | | |
|---|---|---|
| Ammonium Nitrate | 17.5 | 25.0 |
| Aqueous Ammonia (27 wt %) | 10.0 | 1.8 |
| Acetic Acid (98 wt %) | 51.1 | 73.0 |
| Water to make | 1.0 liter | 1.0 liter |
| pH | 4.3 | 3.4 |
| Fixing Solution: | | |
| Mother solution and replenisher were the same. | | |
| Disodium Ethylenediaminetetra-acetate | | 1.7 g |
| Sodium Sulfite | | 14.0 g |
| Sodium Bisulfite | | 10.0 g |
| Ammonium Thiosulfate (70 wt/vol. % aqueous solution) | | 210.0 ml |
| Ammonium Thiocyanate | | 163.0 g |
| Thiourea | | 1.8 g |
| Water to make | | 1.0 liter |
| pH | | 6.5 |
| Stabilizing Solution: | | |
| Mother solution and replenisher were the same. | | |
| Surfactant | | 0.5 g |

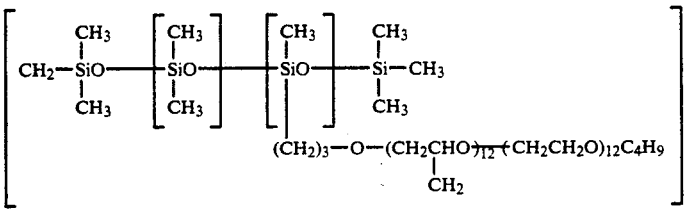

| | |
|---|---|
| Surfactant $[C_{10}H_{21}-O-(CH_2CH_2O)_{10}-H]$ | 0.4 g |
| Triethanolamine | 2.0 g |
| 1,2-Benzisothiazoline-3-one-methanol | 0.3 g |
| Formalin (37 wt %) | 1.5 g |
| Water to make | 1.0 liter |
| pH | 6.5 |

TABLE 2

| Sample | Coupler in 7th, 8th and 11th Layers Compound | Amount* | Degree of Color Turbidity | Color Image Storability (as decrease of Density) |
|---|---|---|---|---|
| (comparative Sample) | | | | |
| 201 | ExY-13 | 1.0 | −0.03 | 0.18 |
| 202 | RC-5 | 1.6 | +0.04 | 0.04 |
| 203 | RC-6 | 2.7 | +0.10 | 0.02 |
| 204 | RC-7 | 1.2 | +0.15 | 0.04 |
| 205 | RC-8 | 0.7 | +0.13 | 0.04 |
| 206 | RC-9 | 1.8 | +0.03 | 0.04 |
| 207 | RC-10 | 2.5 | +0.07 | 0.04 |
| (sample of the invention) | | | | |
| 208 | (13) | 1.3 | −0.02 | 0.03 |
| 209 | (16) | 1.1 | −0.03 | 0.03 |
| 210 | (19) | 1.1 | −0.03 | 0.03 |
| 211 | (50) | 0.9 | −0.04 | 0.03 |
| 212 | (51) | 0.9 | −0.04 | 0.03 |

TABLE 2-continued

| Sample | Coupler in 7th, 8th and 11th Layers Compound | Amount* | Degree of Color Turbidity | Color Image Storability (as decrease of Density) |
|---|---|---|---|---|
| 213 | (88) | 1.0 | −0.04 | 0.03 |

*The relative molar ratio to the amount of ExY-13 in Sample 201.

From the results of Table 2 above, it is noted that the samples of the present invention are superior to the comparative samples. Precisely, the comparative Sample No. 201 had a poor color image fastness, though the degree of color turbidity thereof was low. The comparative Samples Nos. 202 to 206 showed a high degree of color turbidity, though they had a fairly good color image fastness. As opposed to them, all of the samples of the present invention (Samples Nos. 208 to 213) had a good color image fastness and a low degree of color turbidity.

Comparative couplers used above are mentioned below.

RC-5: (Coupler (15) described in JP-A-57-151944)

-continued
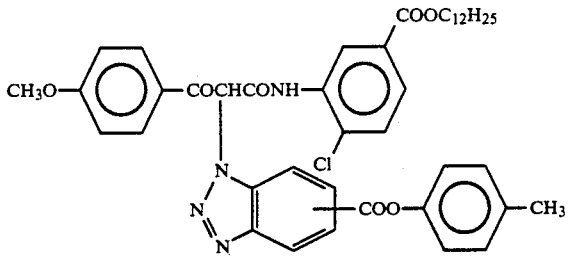
RC-6 (Coupler (43) described in JP-A-57-151944)
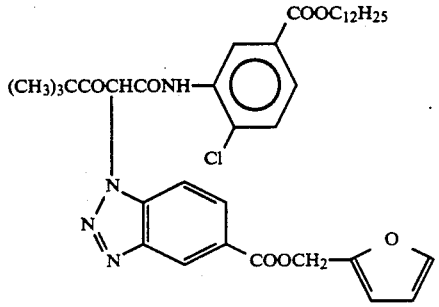
RC-7: (Coupler (13) described in JP-A-51-104825)
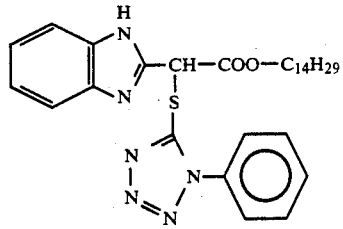
RC-8: (Coupler (3) described in JP-A-52-82423)
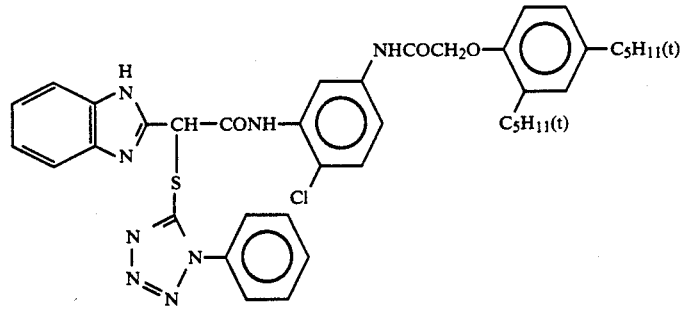
RC-9: (Coupler (1) described in JP-A-1-233451)
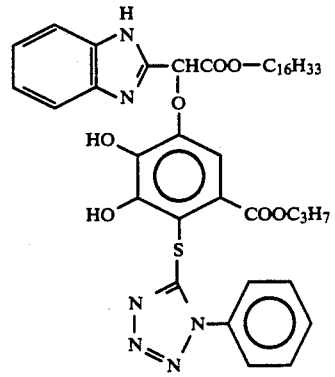
RC-10: (Coupler (3) described in JP-A-2-28645)

-continued

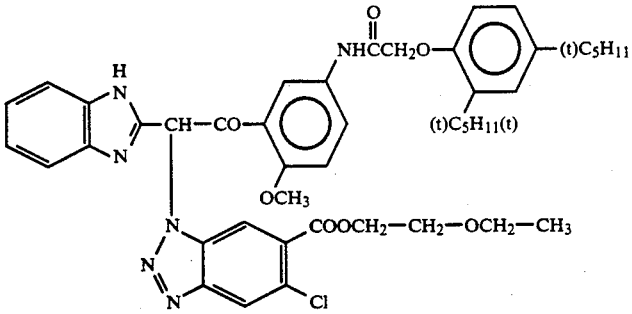

EXAMPLE 3

Preparation of Sample 301

Plural layers mentioned below were coated on a subbing layer-coated cellulose triacetate film support having a thickness of 127 microns to prepare a multilayer color photographic material sample (Sample 301). The amount of each component mentioned below is per $m^2$. The functions of the compounds added are not limited to only those mentioned below.

| | |
|---|---|
| First Layer: Anti-halation Layer | |
| Black Colloidal Silver | 0.25 g |
| Gelatin | 1.9 g |
| Ultraviolet Absorbent U-1 | 0.04 g |
| Ultraviolet Absorbent U-2 | 0.1 g |
| Ultraviolet Absorbent U-3 | 0.1 g |
| Ultraviolet Absorbent U-4 | 0.1 g |
| Ultraviolet Absorbent U-6 | 0.1 g |
| High Boiling Point Organic Solvent Oil-1 | 0.1 g |
| Second Layer: Interlayer | |
| Gelatin | 0.40 g |
| Compound Cpd-D | 10 mg |
| High Boiling Point Organic Solvent Oil-3 | 0.1 g |
| Dye D-4 | 0.4 mg |
| Third Layer: Interlayer | |
| Emulsion of Fine Silver Iodobromide Grains (both surfaces and insides fogged; mean grain size 0.06 micron; fluctuation coefficient 18%; AgI content 1 mol %) | 0.05 g as Ag |
| Gelatin | 0.4 g |
| Fourth Layer: Low-sensitivity Red-sensitive Emulsion Layer | |
| Emulsion A | 0.2 g as Ag |
| Emulsion B | 0.3 g as Ag |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High Boiling Point Organic Solvent Oil-2 | 0.1 g |
| Fifth Layer: Middle-sensitivity Red-sensitive Emulsion Layer | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High Boiling Point Organic Solvent Oil-2 | 0.1 g |
| Sixth Layer: High-sensitivity Red-sensitive Emulsion Layer | |
| Emulsion D | 0.4 g as Ag |
| Gelatin | 1.1 g |
| Coupler C-3 | 0.7 g |
| Coupler C-1 | 0.3 g |
| Additive P-1 | 0.1 g |
| Seventh Layer: Interlayer | |

-continued

| | |
|---|---|
| Gelatin | 0.6 g |
| Additive M-1 | 0.3 g |
| Color Mixing Preventing Agent Cpd-K | 2.6 mg |
| Ultraviolet Absorbent U-1 | 0.1 g |
| Ultraviolet Absorbent U-6 | 0.1 g |
| Dye D-1 | 0.02 g |
| Eighth Layer: Interlayer | |
| Emulsion of Fine Silver Iodobromide Grains (both surfaces and insides fogged; mean grain size 0.06 micron; fluctuation coefficient 16%; AgI content 0.3 mol %) | 0.02 g as Ag |
| Gelatin | 1.0 g |
| Additive P-1 | 0.2 g |
| Color Mixing Preventing Agent Cpd-J | 0.1 g |
| Color Mixing Preventing Agent Cpd-A | 0.1 g |
| Ninth Layer: Low-sensitivity Green-sensitive Emulsion Layer | |
| Emulsion E | 0.3 g as Ag |
| Emulsion F | 0.1 g as Ag |
| Emulsion G | 0.1 g as Ag |
| Gelatin | 0.5 g |
| Coupler C-7 | 0.05 g |
| Coupler C-8 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High Boiling Point Organic Solvent Oil-1 | 0.1 g |
| High Boiling Point Organic Solvent Oil-2 | 0.1 g |
| Tenth Layer: Middle-sensitivity Green-sensitive Emulsion Layer | |
| Emulsion G | 0.3 g as Ag |
| Emulsion H | 0.1 g as Ag |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High Boiling Point Organic Solvent Oil-2 | 0.1 g |
| Eleventh Layer: High-sensitivity Green-sensitive Emulsion Layer | |
| Emulsion I | 0.5 g as Ag |
| Gelatin | 1.0 g |
| Coupler C-8 | 0.1 g |
| Coupler C-4 | 0.3 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High Boiling Point Organic Solvent Oil-1 | 0.02 g |
| High Boiling Point Organic | 0.02 g |

-continued

| | |
|---|---|
| Solvent Oil-2 | |
| Twelfth Layer: Interlayer | |
| Gelatin | 0.6 g |
| Dye D-2 | 0.05 g |
| Dye D-1 | 0.1 g |
| Dye D-3 | 0.07 g |
| Thirteenth Layer: Yellow Filter Layer | |
| Yellow Colloidal Silver | 0.1 g as Ag |
| Gelatin | 1.1 g |
| Color Mixing Preventing Agent Cpd-A | 0.01 g |
| High Boiling Point Organic Solvent Oil-1 | 0.01 g |
| Fourteenth Layer: Interlayer | |
| Gelatin | 0.6 g |
| Fifteenth Layer: Low-sensitivity Blue-sensitive Emulsion Layer | |
| Emulsion J | 0.4 g as Ag |
| Emulsion K | 0.1 g as Ag |
| Emulsion L | 0.1 g as Ag |
| Gelatin | 0.8 g |
| Coupler C-5 | 0.6 g |
| Sixteenth Layer: Middle-sensitivity Blue-sensitive Emulsion Layer | |
| Emulsion L | 0.1 g as Ag |
| Emulsion M | 0.4 g as Ag |
| Gelatin | 0.9 g |
| Coupler C-5 | 0.3 g |
| Coupler C-6 | 0.3 g |
| Seventeenth Layer: High-sensitivity Blue-sensitive Emulsion Layer | |
| Emulsion N | 0.4 g as Ag |
| Gelatin | 1.2 g |
| Coupler C-6 | 0.7 g |
| Eighteenth Layer: First Protective Layer | |
| Gelatin | 0.7 g |
| Ultraviolet Absorbent U-1 | 0.04 g |
| Ultraviolet Absorbent U-2 | 0.01 g |
| Ultraviolet Absorbent U-3 | 0.03 g |
| Ultraviolet Absorbent U-4 | 0.03 g |

-continued

| | |
|---|---|
| Ultraviolet Absorbent U-5 | 0.05 g |
| Ultraviolet Absorbent U-6 | 0.05 g |
| High Boiling Point Organic Solvent Oil-1 | 0.02 g |
| Formalin Scavenger Cpd-C | 0.2 g |
| Formalin Scavenger Cpd-1 | 0.4 g |
| Dye D-3 | 0.05 g |
| Nineteenth Layer: Second Protective Layer | |
| Colloidal Silver | 0.1 mg as Ag |
| Emulsion of Fine Silver Iodobromide Grains (mean grain size 0.06 micron; AgI content 1 mol %) | 0.1 g as Ag |
| Gelatin | 0.4 g |
| Twentieth Layer: Third Protective Layer | |
| Gelatin | 0.4 g |
| Polymethyl Methacrylate (mean grain size 1.5 microns) | 0.1 g |
| Copolymer of Methyl Methacrylate and Acrylic Acid (4/6 by mol, mean grain size 1.5 microns) | 0.1 g |
| Silicone Oil | 0.03 g |
| Surfactant W-1 | 3.0 mg |
| Surfactant W-2 | 0.03 mg |

To all the emulsion layers were added Additives (F-1) to (F-8) in addition to the above-mentioned components. Further, all the layers contain Gelatin Hardening Agent (H-1), Coating Aid Surfactant (W-3) and Emulsification Aid Surfactant (W-4) in addition to the above-mentioned components.

Additionally, phenol, 1,2-benzisothiazolin-3-one, 2-phenoxyethanol and phenethyl alcohol were added to each layer as antiseptic and antifungal agents.

Silver iodobromide emulsions used above are mentioned below.

| | Emulsion | Mean Grain Size (μm) | Fluctuation Coefficient (%) | AgI Content (%) |
|---|---|---|---|---|
| A | Monodispersed 14-hedral grains | 0.25 | 16 | 3.7 |
| B | Monodispersed cubic internal latent image type grains | 0.30 | 10 | 3.3 |
| C | Monodispersed 14-hedral grains | 0.30 | 18 | 5.0 |
| D | Polydispersed twinned crystal grains | 0.60 | 25 | 2.0 |
| E | Monodispersed cubic grains | 0.17 | 17 | 4.0 |
| F | Monodispersed cubic grains | 0.20 | 16 | 4.0 |
| G | Monodispersed cubic internal latent image type grains | 0.25 | 11 | 3.5 |
| H | Monodispersed cubic internal latent image type grains | 0.30 | 9 | 3.5 |
| I | Polydispersed tabular grains (with mean aspect ratio of 4.0) | 0.80 | 28 | 1.5 |
| J | Monodispersed 14-hedral grains | 0.30 | 18 | 4.0 |
| K | Monodispersed 14-hedral grains | 0.37 | 17 | 4.0 |
| L | Monodispersed cubic internal latent image type grains | 0.46 | 14 | 3.5 |
| M | Monodispersed cubic grains | 0.55 | 13 | 4.0 |
| N | Polydispersed tabular grains (with mean aspect ratio of 7.0) | 1.00 | 33 | 1.3 |

Emulsions A to N were color-sensitized as follows:

| Emulsion | Sensitizing Dyes Added | Amount of Dye (g) per mol of Silver Halide | Time of Adding Dyes |
|---|---|---|---|
| A | S-1 | 0.025 | Just after chemical sensitization |
| | S-2 | 0.25 | Just after chemical sensitization |
| B | S-1 | 0.01 | Just after formation of grains |
| | S-2 | 0.25 | Just after formation of grains |
| C | S-1 | 0.02 | Just after chemical sensitization |
| | S-2 | 0.25 | Just after chemical sensitization |
| D | S-1 | 0.01 | Just after chemical sensitization |
| | S-2 | 0.10 | Just after chemical sensitization |
| | S-7 | 0.01 | Just after chemical sensitization |
| E | S-3 | 0.5 | Just after chemical sensitization |
| | S-4 | 0.1 | Just after chemical sensitization |
| F | S-3 | 0.3 | Just after chemical sensitization |
| | S-4 | 0.1 | Just after chemical sensitization |
| G | S-3 | 0.25 | Just after formation of grains |

-continued

| | | | |
|---|---|---|---|
| | S-4 | 0.08 | Just after formation of grains |
| H | S-3 | 0.2 | During formation of grains |
| | S-4 | 0.06 | During formation of grains |
| I | S-3 | 0.3 | Just before chemical sensitization |
| | S-4 | 0.07 | Just before chemical sensitization |
| | S-8 | 0.1 | Just before chemical sensitization |
| J | S-6 | 0.2 | During formation of grains |
| | S-5 | 0.05 | During formation of grains |
| K | S-6 | 0.2 | During formation of grains |
| | S-5 | 0.05 | During formation of grains |
| L | S-6 | 0.22 | Just after formation of grains |
| | S-5 | 0.06 | Just after formation of grains |
| M | S-6 | 0.15 | Just after chemical sensitization |
| | S-5 | 0.04 | Just after chemical sensitization |
| N | S-6 | 0.22 | Just after formation of grains |
| | S-5 | 0.06 | Just after formation of grains |

Compounds used in preparing Sample 301 are mentioned below.

C-1

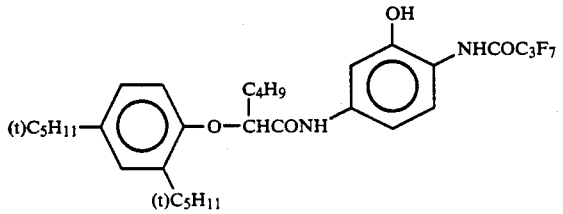

C-2

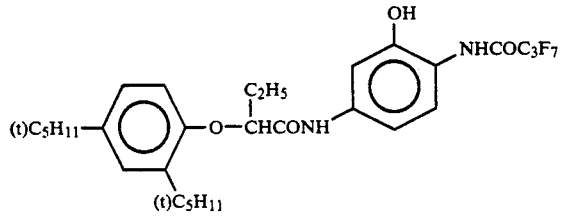

C-3

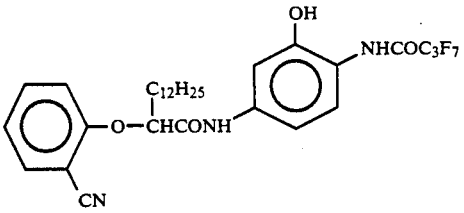

C-4

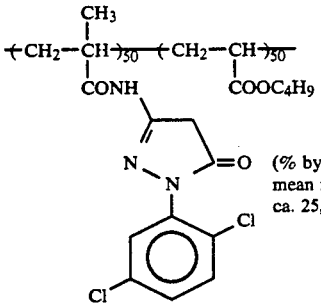

(% by weight)
mean molecular weight:
ca. 25,000

-continued
C-5
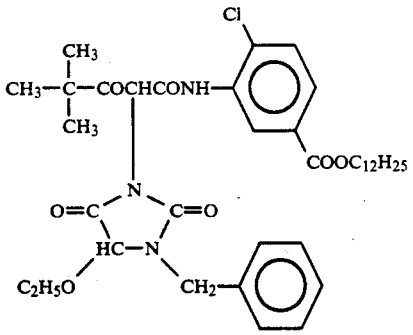
C-6
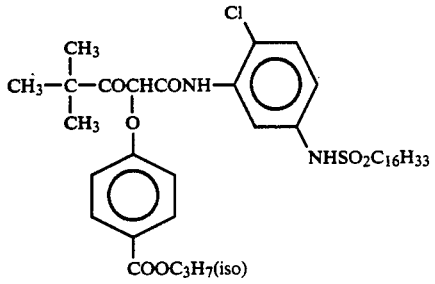
C-7
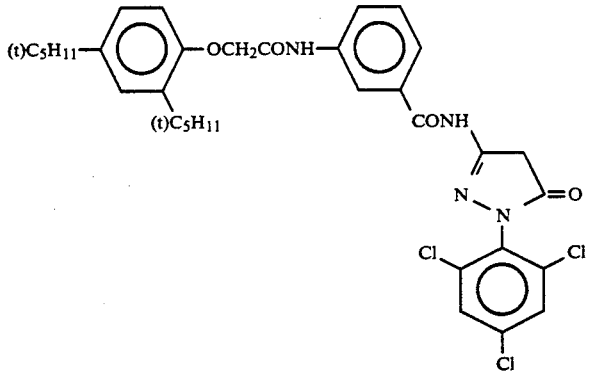
C-8
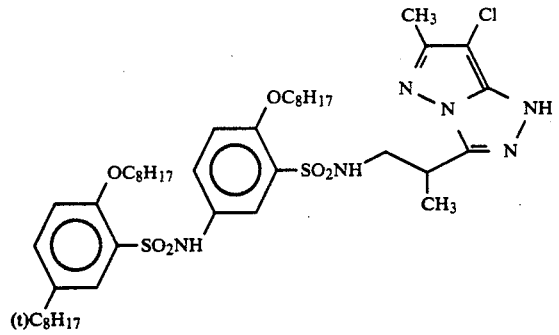
C-9
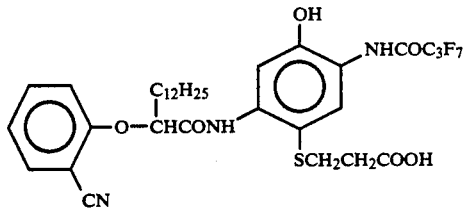
Dibutyl Phthalate Oil-1
Tricresyl Phosphate Oil-2

-continued
Oil-3
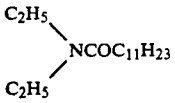
Cpd-A
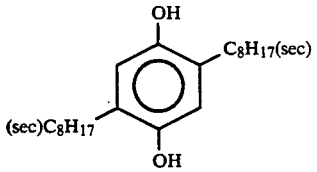
Cpd-B
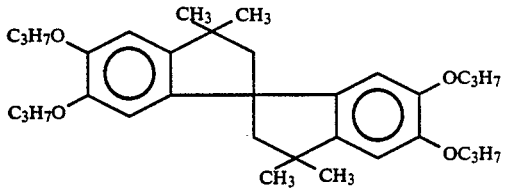
Cpd-C
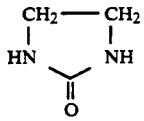
Cpd-D
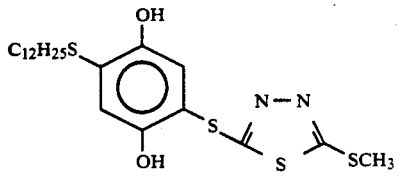
Cpd-E
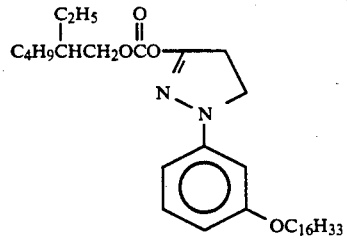
Cpd-F
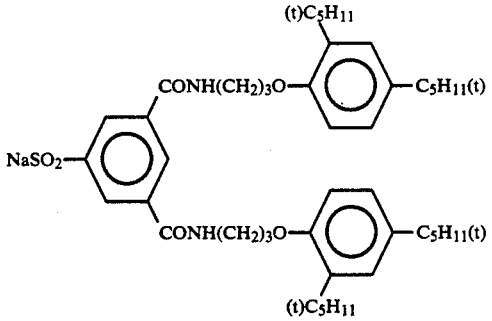
Cpd-G
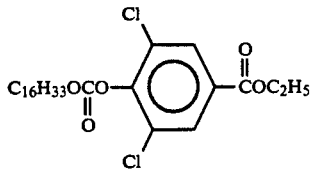

-continued
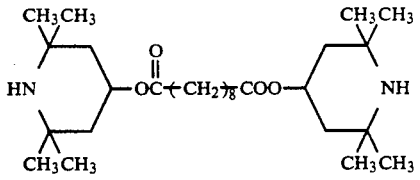
Cpd-H
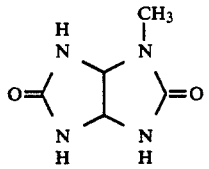
Cpd-I
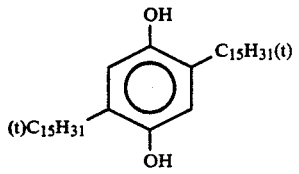
Cpd-J
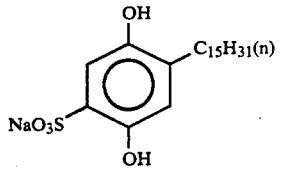
Cpd-K
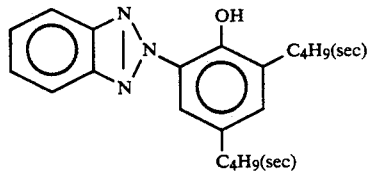
U-1
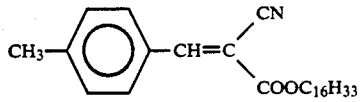
U-2
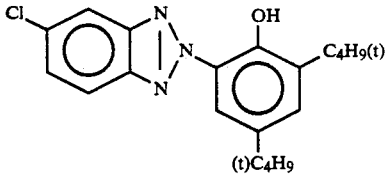
U-3
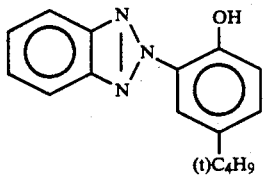
U-4
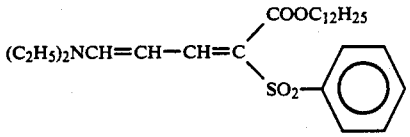
U-5

-continued
U-6
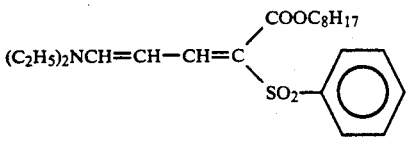
S-1
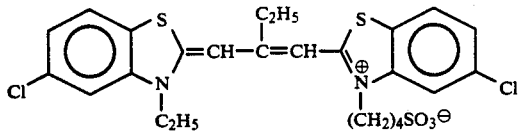
S-2
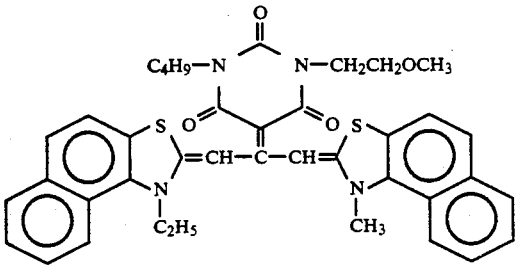
S-3
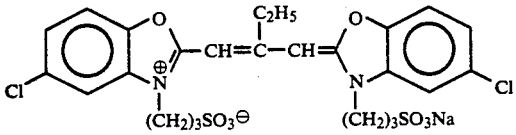
S-4
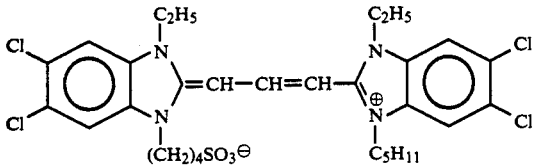
S-5
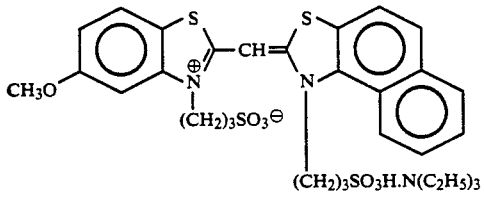
S-6
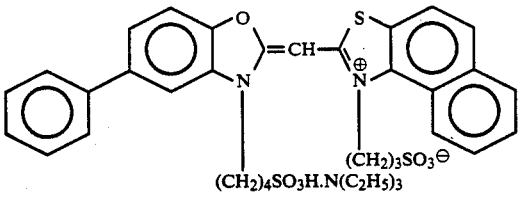
S-7
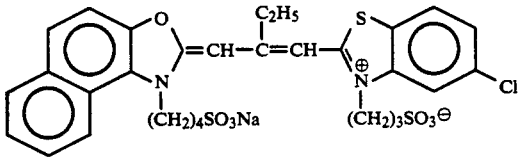
S-8
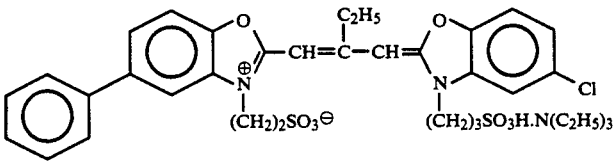

-continued
D-1
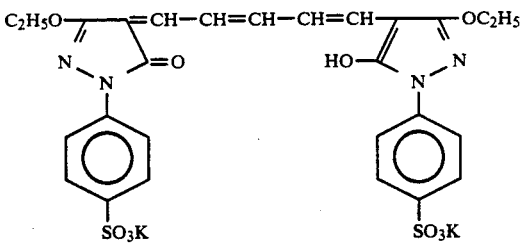
D-2
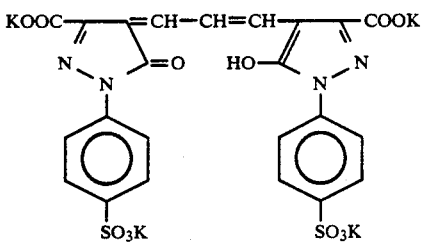
D-3
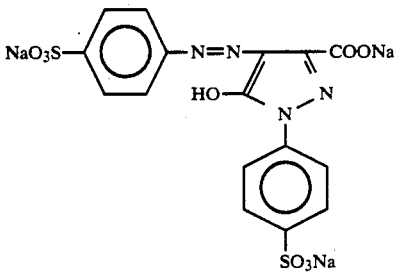
D-4
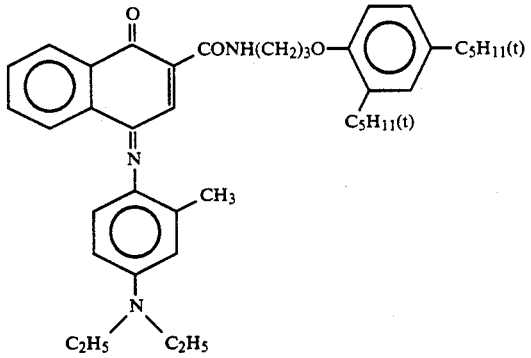
H-1
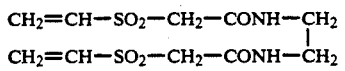
W-1
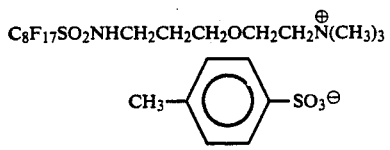
W-2
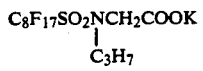
W-3
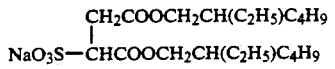

-continued
W-4
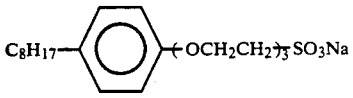
P-1
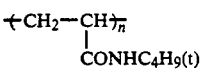
M-1
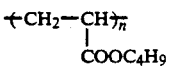
F-1
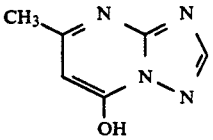
F-2
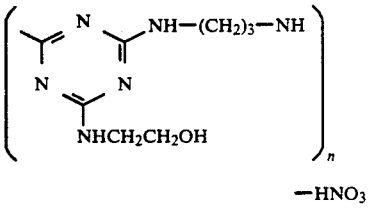
F-3
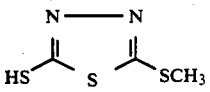
F-4
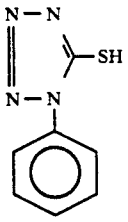
F-5
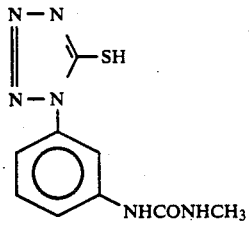
F-6
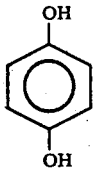
F-7
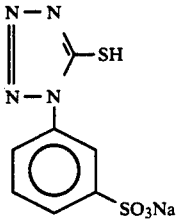

-continued

F-8

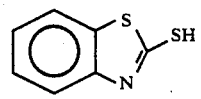

Preparation of Samples Nos. 302 and 303

Samples Nos. 302 and 303 were prepared in the same manner as in the preparation of Sample No. 301, except that Coupler (C-6) in the 16th and 17th layers was replaced by the same molar amount of Coupler (3) and Coupler (41) of the invention, respectively. These samples were developed by the following process and it was found that sample Nos. 302 and 303 gave a good yellow color image with a satisfactory color density as compared with Sample No. 301.

Color Development Process

| Step | Time | Temp. | Tank Capacity | Amount of Replenisher |
|---|---|---|---|---|
| Black-White Development | 6 min | 38° C. | 12 liters | 2.2 l/m$^2$ |
| First Rinsing | 2 min | 38° C. | 4 liters | 7.5 l/m$^2$ |
| Reversal | 2 min | 38° C. | 4 liters | 1.1 l/m$^2$ |
| Color Development | 6 min | 38° C. | 12 liters | 2.2 l/m$^2$ |
| Adjustment | 2 min | 38° C. | 4 liters | 1.1 l/m$^2$ |
| Bleaching | 6 min | 38° C. | 12 liters | 0.22 l/m$^2$ |
| Fixation | 4 min | 38° C. | 8 liters | 1.1 l/m$^2$ |
| Second Rinsing | 4 min | 38° C. | 8 liters | 7.5 l/m$^2$ |
| Stabilization | 1 min | 25° C. | 2 liters | 1.1 l/m$^2$ |

The processing solutions used in the process had the following compositions.

| | Mother Solution | Replenisher |
|---|---|---|
| Black-White Developer: | | |
| Pentasodium Nitrilo-N,N,N-trimethylene-phosphonate | 2.0 g | 2.0 g |
| Sodium Sulfite | 30 g | 30 g |
| Hydroquinone/Potassium monosulfonate | 20 g | 20 g |
| Potassium Carbonate | 33 g | 33 g |
| 1-Phenyl-4-methyl-4-hydroxymethyl-3-pyrazolidone | 2.0 g | 2.0 g |
| Potassium Bromide | 2.5 g | 1.4 g |
| Potassium Thiocyanate | 1.2 g | 1.2 g |
| Potassium Iodide | 2.0 mg | — |
| Water to make | 1000 ml | 1000 ml |
| pH (adjusted with HCl or KOH) | 9.60 | 9.60 |
| Reversal Processing Solution: Mother solution and replenisher were the same. | | |
| Pentasodium Nitrilo-N,N,N-trimethylene-phosphonate | | 3.0 g |
| Stannous Chloride Dihydrate | | 1.0 g |
| P-aminophenol | | 0.1 g |
| Sodium Hydroxide | | 8 g |
| Glacial Acetic Acid | | 15 ml |
| Water to make | | 1000 ml |
| pH (adjusted with HCl or NaOH) | | 6.00 |
| Color Developer: | | |
| Pentasodium Nitrilo-N,N,N-trimethylene-phosphonate | 2.0 g | 2.0 g |
| Sodium Sulfite | 7.0 g | 7.0 g |
| Trisodium Phosphate 12-Hydrate | 36 g | 36 g |
| Potassium Bromide | 1.0 g | — |
| Potassium Iodide | 90 mg | — |
| Sodium Hydroxide | 3.0 g | 3.0 g |

-continued

| | | |
|---|---|---|
| Citrazinic Acid | 1.5 g | 1.5 g |
| N-ethyl-(β-methanesulfonamidoethyl)-3-methyl-4-aminoaniline Sulfate | 11 g | 11 g |
| 3,6-Dithiaoctane-1,8-diol | 1.0 g | 1.0 g |
| Water to make | 1000 ml | 1000 ml |
| pH (adjusted with HCl or KOH) | 11.80 | 12.00 |
| Adjusting Solution: Mother solution and replenisher were the same. | | |
| Disodium Ethylenediamine-tetraacetate Dihydrate | | 8.0 g |
| Sodium Sulfite | | 12 g |
| 1-Thioglycerin | | 0.4 ml |
| Sorbitan Ester (*) | | 0.1 g |
| Water to make | | 1000 ml |
| pH (adjusted with HCl or NaOH) | | 6.20 |
| Bleaching Solution: | | |
| Disodium Ethylenediamine-tetraacetate Dihydrate | 2.0 g | 4.0 g |
| Ammonium Ethylenediamine-tetraacetato/Fe(III) Dihydrate | 120 g | 240 g |
| Potassium Bromide | 100 g | 200 g |
| Ammonium Nitrate | 10 g | 20 g |
| Water to make | 1000 ml | 1000 ml |
| pH (adjusted with HCl or NaOH) | 5.70 | 5.50 |
| Fixing Solution: Mother solution and replenisher were the same. | | |
| Ammonium Thiosulfate | | 8.0 g |
| Sodium Sulfite | | 5.0 g |
| Sodium Bisulfite | | 5.0 g |
| Water to make | | 1000 ml |
| pH (adjusted with HCl or aqueous ammonia) | | 6.60 |
| Stabilizing Solution: Mother solution and replenisher were the same. | | |
| Formalin (37 wt %) | | 5.0 ml |
| Polyoxyethylene-p-monononylphenyl Ether (mean polymerization degree 10) | | 0.5 ml |
| Water to make | | 1000 ml |
| pH | | not adjusted. |

Sorbitan Ester (*):

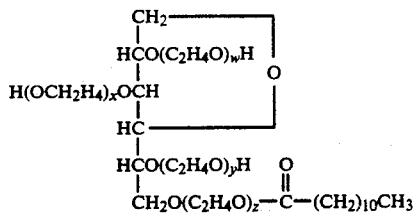

(w + x + y + z = 20)

While the invention has been described in detail and with reference to specific embodiments thereof, it will be apparent to one skilled in the art that various changes and modifications can be made therein without departing from the spirit and scope thereof.

What is claimed is:

1. A silver halide color photographic material, which contains a compound of the following general formula (I) in at least one hydrophilic colloid layer as provided on a support:

(I)

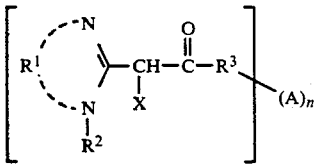

wherein:

$R^1$ represents a non-metallic atomic group necessary for forming a 5-membered unsaturated hereto ring together with a residue of

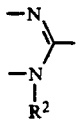

in the formula;

$R^2$ represents a hydrogen atom, an aliphatic group, an aromatic group, or a heterocyclic group;

$R^3$ represents an organic residue;

X represents a group capable of splitting off from the formula when the compound has reacted with the oxidation product of an aromatic primary amine developing agent and forms a structure shown in the following formula (VI) that is bonded to a coupler residue B:

$$B-(L^1)_a-Z-(L^2-Y)_b \quad \text{(VI)}$$

where B represents a residue of a coupler component of formula (I) except X;

Z represents a main part of a compound having a development inhibiting activity, and is bonded to the coupling position of the coupler directly when a is 0 or by a linking group $L^1$ when a is 1;

$L^1$ and $L^2$ each represents a linking group, and the linking group $L^2$ contains a chemical bond which is cleaved in a developer;

Y represents a substituent capable of expressing the development inhibiting activity of Z and is bonded to Z via a linking group $L^2$;

a is 0 or 1, and b is an integer from 0 to 2, and when b is 2, two $(-L^2-Y)$'s may be same as or different from each other;

A represents an acidic dissociating group which may be at any substitutable position in the formula; and n represents an integer of 1 or more;

provided that when A is a substituent in X, the X as split off from the formula when the compound has reacted with the oxidation product of a developing agent does not further react with the oxidation product of the developing agent.

2. The silver halide color photographic material of claim 1, wherein the 5-membered unsaturated heterocyclic group moiety of:

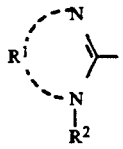

in formula (I) is represented by general formula (A) or (B):

(A)

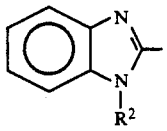

(B)

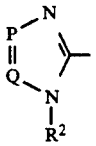

where $R^2$ has the same meaning as that in formula (I); and

P and Q independently represent a carbon atom or a nitrogen atom.

3. The silver halide color photographic material of claim 1, wherein the coupler of formula (VI) is represented by general formulae (VII), (VIII), (IX), (X), (XI), (XII) or (XIII):

(VII)

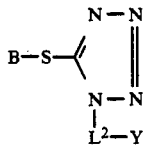

(VIII)

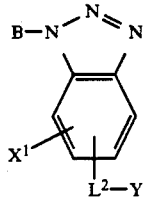

(IX)

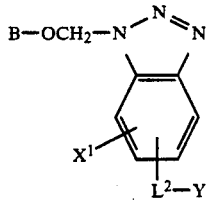

(X)

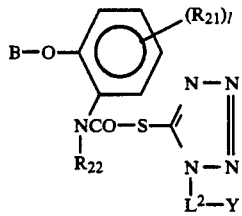

(XI)

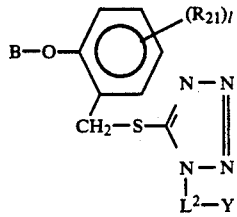

-continued (XII)

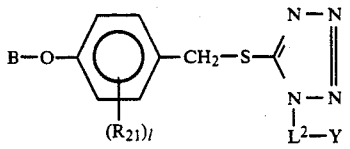

(XIII)

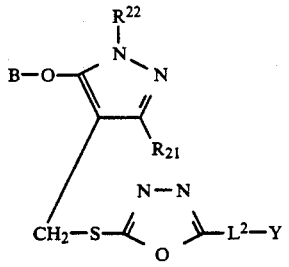

where $X^1$ represents a hydrogen atom, a halogen atom, an alkyl group, an alkenyl group, an alkanamido group, an alkenamido group, an alkoxy group, a sulfonamido group, or an aryl group; $R_{21}$ represents a hydrogen atom, a halogen atom, an alkyl group, an alkenyl group, an aralkyl group, an alkoxy group, an alkoxycarbonyl group, an anilino group, an acylamino group, an ureido group, a cyano group, a nitro group, a sulfonamido group, a sulfamoyl group, a carbamoyl group, an aryl group, a carboxyl group, a sulfo group, a cycloalkyl group, an alkanesulfonyl group, an arylsulfonyl group, or an acyl group; $R_{22}$ represents a hydrogen atom, an alkyl group, an alkenyl group, an aralkyl group, a cycloalkyl group, or an aryl group; l represents 1 or 2, and when l is 2, two $(R_{21})$'s may form a condensed ring; and B, $L^2$ and Y have the same meanings as those in formula (VI).

4. The silver halide color photographic material of claim 1, wherein in the 5-membered unsaturated heterocyclic group moiety of

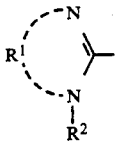

in formula (I), the remaining two ring-forming atoms of $R^1$ are independently a carbon atom, a nitrogen atom, a sulfur atom, a selenium atom or tellurium.

5. The silver halide color photographic material of claim 1, wherein in formula (I), the aliphatic group of $R^2$ is selected from the group consisting of a methyl group, an ethyl group, a 2-ethylhexyl group, a 2-(n-hexyl)-n-decyl group, a vinyl group, an allyl group, and a cyclohexyl group

6. The silver halide color photographic material of claim 1, wherein in formula (I), the aromatic group of $R^2$ is selected from the group consisting of a phenyl group, 2-naphthyl group, and a 2-anthracenyl group.

7. The silver halide color photographic material of claim 1, wherein in formula (I), the heterocyclic group of $R^2$ is selected from the group consisting of a 2-morpholyl group, a 4-pyridyl group and a 2-furanyl group.

8. The silver halide color photographic material of claim 1, wherein in formula (I), $R^3$ is a straight chain or branched, linear or cyclic, saturated or unsaturated, substituted or unsubstituted aliphatic group, an aromatic group, a heterocyclic group, an alkoxy group, an aryloxy group or a heterocyclic-oxy group.

9. The silver halide color photographic material of claim 1, wherein in formula (I), $R^3$ is $-N(R^4)(R^5)$, wherein $R^4$ and $R^5$ each represent an aliphatic group, an aromatic group, a hydrogen atom, or a heterocyclic group.

10. The silver halide color photographic material of claim 1, wherein the acidic dissociating group is selected from the group consisting of —COOH, a phenolic OH, $-S(O)_nH$ (n=0 to 3) $-SO_2NH_2$, $-SO_2NH-R^{31}$, $-SO_2NHCOR^{31}$, $-SO_2NHCO_2R^{31}$, $-CONHCOR^{31}$, $-CONHCO_2R^{31}$, $-CONHSO_2R^{31}$, and $-CONHSO_2NR^{31}R^{32}$, wherein $R^{31}$ is an aliphatic group, an aromatic group, or a heterocyclic group, and $R^{32}$ is a hydrogen atom, an aliphatic group, an aromatic group or a heterocyclic group.

11. The silver halide color photographic material of claim 1, wherein the compound of formula (I) is present in an amount of $1\times10^{-7}$ to 1.0 mol per mol of silver in a layer to which the compound is added or in an adjacent layer.

12. The silver halide color photographic material of claim 1, wherein in formula (I), $R^2$ represents an aliphatic group having from 1 to 30 carbon atoms.

13. The silver halide color photographic material of claim 1, wherein in formula (I), $R^2$ represents an aromatic group having from 6 to 20 carbon atoms.

14. The silver halide color photographic material of claim 1, wherein in formula (I), $R^2$ represents a 5 to 7-membered heterocyclic group having from 6 to 10 carbon atoms and nitrogen, oxygen, sulfur or combinations thereof as hetero atoms.

* * * * *